US006150598A

United States Patent [19]

Suzuki et al.

[11] Patent Number: 6,150,598

[45] Date of Patent: Nov. 21, 2000

[54] TONE DATA MAKING METHOD AND DEVICE AND RECORDING MEDIUM

[75] Inventors: Hideo Suzuki; Masao Sakama, both of Hamamatsu, Japan

[73] Assignee: Yamaha Corporation, Shizuoka-ken, Japan

[21] Appl. No.: 09/162,275

[22] Filed: Sep. 29, 1998

[30] Foreign Application Priority Data

| | | | |
|---|---|---|---|
| Sep. 30, 1997 | [JP] | Japan | 9-284423 |
| Sep. 30, 1997 | [JP] | Japan | 9-284424 |
| Aug. 13, 1998 | [JP] | Japan | 10-244421 |

[51] Int. Cl.[7] ..... G10H 7/00

[52] U.S. Cl. ..... 84/603; 84/626; 84/629

[58] Field of Search ..... 84/603, 622, 626, 84/629

[56] References Cited

U.S. PATENT DOCUMENTS

| | | |
|---|---|---|
| 5,086,685 | 2/1992 | Hanzawa et al. . |
| 5,185,491 | 2/1993 | Izumisawa et al. . |

FOREIGN PATENT DOCUMENTS

| | | |
|---|---|---|
| 0 150 736 | 8/1985 | European Pat. Off. . |
| 0 280 069 | 8/1988 | European Pat. Off. . |
| 0 600 639 | 6/1994 | European Pat. Off. . |
| WO 97/07476 | 2/1997 | WIPO . |

*Primary Examiner*—Jeffrey Donels
*Attorney, Agent, or Firm*—Morrison & Foerster

[57] ABSTRACT

A succession of performance sounds is sampled, and the sampled performance sounds are divided into a plurality of time sections of variable lengths in accordance with respective characteristics of performance expression therein, to extract waveform data of each of the time sections as an articulation element. The waveform data of each of the extracted articulation elements are analyzed in terms of a plurality of predetermined tonal factors to thereby create template data of the individual tonal factors, and the thus-created template data are stored in a data base. Tone performance to be executed is designated by a time-serial sequence of a plurality of articulation elements, in response to which the respective waveform data of the individual articulation elements are read out from the data base to thereby synthesize a tone on the basis of the waveform data. Thus, it is possible to freely execute editing, such as replacement, modification or deletion, of the element corresponding to any desired time section. This arrangement facilitates realistic reproduction of the articulation (style-of-rendition) and control of such articulation reproduction, and achieves an interactive high-quality-tone making technique which provides for free sound making and editing operations by a user.

109 Claims, 32 Drawing Sheets

OPERATIONAL SEQUENCE FOR CREATING DATA BASE

| LABEL OF TONAL FACTOR | EXEMPLARY CONTENTS OF TEMPLATE DATA |
|---|---|
| Timbre (WAVEFORM) | |
| Amp (AMPLITUDE ENVELOPE) | |
| Pitch (PITCH ENVELOPE) | |
| TSC (TIME) | ("1") |

EXAMPLES OF AESEQ

```
AESEQ#1 = ( ATT-Nor, BOD-Vib-nor, BOD-Vib-dep1, BOD-Vib-dep2, REL-Nor )
AESEQ#2 = ( ATT-Nor, BOD-Vib-nor, BOD-Vib-spd1, BOD-Vib-spd2, REL-Nor )
AESEQ#3 = ( ATT-Nor, BOD-Vib-nor, BOD-Vib-d&s1, BOD-Vib-d&s2, REL-Nor )
AESEQ#4 = ( ATT-Nor, BOD-Vib-bri, BOD-Vib-mld1, BOD-Vib-mld2, REL-Nor )
AESEQ#5 = ( ATT-Nor, BOD-Cre-nor, BOD-Cre-vol1, BOD-Cre-vol2, REL-Nor )
AESEQ#6 = ( ATT-Bup-nor, BOD-Nor, REL-Nor )
AESEQ#7 = ( ATT-Nor, BOD-Nor, REL-Bdw-nor )
   •                    •
   •                    •
   •                    •
```

FIG. 5A

EXAMPLES OF AEVQ

```
ATT-Nor      = ( Timb-A-nor, Amp-A-nor, Pit-A-nor, TSC-A-nor )
ATT-Bup-nor  = ( Timb-A-bup, Amp-A-bup, Pit-A-bup, TSC-A-bup )
      •                          •
      •                          •
      •                          •
BOD-Nor      = ( Timb-B-nor, Amp-B-nor, Pit-B-nor, TSC-B-nor )
BOD-Vib-nor  = ( Timb-B-vib, Amp-B-vib, Pit-B-vib, TSC-B-vib )
BOD-Vib-dep1 = ( Timb-B-vib, Amp-B-dp3, Pit-B-dp3, TSC-B-vib )
BOD-Vib-dep2 = ( Timb-B-vib, Amp-B-dp4, Pit-B-dp4, TSC-B-vib )
BOD-Vib-spd1 = ( Timb-B-vib, Amp-B-vib, Pit-B-vib, TSC-B-sp3 )
BOD-Vib-spd2 = ( Timb-B-vib, Amp-B-vib, Pit-B-vib, TSC-B-sp4 )
BOD-Vib-d&s1 = ( Timb-B-vib, Amp-B-dp3, Pit-B-dp3, TSC-B-sp3 )
BOD-Vib-d&s2 = ( Timb-B-vib, Amp-B-dp4, Pit-B-dp4, TSC-B-sp4 )
BOD-Vib-bri  = ( Timb-B-tn3, Amp-B-vib, Pit-B-vib, TSC-B-vib )
BOD-Vib-mld1 = ( Timb-B-tn2, Amp-B-vib, Pit-B-vib, TSC-B-vib )
BOD-Vib-mld2 = ( Timb-B-tn1, Amp-B-vib, Pit-B-vib, TSC-B-vib )
BOD-Cre-nor  = ( Timb-B-cre, Amp-B-cre, Pit-B-cre, TSC-B-cre )
BOD-Cre-vol1 = ( Timb-B-cr3, Amp-B-cr3, Pit-B-cr3, TSC-B-cre )
BOD-Cre-vol2 = ( Timb-B-cr4, Amp-B-cr4, Pit-B-cr4, TSC-B-cre )
      •                          •
      •                          •
      •                          •
REL-Nor      = ( Timb-R-nor, Amp-R-nor, Pit-R-nor, TSC-R-nor )
REL-Bdw-nor  = ( Timb-R-bdw, Amp-R-bdw, Pit-R-bdw, TSC-R-bdw )
      •                          •
      •                          •
      •                          •
```

FIG. 5B

DETAILED EXAMPLE OF AEVQ CONTAINING ATTRIBUTE INFO.

| STYLE OF RENDITION / TEMPLATE | LABEL (INDEX) | ATT-Nor | ATT-Bup-nor | ATT-Bup-dp1 | ATT-Bup-dp2 | ATT-Bup-sp1 | ATT-Bup-sp2 | |
|---|---|---|---|---|---|---|---|---|
| | ATTRIBUTE (ATR) | ATTACK | | | | | | |
| | | NORMAL | BEND-UP | | | | | BEND-DOWN |
| | | | NORMAL | DEPTH | | SPEED | | ------- |
| | | | | SMALL | GREAT | LOW | HIGH | |
| Timbre | | Timb-A-nor | Timb-A-bup | = | = | = | = | ------- |
| Amp | | Amp-A-nor | Amp-A-bup | = | = | = | = | ------- |
| Pitch | | Pit-A-nor | Pit-A-bup | Pit-A-dp1 | Pit-A-dp2 | = | = | ------- |
| TSC | | TSC-A-nor | TSC-A-bup | = | = | TSC-A-sp1 | TSC-A-sp2 | ------- |

FIG. 6

OUTLINE OF TONE SYNTHESIS

EXAMPLE OF AUTOMATIC PERFORMANCE DATA (EXTRACT A PLURALITY OF PARTIAL TEMPLATE WAVEFORMS FROM ORIGINAL WAVEFORM HAVING PLURAL VIBRATO CYCLES)

⇩

IN TONE SYNTHESIS, EXECUTE LOOPED READOUT & CROSS-FADE SYNTHESIS WITH PARTIAL TEMPLATE WAVEFORMS REARRANGED

⇩

(EXAMPLE) a1, b2, c3, a4, b1, a2, b3, c4, c1, c2, a3, b4

TONE DATA MAKING METHOD AND DEVICE AND RECORDING MEDIUM

BACKGROUND OF THE INVENTION

The present invention relates to a tone data making method, device and recording medium which can be suitably used in electronic musical instruments and the like, to provide for generation of a high-quality tone waveform with musical "articulation" and facilitate control of the tone waveform generation. It will be appreciated that the present invention has a wide variety of applications as a tone generating device and method for use in various tone or sound producing equipment, other than electronic musical instruments, such as game machines, personal computers and multimedia facilities.

It is important to note that the term "tone" appearing here and there in this specification is used in the broad sense of the term and encompasses all possible types of sound including human voices, various effect sounds and sounds occurring in the natural world, rather than being limited to musical sounds alone.

In the conventional tone generators based on the so-called waveform memory reading scheme (PCM or Pulse Code Modulation scheme), which are commonly used today in electronic musical instruments and the like, a single or plural cycles of waveform data corresponding to a predetermined timbre or tone color are prestored in memory, and a sustained tone waveform is generated by reading out the prestored waveform data at a rate corresponding to a desired pitch of each tone to be generated. In an alternative, data of an entire waveform, covering from the start to end of a tone to be generated, are prestored in memory, so that a single tone is generated by reading out the prestored waveform data at a rate corresponding to a desired pitch of the tone.

With such PCM tone generators, when a user or player desires to make some modification to the prestored waveform, rather than merely reading out the waveform exactly as prestored, for impartment of particular performance expression to a generated tone, it has been conventional to perform control on three major tonal factors: tone pitch; tone volume; and timbre or tone color. Specifically, for the tone pitch control, the waveform data readout rate is appropriately modulated, in accordance with an optionally selected pitch envelope, to thereby give a pitch modulation effect such as a vibrato, attack pitch or the like. For the tone volume control, a tone volume amplitude envelope based on a given envelope waveform is imparted to the read-out waveform data or the tone volume amplitude of the read-out waveform data is modulated cyclically, to impart a tremolo effect or the like. Further, for the tone color control, the read-out waveform data is subjected to a filtering process.

In addition, multi-track sequencers have been known, which are arranged to collectively sample a succession of tones actually performed live (i.e., a musical phrase) for recording on a single track so that individual musical phrase waveforms thus recorded on a plurality of different tracks are reproductively sounded in combination with automatic performance tones based on sequence performance data recorded separately from the musical phrase waveforms.

Furthermore, recording, in PCM data, the whole of tone waveform data of a music piece actually performed live and then simply reproducing the thus-recorded PCM data is a well-known music recording technique that is normally applied to production of CDs (Compact Disks).

Generally, in cases where an experienced player performs a musical phrase on a natural acoustic musical instrument, such as a piano, violin or saxophone, individual tones of the musical phrase tend to be performed with some musical "articulation" that, rather than being uniform throughout the phrase, would subtly differ between the individual tones, between inter-tone connections or between rising, sustained and falling phases of some of the tones, depending on a general image of the music piece or sensibility of the player, even though the musical phrase is performed on the same musical instrument. Presence of such "articulation" may give the listeners a truly good impression of the performed tones.

The above-mentioned technique of recording, as PCM waveform data, exactly the whole of tone waveform data of a music piece actually performed live by an experienced player, which is normally applied to compact disk production, would provide for realistic reproduction of "articulation" just as executed by the player, since it enables realistic and high-quality reproduction of the live performance. However, due to the fact that such a known recording technique only permits mere reproduction of a fixed music piece (i.e., a music piece just as originally recorded), it can not be used as an "interactive" tone making technique which allows users to freely create tones and edit the thus-created tones on an electronic musical instrument, multimedia facility or the like.

In contrast, the PCM tone generator technique known in the field of electronic musical instruments and the like allows users to create desired tones and impart some degree of performance expression to generated tones. However, the known PCM tone generator technique is not sufficient to achieve such "articulation" that is natural in terms of both tonal quality and performance expression. For example, according to the PCM tone generator technique of this type, there tends to be imposed a significant limitation on the quality of generated tones, because waveform data prestored in memory are just the result of merely sampling a single tone performed on a natural acoustic musical instrument. In particular, with the PCM tone generator technique, it is not possible to reproduce or express articulation or style of rendition that was employed during an actual performance to connect together predetermined tones. For example, in the case of a slur performance where a group of musical notes is performed smoothly together, the conventional electronic musical instruments and the like based on the PCM tone generator technique can not reproduce articulation or style of rendition providing sound quality comparable to that achieved by a live performance on a natural acoustic musical instrument, because it just relies on a simple approach of merely smoothly varying the rate of waveform data readout from the memory or controlling a tone volume envelope to be imparted to generated tones. Besides, even tones of a same pitch produced by a same musical instrument would in effect present different or non-uniform articulation in their attack phases, depending on a difference in musical phrases to which they belong or on their performance occasions even when they are within a same musical phrase; however, such a subtle difference in the articulation can not be expressed appropriately by the electronic musical instrument or the like using the known PCM tone generator technique.

Furthermore, tone generation control carried out in the conventional electronic musical instruments and the like for desired performance expression tends to be relatively monotonous and can never be said to be sufficient. For example, whereas it has been conventionally known to execute tone control in response to a performance touch on a key or the like, the conventional technique can only control tone volume variation characteristics and operating characteristics of the tone color filter used and can never freely control tonal characteristics separately for, e.g., each of the sounding phrases, from the rising to falling phases, of a tone. Further, for tone color control, the conventional technique can not afford sufficient tone color variations corresponding to various performance expression, because it just reads out, from memory, waveform data corresponding to a tone color selected prior to a performance and then, during generation of tones, variably controls the corresponding waveform data via a filter or otherwise in response to varying performance expression. Besides, due to the fact that the shape and other characteristics of envelope waveforms, employed in the conventional technique, for controlling the tone pitch, volume, etc. are each set and controlled while treating the whole of a continuous envelope (from the rise to fall thereof) as a single unit, it is not possible to freely perform operations on the individual phases or segments of the envelope, such as partial replacement (i.e., replacement of a desired segment) of the envelope.

Moreover, the above-mentioned multi-track sequencer technique can in no way effect partial editing (such as partial replacement or characteristic control) of a musical phrase waveform because it just records musical phrase waveform data of a live performance. Thus, this technique also can not be used as an interactive tone making technique which allows users to freely create tones on an electronic musical instrument, multimedia facility or the like.

Furthermore, although ordinary sounds occurring in the natural world as well as musical performance tones generally contain very delicate "articulation" varying over time, all the conventional techniques are unable to controllably reproduce the "articulation" in a skillful, appropriate manner.

SUMMARY OF THE INVENTION

It is therefore an object of the present invention to provide an interactive high-quality-tone making technique which, in generating a tone (including not only a musical sound but also any other ordinary type of sound, as noted above) using an electronic musical instrument or other electronic device, achieves realistic reproduction of articulation and facilitates control of the articulation reproduction, to thereby allow users to freely create a tone and edit the thus-created tone on an electronic musical instrument, multimedia facility or the like.

It is another object of the present invention to provide a novel automatic performance device and method based on such an interactive high-quality-tone making technique.

It is still another object of the present invention to provide a novel tone data editing device and method based on the interactive high-quality-tone making technique.

It is still another object of the present invention to provide a novel technique for connecting together waveform data or control data.

It is still another object of the present invention to provide a novel vibrato sound generating device.

Note that the term "articulation" is used in this specification in its commonly-known sense and should be construed so broadly as to encompass "syllable", "inter-tone connection", "block of a plurality of tones (phrase)", "partial characteristic of a tone", "style of tone generation", "style of rendition", "performance expression" and so forth.

According to an aspect of the present invention, there is provided a tone data making method, which comprises the steps of: sampling a performance of a single or a plurality of tones; dividing the performance, sampled by the step of sampling, into a plurality of time sections of variable lengths in accordance with characteristics of performance expression therein, to extract waveform data of each of the time sections as an articulation element; analyzing the waveform data of each of the articulation elements, extracted by the step of dividing, in terms of a plurality of predetermined tonal factors and generating tonal characteristic data indicative of respective characteristics of the tonal factors in the articulation element; and storing in a data base the tonal characteristic data corresponding to the extracted articulation elements.

In a preferred implementation, the tone data making method further comprises the steps of: designating a tone performance to be executed, by a time-serial combination of a plurality of the articulation elements; reading out, from the data base, the tonal factor characteristic data corresponding to the articulation elements designated by the step of designating; synthesizing waveform data corresponding to the designated articulation elements, on the basis of each of the tonal factor characteristic data read out from the data base; and sequentially connecting together the waveform data, synthesized for individual ones of the designated articulation elements, to thereby generate a succession of performance tones comprising the time-serial combination of the articulation elements.

According to another aspect of the present invention, there is provided a tone synthesizing device, which comprises: a storage section that stores therein tonal factor characteristic data relating to predetermined tonal factors of partial tone waveforms corresponding to various articulation elements; a designating section that designates a tone performance to be executed, by a time-serial combination of a plurality of the articulation elements; a readout section that reads out, from the storage section, tonal factor characteristic data, indicative of respective characteristics of the tonal factors, corresponding to the articulation elements designated by the designating section; a synthesizing section that synthesizes partial waveform data corresponding to the designated articulation elements, on the basis of each of the tonal factor characteristic data read out from the storage section; and a section that sequentially connects together the partial waveform data, synthesized for individual ones of the designated articulation elements, to thereby generate a succession of performance tones comprising the time-serial combination of the articulation elements.

According to still another aspect of the present invention, there is provided a tone synthesizing method, which comprises: a first step of dividing one or more continuous tones into a plurality of time elements and supplying element data indicative of a tonal characteristic for each of the time elements; a second step of selecting a particular one of the time elements; a third step of selecting desired element data from among a plurality of element data stored in a data base and replacing the element data of the particular time element, selected by the second step, with the selected element data; and a fourth step of generating a tone waveform for each of the time elements on the basis of the element data for the time element. Thus, according to this tone synthesizing method, the one or more continuous tones are synthesized by sequentially connecting together the tone waveforms of individual ones of the time elements generated by the fourth step and the synthesized one or more continuous tones have tonal characteristics having been variably controlled in accordance with replacement of the element data by the third step. This arrangement provides for various editing operations, such as free replacement of any desired part of one or more continuous tones with another tone element, and thereby can generate, with free controllability, high-quality tones having musical articulation.

According to still another aspect of the present invention, there is provided a tone synthesizing method, which comprises: a first step of dividing one or more continuous tones into a plurality of time elements and supplying variation data indicative of respective variations of a plurality of tonal factors for each of the time elements; a second step of selecting a particular one of the time elements; a third step of selecting desired variation data from among a plurality of variation data of a predetermined tonal factor stored in a data base and replacing the variation data of the predetermined tonal factor for the particular time element, selected by the second step, with the selected variation data; and a fourth step of generating a tone waveform for each of the time elements on the basis of the variation data of the plurality of tonal factors in the time element. Thus, according to this tone synthesizing method, the one or more continuous tones are synthesized by sequentially connecting together the tone waveforms of individual ones of the time elements generated by the fourth step and the synthesized one or more continuous tones have tonal characteristics having been variably controlled in accordance with replacement of the variation data by the third step. This arrangement also provides for various editing operations, such as free replacement of a characteristic of any desired part of one or more continuous tones with another characteristic, and thereby can generate, with free controllability, high-quality tones having musical articulation.

According to yet another aspect of the present invention, there is provided a tone synthesizing method, which comprises: a first step of sequentially generating a plurality of instruction data corresponding to a plurality of tonal factors, for each of successive time sections; a second step of generating respective control waveform data of the plurality of tonal factors, in response to the instruction data generated by the first step; and a third step of synthesizing a tone waveform in the time section, on the basis of the respective control waveform data of the plurality of tonal factors generated by the second step. This arrangement can generate tones having a plurality of tonal factors that vary in a complex manner in accordance with the corresponding control waveform data, which would enhance freedom of timewise tone variations and thus achieve enriched variations of the tones.

According to another aspect of the present invention, there is provided an automatic performance device, which comprises: a storage section that sequentially stores therein style-of-rendition sequence data for a plurality of performance phrases in a predetermined order of performance thereof, each of the style-of-rendition sequence data describing one of the performance phrases in a time-serial sequence of a plurality of articulation elements; a reading section that reads out the style-of-rendition sequence data from said storage section; and a waveform generating section that, in accordance with the style-of-rendition sequence data read out by said reading section, sequentially generate waveform data corresponding to the articulation elements constituting a style-of-rendition sequence specified by the read-out style-of-rendition sequence data.

According to still another aspect of the present invention, there is provided a tone data editing device, which comprises: a tone data base section that, for each of a plurality of performance phrases with musical articulation, divides one or more sounds constituting the performance phrase into a plurality of partial time sections and stores therein an articulation element sequence sequentially designating articulation elements for individual ones of the partial time sections; a first section that designates a desired style of rendition; and a second section that searches through said data base section for the articulation element sequence corresponding to the style of rendition designated by said first section, whereby a search is permitted to see whether or not a desired style of rendition is available from said tone data base section.

According to still another aspect of the present invention, there is provided a sound waveform generating device, which comprises: a storage section that stores therein template data descriptive of partial sound waveforms corresponding to partial time sections of a sound; a reading section that, in accordance with passage of time, reads out the template data descriptive of a plurality of the partial sound waveforms; a connection processing section that, for each particular one of the template data read out by said reading section from said storage section, defines a manner of connecting the particular template data and other template data adjoining the particular template data, and connects together an adjoining pair of the template data, read out by said reading section, in accordance with the defined manner of connecting; and a waveform generating section that generates partial sound waveform data on the basis of the template data connected by said connection processing section.

According to yet another aspect of the present invention, there is provided a vibrato sound generating device, which comprises: a storage section that stores therein a plurality of waveform data sets, each of said waveform data sets having been sporadically extracted from an original vibrato-imparted waveform; and a reading section that repetitively reads out one of the waveform data sets while sequentially switching the waveform data set to be read out and thereby executes a waveform data readout sequence corresponding to a predetermined vibrato period, said reading section repeating the waveform data readout sequence to thereby provide a vibrato over a plurality of vibrato periods.

In short, the tone data making and tone synthesizing techniques according to the present invention are characterized by analyzing articulation of a sound and executing tone editing or tone synthesis individually for each articulation element, so that the inventive techniques carry out tone synthesis by modelling the articulation of the sound. For this reason, the tone data making and tone synthesizing techniques according to the present invention may each be called a sound articulation element modelling (abbreviated "SAEM") technique.

It will be appreciated that the principle of the present invention may be embodied not only as a method invention but also as a device or apparatus invention. Further, the present invention may be embodied as a computer program as well as a recording medium containing such a computer program. In addition, the present invention may be embodied as a recording medium containing waveform or tone data organized by a novel data structure.

BRIEF DESCRIPTION OF THE DRAWINGS

For better understanding of the above and other features of the present invention, the preferred embodiments of the invention will be described in greater detail below with reference to the accompanying drawings, in which:

FIGS. 5A and 5B are diagrams showing detailed examples of articulation element sequences and articulation element vectors stored in an articulation data base section of FIG. 4;

FIG. 6 is a diagram showing detailed examples of the articulation element vectors containing attribute information;

DETAILED DESCRIPTION OF THE PREFERRED EMBODIMENTS

Exemplary Manner of Creating Tone Data Base

As note earlier, in cases where an experienced player performs a substantially continuous musical phrase on a natural acoustic musical instrument, such as a piano, violin or saxophone, individual tones of the phrase tend to be performed with some musical "articulation" that, rather than being uniform throughout the phrase, would subtly differ between the individual tones, inter-tone connections or rising, sustained and falling segments of some of the tones, depending on a general image of the music piece or sensibility of the player, although the phrase is performed on the same musical instrument. Presence of such "articulation" can give the listeners a truly good impression of the performed tones.

Generally, in a performance of a musical instrument, the "articulation" would present itself as a reflection of a particular style of rendition or performance expression employed by the player. Thus, it should be noted that the terms "style of rendition" or "performance expression" and "articulation" as used herein are intended to have a virtually same meaning. Among various examples of the style of rendition are staccato, tenuto, slur, vibrato, tremolo, crescendo and decrescendo. When a player performs a substantially continuous musical phrase on a natural acoustic musical instrument, various different styles of rendition are normally employed in various musical phases as dictated by a music score or the player's sensibility, and various different articulation would result from such different styles of rendition employed by the player.

Figures 1, 3:
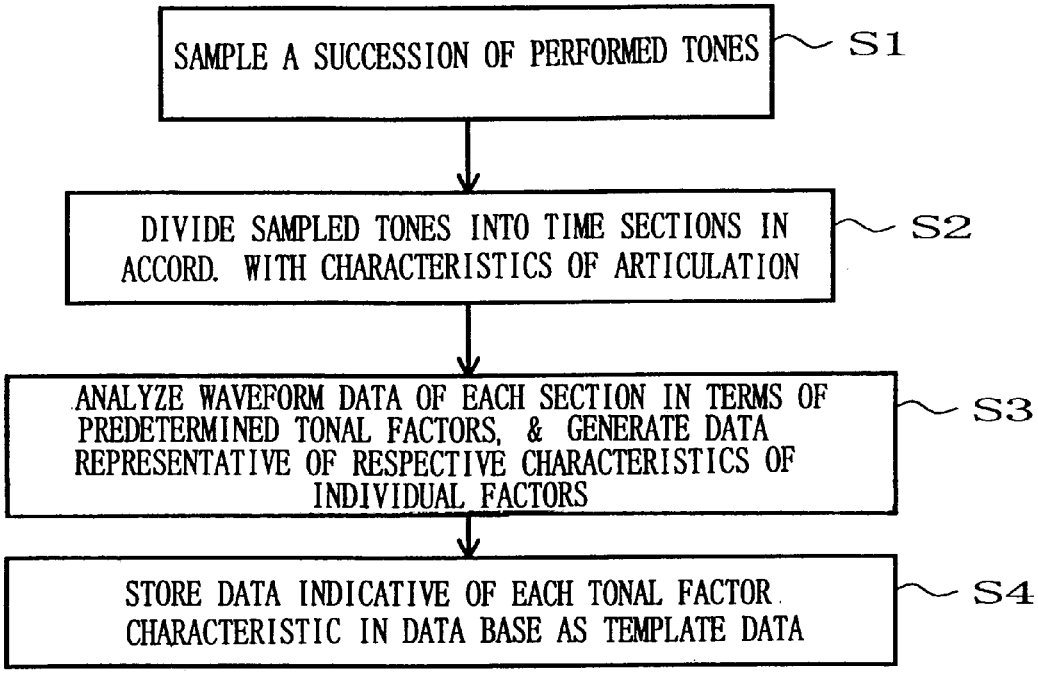
FIG. 1 is a flow chart showing an example of an operational sequence for creating a tone data base by a tone data making method in accordance with a preferred embodiment of the present invention.
FIG. 3 is a diagram showing detailed examples of a plurality of tonal factors analytically determined from a waveform corresponding to a single articulation element.

FIG. 1 is a flow chart showing an example manner in which a tone data base is created in accordance with the principle of the present invention. First step S1 samples a succession of actually performed tones (a single tone or a plurality of tones). Let's assume here that an experienced player of a particular natural acoustic musical instrument performs a predetermined substantially-continuous musical phrase. The resultant series of performed tones is picked up via a microphone and sampled at a predetermined sampling frequency so as to provide PCM (Pulse Code Modulated) waveform data for the entire phrase performed. The thus-provided PCM waveform data are high-quality data that can also be superior in the musical sense.

Figure 2:
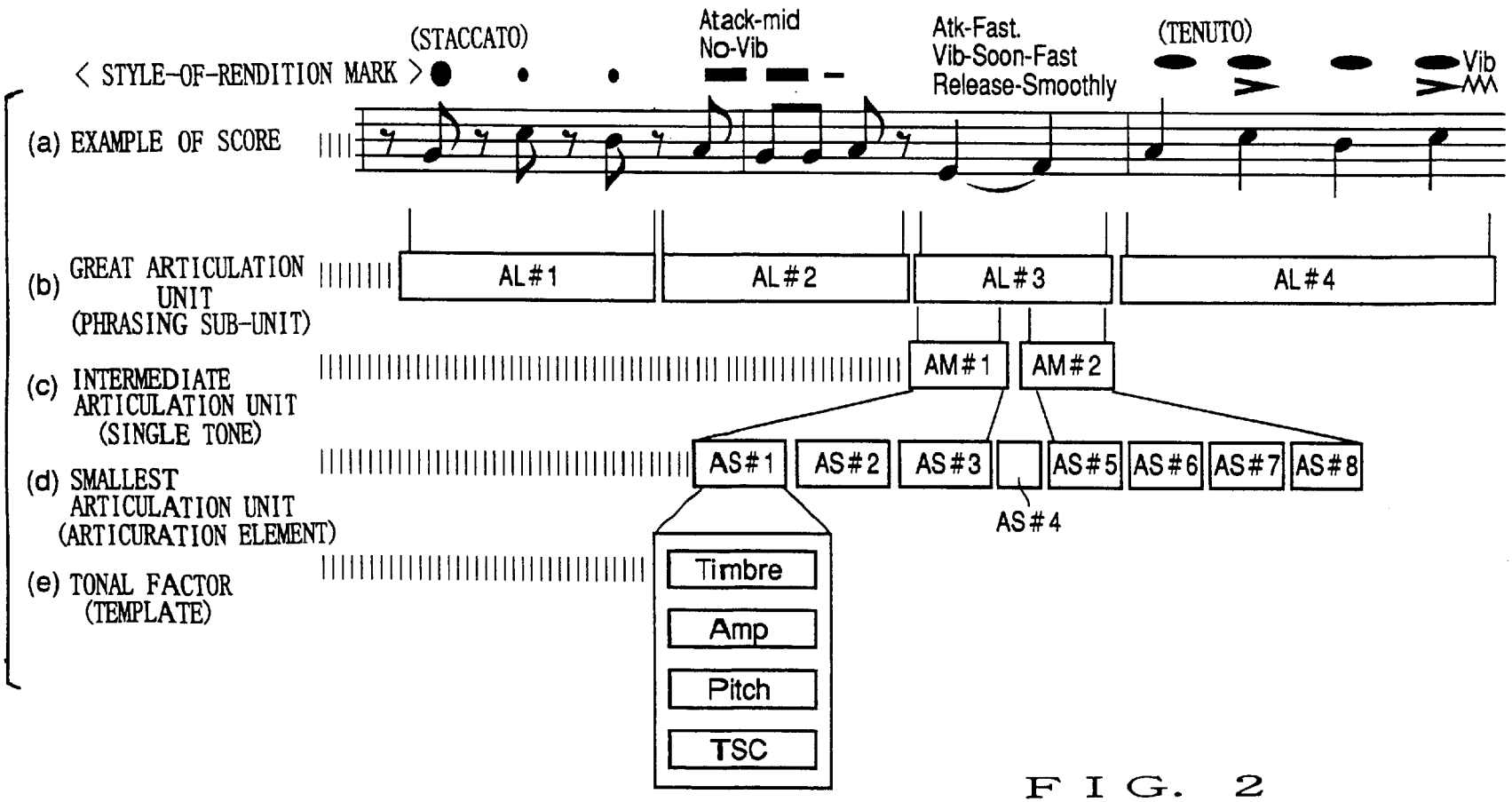
FIG. 2 is a diagram showing an example music score representing a musical phrase, an exemplary manner of dividing the musical phrase into performance sections on an articulation-by-articulation basis.

For purposes of explanation, there is shown, in section (a) of FIG. 2, an example music score depicting a substantially continuous musical phrase. "STYLE-OF-RENDITION MARK" put right above the music score illustratively show several styles of rendition in accordance with which the musical phrase written on the music score is to be performed. However, the score with such style-of-rendition marks is not always necessary for the sampling purposes at step S1; that is, in one alternative, the player may first perform the musical phrase in accordance with an ordinary music score, and then a music score with style-of-rendition marks may be created by analyzing the sampled waveform data to determine styles of rendition actually employed in time-varying performance phases of the phrase. As will be described later, such a music score with style-of-rendition marks may be highly helpful to ordinary users in extracting desired data from among a data base created on the basis of the sampled data and connecting together the extracted data to create a desired performance tone, rather than being helpful in the sampling of step S1. However, to illustratively describe how the musical phrase written on the music score in section (a) of FIG. 2 was actually performed, the following paragraphs explain the meanings of the style-of-rendition marks on the illustrated music score.

The style-of-rendition marks in black circles, written in relation to first three notes in a first measure, each represent a "staccato" style of rendition, and the size of the black circles represents a tone volume.

The style-of-rendition marks in black rectangles, written in relation to next notes along with letters "Atack-Mid, No-Vib", represent a style of rendition where a medium-level attack is to be given with no vibrato effect.

The style-of-rendition marks in letters "Atk-Fast, Vib-Soon-Fast, Release-Smoothly", written in relation to notes interconnected by a slur in the latter half of a second measure, represent a style of rendition where an attack is to rise fast, a vibrato is to get fast promptly and a release is to be smooth.

The style-of-rendition marks in black ovals in a third measure represent a "tenuto" style of rendition. In the third measure in section (a) of FIG. 2, there are also written style-of-rendition marks indicating that the tone volume is to become progressively low and a style-of-rendition mark indicating that a vibrato effect is to be imparted at the end of a tone.

From the music score in section (a) of FIG. 2, it will be seen that a variety of styles of rendition or performance expression are employed even in the short musical phrase made up of only three measures.

Note that these style-of-rendition marks may of course be in any other forms than illustratively shown in section (a) of FIG. 2 as long as they can represent particular styles of rendition in an appropriate manner. Whereas marks more or less representative of various styles of rendition have been used in the traditional music score making, it is preferable that more precise or specific style-of-rendition marks, having never been proposed or encountered heretofore, be employed in effectively carrying out the present invention.

Referring back to FIG. 1, step S2 divides a succession of performed tones, sampled at step S1, into a plurality of time sections of variable lengths in accordance with respective characteristics of performance expression (namely, articulation) therein. This procedure is completely different from the conventional approach where waveform data are divided and analyzed for each of regular, fixed time frames as known in the Fourier analysis. Namely, because a variety of articulation is present in the sampled succession of performed tones, time ranges of the tones corresponding to the individual articulation would have given different lengths rather than a uniform length. Thus, the time sections, resulting from dividing the succession of performed tones in accordance with the respective characteristics of performance expression (namely, articulation), would also have different lengths.

Other sections (b), (c) and (d) of FIG. 2 hierarchically show exemplary manners of dividing the sampled succession of performed tones. Specifically, section (b) of FIG. 2 shows an exemplary manner in which the succession of performed tones is divided into relatively great articulation blocks which will hereinafter be called "great articulation units" and are, for convenience, denoted in the figure by reference characters AL#1, AL#2, AL#3 and AL#4. These great articulation units may be obtained by dividing the succession of performed tones for each group of phrasing sub-units that are similar to each other in general performance expression. Further, section (c) of FIG. 2 shows an exemplary manner in which each of the great articulation units (unit AL#3 in the illustrated example) is divided into intermediate articulation units which are, for convenience, denoted in the figure by reference characters AM#1 and AM#2. These intermediate articulation units may be obtained by roughly dividing the great articulation unit for each of the tones. Furthermore, section (d) of FIG. 2 shows an exemplary manner in which each of the intermediate articulation units (units AM#1 and AM#2 in the illustrated example) is divided into smallest articulation units which are, for convenience, denoted in the figure by reference characters AS#1 to AS#8. These smallest articulation units AS#1 to AS#8 correspond to various portions of the same tone having different performance expression, which typically include an attack portion, body portion (i.e., relatively stable portion presenting steady characteristics), release portion of the tone and a connection or joint between that tone and an adjoining tone.

In the illustrated example, the smallest articulation units AS#1, AS#2 and AS#3 correspond to the attack portion and first and second body portions, respectively, of a tone (a preceding one of two slur-connected tones) constituting the intermediate articulation unit AM#1, and the smallest articulation units AS#5, AS#6, AS#7 and AS#8 correspond to the first, second and third body and release portions, respectively, of a tone (a succeeding one of the two slur-connected tones) constituting the intermediate articulation unit AM#2. The reason why a single tone has a plurality of body portions, such as first and second body portions, is that even the same tone has different articulation—e.g., different vibrato speeds—that would result in a plurality of body portions. The smallest articulation unit AS#4 corresponds to a connecting region provided by the slur between the adjoining tones, and it may be extracted out of one of the two smallest articulation units AS#1 and AS#2 (either from an ending portion of the unit AS#1 or from a starting portion of the unit AS#2) by properly cutting the one unit from the other. Alternatively, the smallest articulation unit AS#4 corresponding to the connection by the slur between the tones may be extracted as an independent intermediate articulation unit from the very beginning, in which case the great articulation unit AL#3 is divided into three intermediate articulation units and the middle intermediate articulation unit of these, i.e., a connection between the other two units, is set as the smallest articulation unit AS#4. In such a case where the smallest articulation unit AS#4 corresponding to the connection by the slur between the tones is extracted as an independent intermediate articulation unit from the very beginning, it may be applied between other tones to be interconnected by a slur.

The smallest articulation units AS#1 to AS#8 as shown in section (d) of FIG. 2 correspond to the plurality of time sections provided at step S2. In the following description, these smallest articulation units will also be referred to as "articulation elements", or merely "elements" in some cases. The manner of providing the smallest articulation units is not necessarily limited to the one employed in the above-described example, and the smallest articulation units, i.e., articulation elements, do not necessarily correspond only to portions or elements of a tone.

At next step S3 of FIG. 1, waveform data of each of the divided time sections (the smallest articulation units AS#1 to AS#8, namely, articulation elements) are analyzed in terms of a plurality of predetermined tonal factors, so as to generate data representing respective characteristics of the individual tonal factors. Among the predetermined tonal factors to be considered here are, for example, waveform (timbre or tone color), amplitude (tone volume), tone pitch and time. These tonal factors are not only components (articulation elements) of the waveform data in the time section but also components of articulation (articulation elements) in the time section.

Then, at following step S4, the data representing respective characteristics of the individual tonal factors thus generated for each of the time sections are stored into a data base, which allows the thus-stored data to be used as template data in subsequent tone synthesis processing as will be more fully described later.

The following paragraphs describe an exemplary manner in which the waveform data of each of the divided time sections are analyzed in terms of the predetermined tonal factors, and FIG. 3 shows examples of the data representing the respective characteristics of the individual tonal factors (template data). In section (e) of FIG. 2 as well, there are shown the various types of tonal factor analyzed from a single smallest articulation unit.

(1) For the waveform (tone color) factor, the original PCM waveform data in the time section (articulation element) in question are extracted just as they are, and then stored in the data base as a waveform template, which will hereinafter be represented by a label "Timbre".

(2) For the amplitude (tone volume) factor, a volume envelope (volume amplitude variation over time) of the original PCM waveform data in the time section (articulation element) in question is extracted to provide amplitude envelope data, and the amplitude envelope data are then stored in the data base as an amplitude template, which will hereinafter be represented by a label "Amp" that is short for the term "amplitude".

(3) For the tone pitch factor, a pitch envelope (tone pitch variation over time) of the original PCM waveform data in the time section (articulation element) in question is extracted to provide pitch envelope data, and the pitch envelope data are then stored in the data base as a pitch template, which will hereinafter be represented by a label "Pitch".

(4) For the time factor, the time length of the original PCM waveform data in the time section (articulation element) in question is used directly. Thus, in such a situation where the time length (taking a variable value) of the original PCM waveform data in the time section (articulation element) in question is represented by a value "1", there is no particular need to measure the time length during creation of the data base. Further, because data on the time factor, namely, time template (TSC template) represents a same value "1" for all the time sections (articulation elements), there is no particular need to store it in the data base. Of course, this arrangement is just exemplary, and a modification is of course possible where the actual time length is measured and stored as time template data in the data base.

As one approach for variably controlling the original time length of waveform data, the assignee of the present application has already proposed a "Time Stretch and Compress" (abbreviated "TSC") control technique that is intended to stretch or compress waveform data in the time axis direction without influencing the pitch of the waveform data, although the proposed TSC control technique has not yet be laid open to the public. The preferred embodiment of the present invention employs such a "Time Stretch and Compress" control technique, and the label "TSC" representing the above-mentioned time factor is an abbreviation of "Time Stretch and Compress". In the tone synthesis processing, the time length of a reproduced waveform signal can be variably controlled by setting the TSC value to an appropriate variable value rather than fixing it at "1". In such a case, the TSC value may be given as a time-varying value (e.g., a time function such as an envelope). Note that this TSC control can be very helpful in, for example, freely and variably controlling the time length of a specific portion of the original waveform for which a special style of rendition, such as a vibrato or slur, was employed.

According to the present embodiment, the above-mentioned operations are executed on a variety of natural acoustic musical instruments in relation to a variety of styles of rendition (i.e., in relation to a variety of musical phrases) so that for each of the natural acoustic musical instruments, templates for a number of articulation elements are created in relation to each of the tonal factors. The thus-created templates are stored in the data base. The above-described sampling and articulation-analyzing operations may be performed on various sounds occurring in the natural world, such as human voices and thunder, as well as tones produced by natural musical acoustic instruments, and a variety of template data, provided as a result of such operations for each of the tonal factors, may be stored in the data base. It should be obvious that the phrase to be performed live for the sampling purpose is not limited to the one made up of a few measures as in the above example and may be a shorter phrase comprising only a single phrasing sub-unit as shown in section (b) of FIG. 2 or may be the whole of a music piece.

Figure 4:
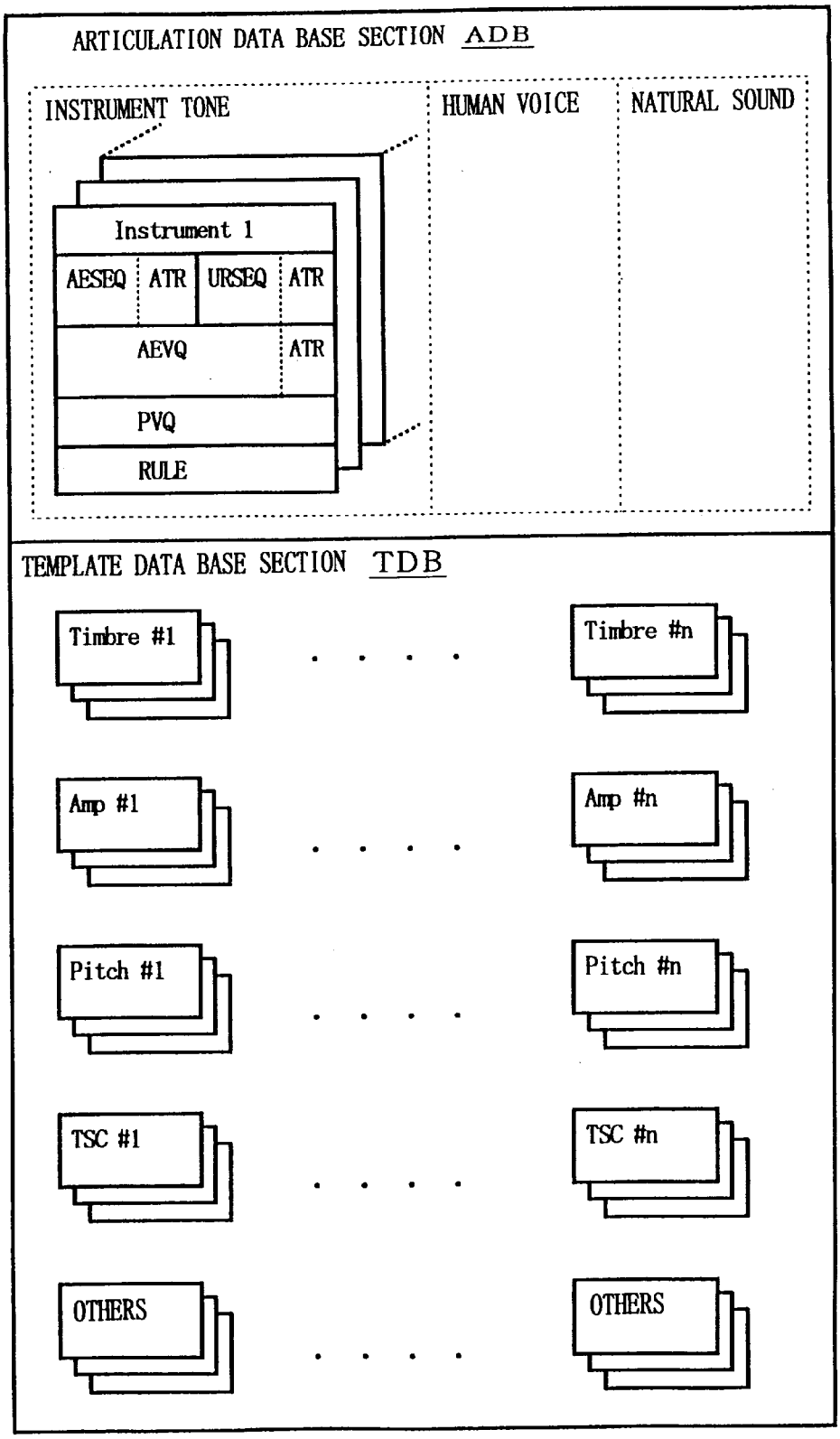
FIG. 4 is a diagram showing an exemplary organization of the data base created by the method in accordance with the present invention.

FIG. 4 shows an exemplary organization of the data base DB, in which it is divided roughly into a template data base section TDB and an articulation data base section ADB. As hardware of the data base DB, a readable/writable storage medium, such as a hard disk device or an optical magnetic disk device (preferably having a large capacity), is employed as well known in the art.

The template data base section TDB is provided for storing a number of template data created in above-mentioned manner. All the template data to be stored in the template data base section TDB do not necessarily have to be based on the sampling and analysis of performed tones or natural sounds as noted above. What is essential here is that these template data are arranged in advance as ready-made data; in this sense, all of these template data may be created as desired artificially through appropriate data editing operations. For example, because the TSC templates relating to the time factor can be created in free variation patterns (envelopes) although they are normally of the value "1" as long as they are based on the sampling of performed tones, a variety of TSC values or envelope waveforms representing time variations of the TSC values may be created as TSC template data to be stored in the data base. Further, the types of the template data to be stored in the template data base section TDB do not necessarily have to be limited to those corresponding to the tonal factors of the original waveform and may include other types of tonal factor to afford enhanced convenience in the subsequent tone synthesis processing. For example, to execute tone color control using a filter during the tone synthesis processing, a number of sets of filter coefficients (including sets of time-varying filter coefficients) may be prepared and stored in the template data base section TDB. It should be obvious that such filter coefficient sets may be prepared either on the basis of analysis of the original waveform or through any other suitable means.

Each of the template data stored in the data base TDB is directly descriptive of the contents of the data as exemplarily shown in FIG. 3. For example, the waveform (Timbre) template represents PCM waveform data themselves. The envelope waveforms, such as an amplitude envelope, pitch envelope and TSC envelope, may be obtained by encoding their respective envelope shapes through the known PCM scheme. However, to compress the data storage format of the template data, in the shape of an envelope waveform, in the template data base section TDB, these template data may be stored as parameter data for achieving broken-line approximation of their respective envelope waveforms—as generally known, each of the parameter data comprises a set of data indicative of inclination rates and target levels, time lengths or the like of the individual broken lines.

The waveform (Timbre) template may also be stored in an appropriately compressed format other than in PCM waveform data. Namely, the waveform (Timbre) template data may either be in a compressed code format other than the PCM format, such as DPCM or ADPCM, or comprise waveform synthesizing parameter data. Because various types of waveform synthesis based on such parameters are known, such as the Fourier synthesis, FM (Frequency Modulation) synthesis, AM (Amplitude Modulation) synthesis or synthesis based on a physical model tone generator, waveform synthesizing parameters for these purposes may be stored in the data base as the waveform (Timbre) template data. In this case, waveform generation processing based on the waveform (Timbre) template data, i.e., waveform synthesizing parameters, is executed by a waveform synthesizing arithmetic operation device, software program, or the like. In such a case, a plurality of sets of waveform synthesizing parameters each for generating a waveform of a desired shape may be prestored in relation to a single articulation element, i.e., time section so that a time-variation of the waveform shape within the single articulation element is achieved by switching, with the passage of time, the parameter set to be used for the waveform synthesis.

Further, even where the waveform (Timbre) template is stored as PCM waveform data and if the conventionally-known looped readout technique can be used properly (e.g., in the case of waveform data of a portion, such as a body portion, having a stable tone color waveform and presenting not-so-great variations over time), there may be stored only part, rather than the whole, of the waveform of the time section in question. Further, if template data for different time sections or articulation elements obtained as a result of the sampling and analysis are identical or similar to each other, then only one, rather than all, of the template data may be stored in the data base TDM so that the only one template data thus stored is shared in the tone synthesis processing; this arrangement can significantly save a limited storage capacity of the data base TDB. In one implementation, the template data base section TDB may include a preset area for storing data created previously by a supplier of the basis data base (e.g., the manufacturer of the electronic musical instrument), and a user area for storing data that can be freely added by the user.

The articulation data base section ADB, to build a performance including one or more articulation, contains articulation-descriptive data (i.e., data describing a substantially continuous performance by a combination of one or more articulation elements and data describing the individual articulation) in association with various cases of performance and styles of rendition.

In FIG. 4, there is shown an example of the articulation data base section for a given instrument tone labelled "Instrument 1". Articulation element sequence AESEQ describes a performance phrase (namely, articulation performance phrase), containing one or more articulation, in the form of sequence data sequentially designating one or more articulation elements. This articulation element sequence corresponds to, for example, a time series of the smallest articulation units, namely, articulation elements obtained as a result of the sampling and analysis as shown in section (d) of FIG. 2. In practice, a number of articulation element sequences AESEQ are stored in the data base so as to cover various possible styles of rendition that may take place in performing the instrument tone. Each of the articulation element sequences AESEQ may comprise one or more of the "phrasing sub-units" (great articulation units AL#1 to AL#4) as shown in section (b) of FIG. 2, or one or more of the "intermediate articulation units AM#1 and AM#2) as shown in section (c) of FIG. 2.

Articulation element vector AEVQ in the articulation data base section ADB contains indices to the tonal-factor-specific factor template data for all the articulation elements stored in the template data base section TDB in relation to the instrument tone (Instrument 1), in the form of vector data designating the individual templates (e.g., in address data for retrieving a desired template from the template data base section TDB). As seen in the examples of sections (d) and (e) of FIG. 2, for example, the articulation element vector AEVQ contains vector data specifically designating four templates Timber, Amp, Pitch and TSC for the individual tonal factors (waveform, amplitude, pitch and time) constituting a partial tone that corresponds to a given articulation element AS#1.

In every articulation element sequence (style of rendition sequence) AESEQ, there are described indices to a plurality of articulation elements in accordance with a predetermined performing order, and a set of the templates constituting a desired one of the articulation elements can be retrieved by reference to the articulation element vector AEVQ.

FIG. 5A is a diagram illustratively showing articulation element sequences AESEQ#1 to AESEQ#7. Specifically, in FIG. 5A, "AESEQ#1"=(ATT-Nor, BOD-Vib-nor, BOD-Vib-dep1, BOD-Vib-dep2, REL-Nor)" indicates that No. 1 articulation element sequence AESEQ#1 is a sequence of five articulation elements: ATT-Nor; BOD-Vib-nor; BOD-Vib-depl; BOD-Vib-dep2; and REL-Nor. The meanings of the index labels of the individual articulation elements are as follows.

The label "ATT-Nor" represents a "normal attack" style of rendition which causes the attack portion to rise in a standard or normal manner.

The label "BOD-Vib-nor" represents a "body normal vibrato" style of rendition which imparts a normal vibrato to the body portion.

The label "BOD-Vib-dep1" represents a "body vibrato depth 1" style of rendition which imparts a vibrato, one level deeper than the normal vibrato, to the body portion.

The label "BOD-Vib-dep2m represents a "body vibrato depth 2" style of rendition which imparts a vibrato, two levels deeper than the normal vibrato, to the body portion.

The label "REL-Nor" represents a "normal release" style of rendition which causes the release portion to fall in a standard or normal manner.

Thus, the No. 1 articulation element sequence AESEQ#1 corresponds to such articulation that the generated tone begins with a normal attack, has its following body portion initially imparted a normal vibrato, next a deeper vibrato and then a still-deeper vibrato and finally ends with a release portion falling in the standard manner.

Similarly, articulation of other articulation element sequences AESEQ#2 to AESEQ#6 may be understood from the labels of their component articulation elements of FIG. 5A. However, to facilitate the understanding, there are given below the meanings of the index labels of some other articulation elements.

The label "BOD-Vib-spd1" represents a "body vibrato speed 1" style of rendition which imparts a vibrato, one level faster than the normal vibrato, to the body portion.

The label "BOD-Vib-spd2" represents a "body vibrato speed 2" style of rendition which imparts a vibrato, two levels faster than the normal vibrato, to the body portion.

The label "BOD-Vib-bri" represents a "body vibrato depth & speed 1" style of rendition which increases the depth and speed of a vibrato, to be imparted to the body portion, by one level than their respective normals.

The label "BOD-Vib-bri" represents a "body vibrato brilliant" style of rendition which imparts a vibrato to the body portion and makes the tone color bright.

The label "BOD-Vib-mld1" represents a "body vibrato mild 1" style of rendition which imparts a vibrato to the body portion and makes the tone color a little mild.

The label "BOD-Cre-nor" represents a "body crescendo" style of rendition which imparts a normal crescendo to the body portion.

The label "BOD-Cre-voll" represents a "body crescendo volume 1" style of rendition which increases the volume of a crescendo, to be imparted to the body portion, by one level.

The label "ATT-Bup-nor" represents an "attack bend-up normal" style of rendition which bends up the pitch of the attack portion at a normal depth and speed.

The label "REL-Bdw-nor" represents a "release bend-down normal" style of rendition which bends down the pitch of the release portion at a normal depth and speed.

Thus, the No. 2 articulation element sequence AESEQ#2 corresponds to such articulation that the generated tone begins with a normal attack, has its following body portion initially imparted a normal vibrato, next a little faster vibrato and then a still-faster vibrato and finally ends with a release portion falling in the standard manner.

The No. 3 articulation element sequence AESEQ#3 corresponds to a type of articulation (style of rendition) for imparting a vibrato that becomes progressively deeper and faster. The No. 4 articulation element sequence AESEQ#4 corresponds to a type of articulation (style of rendition) for varying the tone quality (tone color) of a waveform during a vibrato. The No. 5 articulation element sequence AESEQ#5 corresponds to a type of articulation (style of rendition) for imparting a crescendo. The No. 6 articulation element sequence AESEQ#6 corresponds to a type of articulation (style of rendition) for allowing the pitch of the attack portion to bend up (become gradually higher). The No. 7 articulation element sequence AESEQ#7 corresponds to a type of articulation (style of rendition) for allowing the pitch of the attack portion to bend down (become gradually lower).

Various other articulation element sequences (style-of-rendition sequences) than the above-mentioned are stored in the articulation data base section ADB, although they are not specifically shown in FIG. 5A.

FIG. 5B is a diagram showing exemplary organizations of the articulation element vectors AEVQ relating to some articulation elements. Specifically, in FIG. 5B, vector data in each pair of parentheses designate templates corresponding to the individual tonal factors. In each of the vector data, the leading label represents a specific type of the template; that is, the label "Timb" indicates a waveform (Timbre) template, the label "Amp" an amplitude (Amp) template, the label "Pit" a pitch template, the label "TSC" a time (TSC) template.

For example, the data "ATT-Nor=(Timb-A-nor, Amp-A-nor, Pit-A-nor, TSC-A-nor)" indicates that the articulation element "ATT-Nor" representing a "normal attack" style of rendition is to be subjected to a waveform synthesis using a total of four templates: "Timb-A-no" (waveform template with a normal attack portion); "Amp-A-nor" (amplitude template with a normal attack portion); "Pit-A-nor" (pitch template with a normal attack portion); and "TSC-A-nor" (TSC template with a normal attack portion).

To give another example, the articulation element "BOD-Vib-dep1" representing a "body vibrato depth 1" style of rendition is to be subjected to a waveform synthesis using a total of four templates: "Timb-B-vib" (waveform template for imparting a vibrato to the body portion); "Amp-B-dp3" (amplitude template for imparting a depth 3 vibrato to the body portion); "Pit-B-dp3" (pitch template for imparting a depth 3 vibrato to the body portion); and "TSC-B-vib" (TSC template for imparting a vibrato to the body portion).

To give still another example, the articulation element "REL-Bdw-nor" representing a "release bend-own normal" style of rendition is to be subjected to a waveform synthesis using a total of four templates: "Timb-R-bd" (waveform template for bending down the release portion); "Amp-R-bdw" (amplitude template for bending down the release portion); *Pit-R-bdw" (pitch template for bending down the release portion); and "TSC-R-bdw" (TSC template for bending down the release portion).

To facilitate editing of articulation, it is preferable to prestore attribute information ATR, outlining respective characteristics of the individual articulation element sequences, in association with the articulation element sequences AESEQ. Similarly, it is preferable to prestore attribute information ATR, outlining respective characteristics of the individual articulation element sequences, in association with the articulation element vectors AEVQ.

In short, such attribute information ATR describes the respective characteristics of the individual articulation elements, i.e, smallest articulation units as shown in section (d) of FIG. 2. FIG. 6 shows exemplary characteristics of several attack-portion-related articulation elements; more specifically, there are shown labels or indices of the articulation elements and contents of the attribute information ATR of the articulation elements, as well as vector data designating tonal-factor-specific templates.

According to the illustrated example of FIG. 6, the attribute information ATR is also organized and managed in a hierarchical manner. Namely, common attribute information "attack" is given to all the attack-portion-related articulation elements, and attribute information "normal" is added to each of the articulation elements which is of a normal or standard nature. Further, attribute information "bend-up" is added to each of the articulation elements to which a bend-up style of rendition is applied, while attribute information "bend-down" is added to each of the articulation elements to which a bend-down style of rendition is applied. Moreover, of the articulation elements to which the bend-up style of rendition is applied, attribute information "normal" is added to each having a normal nature, and attribute information "small depth" is added to each having a smaller-than-normal depth, while attribute information "great depth" is added to each having a greater-than-normal depth. Furthermore, of the articulation elements to which the bend-up style of rendition is applied, attribute information "low speed" is added to each having a lower-than-normal speed, while attribute information "high speed" is added to each having a higher-than-normal speed. Although not specifically shown, similar subdivided attribute information is added to the articulation elements to which a bend-down style of rendition is applied.

In FIG. 6, there is also shown that a same template is sometimes shared between different articulation elements. In the illustrated example of FIG. 6, vector data of the four templates noted in the section "index" (in other words, template indices) designate templates for generating a partial tone corresponding to the articulation element. Here, each mark "=" attached to some of the articulation elements having the bend-up attribute indicates that the same template as for the normal style of rendition is to be used in the corresponding style of rendition. For example, the waveform (Timbre) template for the normal bend-up style of rendition (Timb-A-bup) is used as the waveform templates for all of the other bend-up styles of rendition. Similarly, the amplitude (Amp) template for the normal bend-up style of rendition (Amp-A-bup) is used as the amplitude templates for all of the other bend-up styles of rendition. This is because the same waveform or amplitude envelope can be safely used without influencing the tone quality even when there is a subtle variation in the bend-up style of rendition. In contrast, different pitch (templates) must be used depending on different depths in the bend-up style of rendition. For example, for the articulation element ATT-Bup-dp1 having the "small depth" attribute, vector data Pit-A-dp1 is used to designate a pitch envelope template corresponding to a small bend-up characteristic.

Sharing the template data in the above-mentioned manner can effectively save the limited storage capacity of the template data base section TDB. Besides, it can eliminate a need to record a live performance for every possible style of rendition.

From FIG. 6, it may be seen that the speed of the bend-up styles of rendition is adjustable by using a different time (TSC) template. The pitch bend speed corresponds to a time necessary for the pitch to move from a predetermined initial value to a target value, and thus as long as the original waveform data has a predetermined pitch bend characteristic that the pitch bends from a predetermined initial value to a target value within a specific period of time, it can be adjusted by variably controlling the time length of the original waveform data through the TSC control technique. Such variable control of the waveform time length using a time (TSC) template can be suitably used to adjust speeds of various styles of rendition such as a tone rising speed and speeds of a slur and a vibrato. Although a pitch variation in a slur can be provided by a pitch (Pitch) template, it is preferable to execute the TSC control using a time (TSC) template because the TSC control achieves a more natural slur.

It should be obvious that each of the articulation element vectors AEVQ in the articulation data base section ADB is addressable by the attribute information ATR as well as by the articulation element index. Thus, by conducting a search through the articulation data base section ADB using desired attribute information ATR as a keyword, it is possible to find out any articulation element having an attribute corresponding to the keyword, which would significantly facilitate data editing operations by the user. Such attribute information ATR may be attached to the articulation element sequence AESEQ. Thus, by conducting such a search through the articulation data base section ADB using desired attribute information ATR as a keyword, it is possible to find out any articulation element sequence AESEQ containing an articulation element with an attribute corresponding to the keyword.

It should be obvious that the articulation element index for addressing a desired articulation element vector AEVQ in the articulation data base section ADB is given automatically by readout of the articulation element sequence AESEQ; however, an arrangement may be made to enter a desired articulation element index separately, for the purpose of editing or free real-time tone production.

In the articulation data base section ADB, there is also provided a user area for storing articulation element sequences optionally created by the user. Articulation element vector data optionally created by the user may also be stored in the user area.

The articulation data base section ADB also contains partial vectors PVQ as lower-level vector data for the articulation element vectors AEVQ. Where the template data designated by one of the articulation element vectors AEVQ is stored as data for some of, rather than all of, the time sections of the corresponding articulation element, this partial template data is read out repetitively in a looped fashion so as to reproduce the data of the entire time section of the articulation element. The data necessary for such looped readout are stored as the partial vector PVQ. In such a case, data designating one of the partial vectors PVQ is contained, along with the template data, in the articulation element vector AEVQ so that the data of the partial vector PVQ are read out in accordance with the partial vector designating data and their looped readout are controlled by the data of the partial vector PVQ. To this end, each of the partial vectors PVQ contains loop-start and loop-end addresses necessary for controlling the looped readout.

In the articulation data base section ADB, there are also stored rule data RULE descriptive of various rules to be applied, during the tone synthesis processing, to connect together waveform data of articulation elements adjoining each other in time. For example, various rules, for example, as to how waveform cross-fade interpolation is to be carried out for a smooth waveform connection between the adjoining articulation elements, as to whether such a waveform connection is to be made directly without the cross-fade interpolation and as to what sort of cross-fade scheme is to be used for the waveform cross-fade interpolation, are stored in association with the individual sequences or individual articulation elements within the sequences. These connecting rules can also be a subject of the data editing by the user.

As a matter of fact, the articulation data base section ADB includes various articulation data base areas, having an organization as illustratively described above, for each of various musical instruments (i.e., tone colors of natural acoustic musical instruments), for each of various human voices (voices of young female and male, bariton, soprano, etc.), for each of various natural sounds (thunder, sound of the waves, etc.).

Outline of Tone Synthesis

Figure 7:
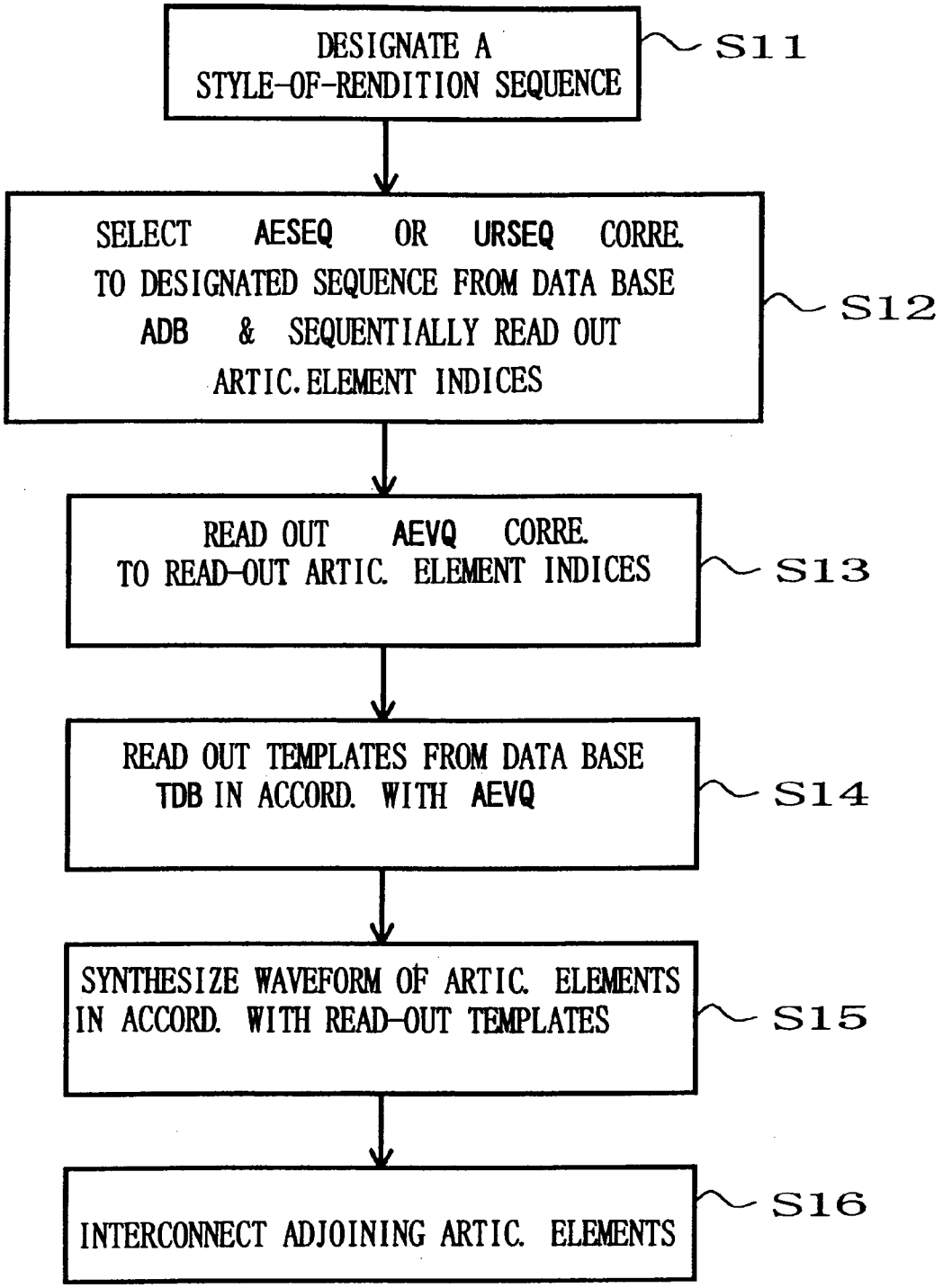
FIG. 7 is a flow chart outlining an exemplary operational sequence for synthesizing a tone by the tone data making method in accordance with the present invention.

FIG. 7 is a flow chart outlining a sequence of operations for synthesizing a tone by use of the data base DB organized in the above-described manner.

First, at step S11, a desired style of rendition sequence is designated which corresponds to a tone performance which may be a performance phrase made up of a plurality of tones or a single tone. The style of rendition sequence designation may be implemented by selectively specifying an articulation element sequence AESEQ or URSEQ of a desired instrument tone (or human voice or natural sound) from among those stored in the articulation data base section ADB.

Figure 8A:
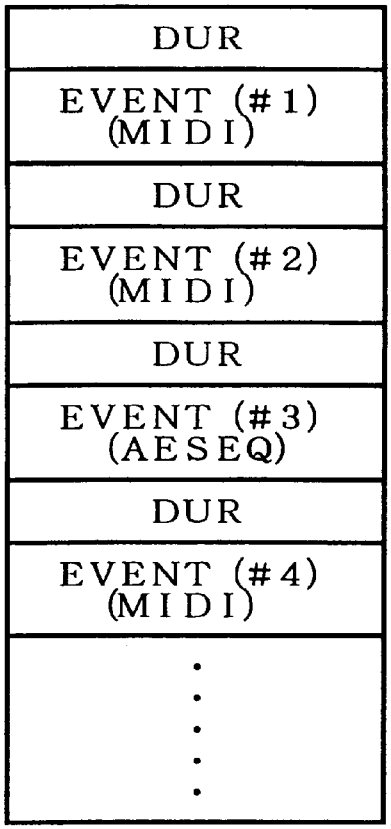
FIGS. 8A and 8B are diagrams showing exemplary organizations of automatic performance sequence data employing a tone synthesis scheme based on the tone data making method in accordance with the present invention.
Figure 8B:
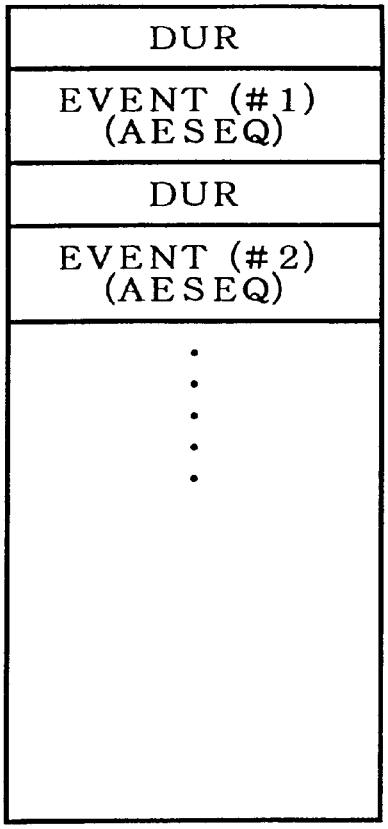

In some implementation, style-of-rendition-sequence designating data may be given on the basis of a real-time performance operation by the user or player, or on the basis of automatic performance data. In the former case, for example, different style of rendition sequences may be allocated to keyboard keys or other performance operators so that player's activation of any one of the operators can generate the style-of-rendition-sequence designating data allocated to the operator. In the latter case, one possible approach may be that the individual style-of-rendition-sequence designating data are incorporated, as event data, in MIDI-format automatic performance sequence data corresponding to a desired music piece so that they can be read out at respective event reproducing points during reproduction of the automatic performance, as illustratively shown in FIG. 8A. In FIGS. 8A and 8B, "DUR" represents duration data indicative of a time interval up to a next event, "EVENT" represents event data, "MIDI" indicates that the performance data associated with the corresponding event data is in the MIDI format, and "AESEQ" indicates that the performance data associated with the corresponding event data is the style-of-rendition-sequence designating data. In this case, it is possible to execute an ensemble performance of an automatic performance based on the MIDI-format automatic performance data and an automatic performance based on the style of rendition sequence according to the principle of the present invention; then, the main solo or melody instrument part may be performed by the style of rendition sequence, i.e., articulation element synthesis, according to the present invention, while the other instrument part may be performed by the MIDI-data-based automatic performance.

As another approach in the latter case, only a plurality of style-of-rendition-sequence designating data AESEQ may be stored in association with a desired music piece so that they can be read out at respective event reproducing points during reproduction of the music piece. This arrangement can automatically perform the articulation sequence of the music piece which has been never been realized or proposed in the past.

As still another approach in the latter case, only automatic performance sequence data, e.g., in the MIDI-format, corresponding to a desired music piece may be stored so that style-of-rendition-sequence designating data can be generated as a result of analyzing the stored automatic performance sequence data and thereby automatically determining a style of rendition.

Further, as another way of designating a style of rendition, the user or player may enter one or more desired pieces of attribute information to execute a search through the articulation data base section ADB using the entered attribute information as a keyword so that one or more articulation element sequences AESEQ can be automatically listed up to allow selective designation of a desired one of the listed-up sequences.

Referring back to FIG. 7, articulation element (AE) indices are read out sequentially at step S12 in accordance with a predetermined performance order from among the selected articulation element sequence AESEQ or URSEQ. Then, at step S13, an articulation element vector (AEVQ) is read out which corresponds to the read-out articulation element (AE) indices. At next step S14, individual template data designated by the read-out articulation element vector are read out from the template data base section TDB.

Subsequently, at step S15, waveform data (partial tone) of a single articulation element (AE) is synthetically generated in accordance with the read-out individual template data. Basically, this waveform synthesis is implemented by reading out PCM waveform data, corresponding to the waveform (Timbre) template data, for a time length as dictated by the time (TSC) template and then controlling the amplitude envelope of the read-out PCM waveform data in accordance with the amplitude (Amp) template. In this embodiment, each waveform (Timbre) template stored in the template data base section TDB is assumed to retain the pitch, amplitude envelope and time length of the sampled original waveform, and thus in a situation where the pitch (Pitch) template, amplitude (Amp) template and time (TSC) template have not been modified from those of the sampled original waveform, the PCM waveform data, corresponding to the waveform (Timbre) template data, read out from the template data base section TDB would be directly used as the waveform data for the articulation element in question. In the event that any of the pitch (Pitch) template, amplitude (Amp) template and time (TSC) template has been modified from that of the sampled original waveform via the later-described data editing or the like, the rate to read out the waveform (Timbre) template data from the template data base section TDB is variably controlled (if the pitch template has been modified), or the time length of the data readout is variably controlled (if the time template has been modified), or the amplitude envelope of the read-out waveform is variably controlled (if the amplitude template has been modified).

It will be appreciated that where the above-mentioned partial vector PVQ is applied to the articulation element (AE) in question, control is also performed on the necessary looped readout.

Then, at step S16 of FIG. 7, an operation is executed for sequentially connecting together the synthetically generated waveform data of the individual articulation elements, so as to generate a succession of performance tones comprising a time-serial combination of a plurality of the articulation elements. This waveform data connecting operation is controlled in accordance with the rule data RULE stored in the articulation data base section ADB. In a situation where the rule data RULE instructs a direct connection, then it is only necessary to sound the waveform data of the individual articulation elements, synthetically generated at step S15, sequentially just in the order of their generation. In another situation where the rule data RULE instructs predetermined cross-fade interpolation, the waveform data at the ending portion of a preceding one of two adjoining articulation elements (hereinafter called a preceding articulation element) is connected with the waveform data at the starting portion of a succeeding articulation element via a cross-fade interpolation synthesis in accordance with a designated interpolation scheme, to thereby provide a smooth connection between the adjoining elements. For example, if the waveform data of the adjoining articulation elements are to be interconnected just as in the sampled original waveform, then the rule data RULE may instruct a direct connection, because a smooth connection between the elements is guaranteed from the beginning in this case. In other cases, it is preferable to carry out some sort of interpolation synthesis, because a smooth connection between the adjoining elements is not guaranteed otherwise. As will be later described, this embodiment is arranged to permit a selection of any desired one of a plurality of cross-fade interpolation schemes by the rule data RULE.

A succession of the performance tone synthesizing operations at steps S11 to S16 is carried out in a single tone synthesizing channel per instrument tone (human voice or natural sound). Where the performance tone synthesizing operations are to be executed for a plurality of instrument tones (human voices or natural sounds) simultaneously in a parallel manner, it is only necessary that the succession of the operations at steps S11 to S16 be carried out in a plurality of channels on a time-divisional basis. As will be later described, where a tone waveform is to be generated using the cross-fade synthesis scheme, two waveform generating channels, i.e., one channel for generating a fading-out waveform and one channel for generating a fading-in waveform, are used per tone synthesizing channel.

Figure 9A:
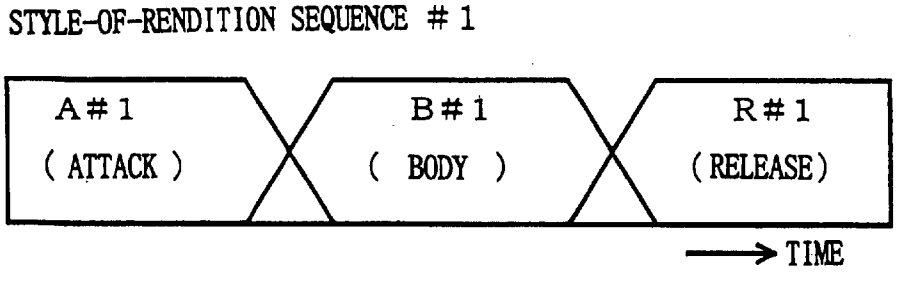
FIG. 9 is a diagram showing exemplary details of some style-of-rendition sequences according to the present invention.
Figure 9B:
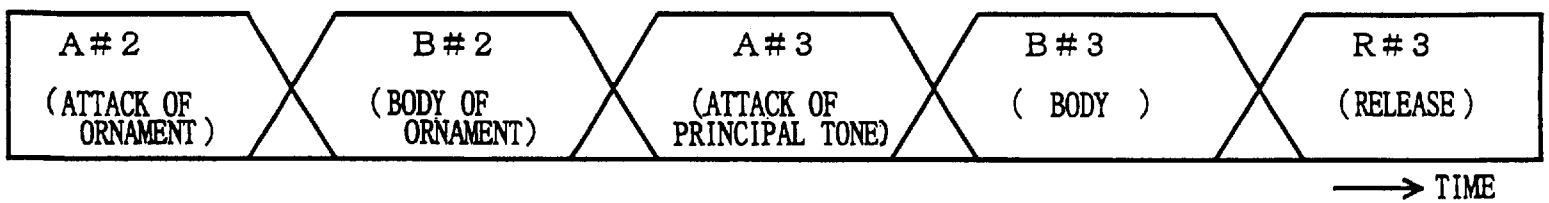
Figure 9C:
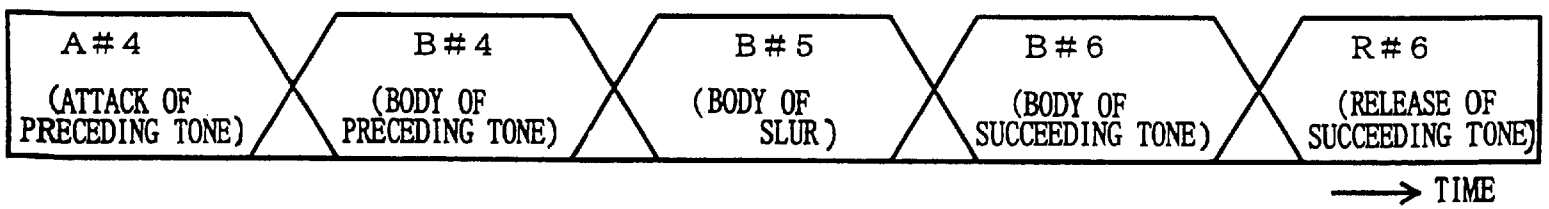

FIGS. 9A to 9C are diagrams showing exemplary combinations of articulation elements in some of the style-of-rendition sequences. The style-of-rendition sequence #1 shown in FIG. 9A represents a simplest example of the combination, where articulation elements A#1, B#1 and R#1 of the attack, body and release portions, respectively, are sequentially connected together with each connection being made by cross fade interpolation. The style-of-rendition sequence #2 shown in FIG. 9B represents a more complex example of the combination, where an ornamental tone is added before a principal tone; more specifically, articulation elements A#2 and B#2 of attack and body portions of the ornamental tone and articulation elements A#3, B#3 and R#3 of attack, body and release portions of the principal tone are sequentially connected together with each connection being made by cross fade interpolation. Further, the style-of-rendition sequence #3 shown in FIG. 9C represents another example of the combination, where an adjoining pair of articulation elements are connected by a slur; more specifically, articulation elements A#4 and B#4 of attack and body portions of the preceding tone, articulation element A#5 of the slur body portion and articulation elements B#5 and R#6 of body and release portions of the succeeding tone are sequentially connected together with each connection being made by cross-fade interpolation. Whereas partial tone waveforms corresponding to the articulation elements are each schematically shown in an envelope shape alone in these figures, each of the partial tone waveforms, in fact, comprises waveform data synthetically generated on the basis of the waveform (Timbre), amplitude (Amp), pitch (Pitch) and time (TSC) templates as described above.

Figure 10:
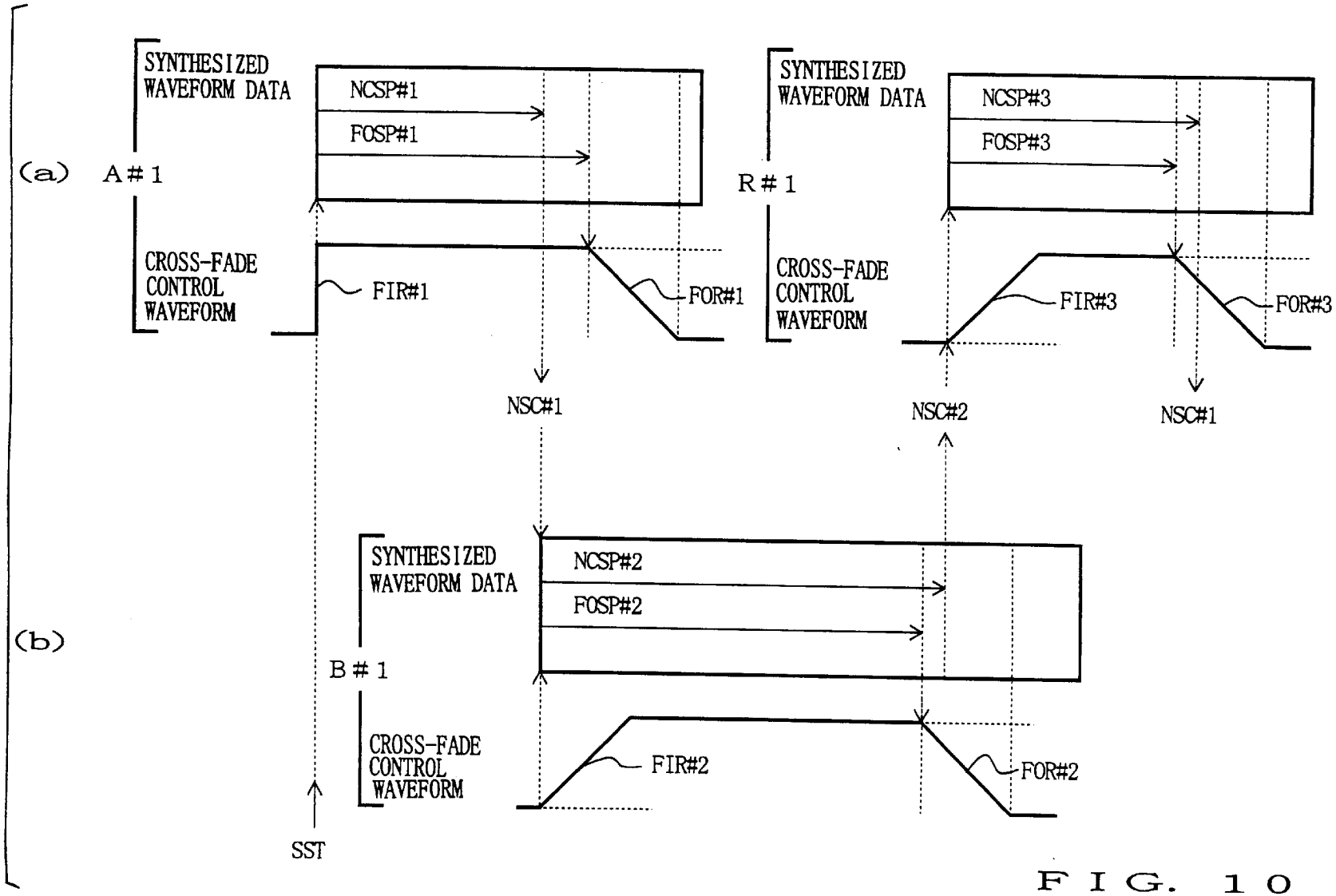
FIG. 10 is a time chart showing an example of a process for connecting, by cross-fade synthesis, adjoining articulation elements in a single style-of-rendition sequence.

FIG. 10 is a time chart showing a detailed example of the above-described process for sequentially generating partial tone waveforms corresponding to a plurality of articulation elements and connecting these partial tone waveforms by cross-fade interpolation in a single tone synthesizing channel. Specifically, for cross-fade synthesis between two element waveforms, two waveform generating channels are used in relation to the single tone synthesizing channel. Section (a) of FIG. 10 is explanatory of an exemplary manner in which a waveform is generated in the first waveform generating channel, while section (b) of FIG. 10 is explanatory of an exemplary manner in which a waveform is generated in the second waveform generating channel. The legend "synthesized waveform data" appearing at the top of each of sections (A) and (B) represents waveform data synthetically generated, as a partial tone waveform, on the basis of the templates of waveform (Timbre), amplitude (Amp), pitch (Pitch) and the like (e.g., the waveform data synthetically generated at step S15 of FIG. 7), and the legend "cross-fade control waveform" appearing at the bottom of each of sections (A) and (B) represents a control waveform which is used to cross-fade-connect partial tone waveforms corresponding to the articulation elements and which is generated, for example, during the operation of step S16 in the flow chart of FIG. 7. The amplitude of the element waveform data shown at the top is controlled by the cross-fade control waveform shown at the bottom in each of the first and second waveform generating channels, and the respective waveform data, with their amplitude controlled by the cross-fade scheme, output from the two waveform generating channels are then added together to thereby complete the cross-fade synthesis.

To initiate a particular style-of-rendition sequence, a sequence start trigger signal SST is given, in response to which is started generation of a partial tone waveform corresponding to the first articulation element (e.g., articulation element A#1) of the sequence. Specifically, waveform data are synthesized on the basis of various template data, such as those of the waveform (Timbre), amplitude (Amp), pitch (Pitch) and time (TSC) templates, for the articulation element. Whereas the "synthesized waveform data" is merely shown as a rectangular block in the figure, it, in fact, includes a waveform corresponding to the waveform (Timbre) template data, an amplitude envelope corresponding to the amplitude (Amp) template data, pitch and pitch variation corresponding to the pitch (Pitch) template data, and a time length corresponding to the time (TSC) template.

The cross-fade control waveform for the first articulation element in the sequence may be caused to rise immediately to a full level as shown. If the waveform of the first articulation element in the sequence is to be combined with an ending-portion of a performance tone in a preceding sequence by cross-fade synthesis, then it is only necessary to impart a fade-in characteristic of an appropriate inclination to the rising portion of the first cross-fade control waveform.

In association with the first articulation element in the sequence, a fade-in rate FIR#1, next channel start point information NCSP#1, fade-out start point information FOSP#1 and fade-out rate FOR#1 are prestored as connection control information. The next channel start point information NCSP#1 designates a specific point at which to initiate waveform generation of the next articulation element (e.g., B#1). The fade-out start point information FOSP#1 designates a specific point at which to initiate a fade-out of the associated waveform. As shown, the cross-fade control waveform is maintained flat at the full level up to the fade-out start point, after which, however, it's level gradually falls at an inclination according to the preset fade-out rate FOR#1. In the event the rule data RULE corresponding to the articulation element A#1 instructs a direct waveform connection involving no cross-fade synthesis, the next channel start point information NCSP#1 and fade-out start point information FOSP#1 may be set to designate an end point of the synthetically generated articulation element waveform associated therewith. If, however, the corresponding rule data RULE instructs a direct waveform connection involving cross-fade synthesis, these information NCSP#1 and FOSP#1 designate respective points that are appropriately set before the end point of the synthetically generated articulation element waveform associated therewith. Therefore, it may be safely deemed that these fade-in rate FIR#1, next channel start point information NCSP#1, fade-out start point information FOSP#1 and fade-out rate FOR#1 is contained in the rule data RULE corresponding to the articulation element A#1 in question. Note that these waveform-connection control information is provided for each of the articulation elements.

Once the process for generating the articulation element waveform A#1 in the first waveform generating channel shown in section (a) of FIG. 10 arrives at the point designated by the next channel start point information NCSP#1, a next channel start trigger signal NCS#1 is given to the second waveform generating channel shown in section (b) of FIG. 10, in response to which generation of a partial tone waveform corresponding to the second articulation element (e.g., articulation element B#1) of the sequence is initiated in the second waveform generating channel. The cross-fade control waveform for the articulation element B#1 fades in (i.e., gradually rises) at an inclination specified by the corresponding fade-in rate FIR#2. In this way, the fade-out period of the preceding articulation element waveform A#1 and the fade-in period of the succeeding articulation element waveform B#1 overlap each other, and adding the two overlapping articulation elements will complete a desired cross-fade synthesis therebetween.

After the waveform data of the preceding articulation element waveform A#1 completely fades out, there is only left the succeeding articulation element waveform B#1. Such cross-fade synthesis achieves a smooth waveform connection from the preceding articulation element waveform A#1 to the succeeding articulation element waveform B#1.

Further, once the process for generating the articulation element waveform B#1 in the second waveform generating channel shown in section (b) of FIG. 10 arrives at the point designated by the fade-out start point information FOSP#2, the cross-fade control waveform for the articulation element B#1 gradually falls at an inclination according to the corresponding fade-out rate FOR#2. Then, once the process for generating the articulation element waveform B#1 arrives at the point designated by the next channel start trigger signal NCS#2, a next channel start trigger signal NCS#2 is given to the first waveform generating channel shown in section (a) of FIG. 10, in response to which generation of a partial tone waveform corresponding to the third articulation element (e.g., articulation element R#1) of the sequence is initiated in the first waveform generating channel. The cross-fade control waveform for the articulation element R#1 fades in (i.e., gradually rises) at an inclination specified by the corresponding fade-in rate FIR#3. In this way, the fade-out period of the preceding articulation element waveform B#1 and the fade-in period of the succeeding articulation element waveform R#1 overlap each other, and adding the two overlapping elements will complete a desired cross-fade synthesis therebetween.

In the above-described manner, the individual articulation elements will be connected together, by sequential cross-fade synthesis, in the time-serial order of the sequence.

The above-described example is arranged to execute the cross-fade synthesis on each of the element waveforms synthetically generated on the basis of the individual templates, but the present invention is not so limited; for example, the cross-fade synthesis operation may be executed on each of the template data so that the individual articulation element waveforms are synthetically generated on the basis of the template data having been subjected to the cross-fade synthesis. In such an alternative, a different connecting rule may be applied to each of the templates. Namely, the above-mentioned connection control information (the fade-in rate FIR, next channel start point NCSP, fade-out start point FOSP and fade-out rate FOR) is provided for each of the templates corresponding to the tonal factors, such as the waveform (Timbre), amplitude (Amp), pitch (Pitch) and time (TSC), of the element's waveform. This alternative arrangement permits cross-fade connection in accordance with optimum connecting rules corresponding to the individual templates, which will achieve enhanced efficiency.

Editing

Figure 11:
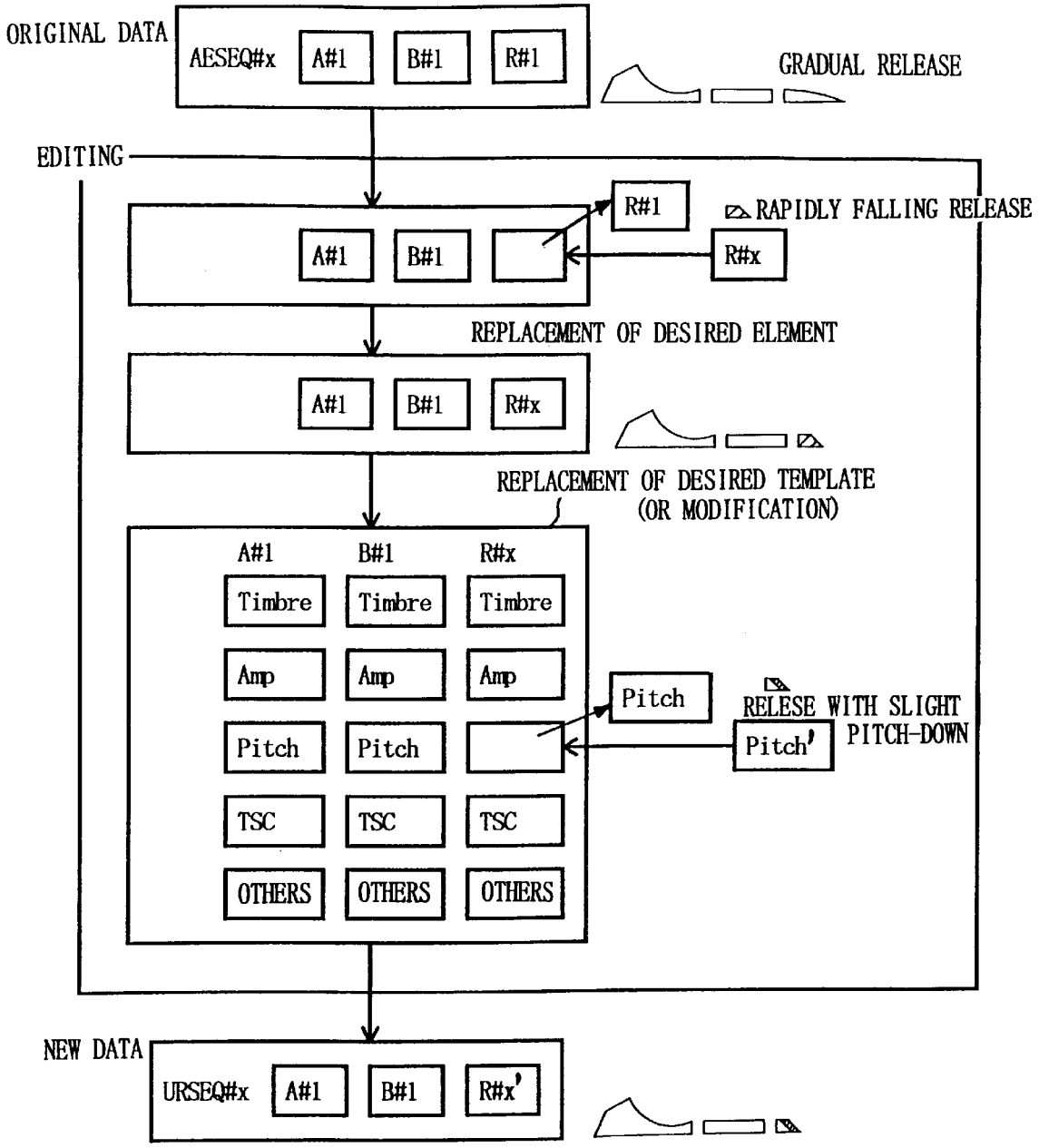
FIG. 11 is a block diagram outlining an exemplary manner of editing a style-of-rendition sequence (articulation element sequence)

FIG. 11 is a block diagram showing an example of the data editing process; more particularly, this example editing process is carried out on the basis of data of an articulation element sequence AESEQ#x which comprises an articulation element A#1 having an attribute of an attack portion, an articulation element B#1 having an attribute of a body portion and an articulation element R#1 having an attribute of a release portion. Of course, this editing process is executed by a computer running a given editing program and the user effecting necessary operations on a keyboard or mouse while viewing various data visually shown on a display.

The articulation element sequence AESEQ#x, forming the basis of the editing process, can be selected from among a multiplicity of the articulation element sequences AESEQ stored in the articulation data base section ADB (see, for example, FIG. 5A). Roughly speaking, the articulation data editing comprises replacement, addition or deletion of an articulation element within a particular sequence, and creation of a new template by replacement of a template or data value modification of an existing template within a particular articulation element.

In a section of FIG. 11 labelled "Editing", there is shown an example where the articulation element R#1 with the release portion attribute having an amplitude envelope characteristic falling relatively gradually is replaced with another articulation element (replacing articulation element) R#x having an amplitude envelope characteristic falling relatively rapidly. Instead of such replacement, a desired articulation element may be added (e.g., addition of a body portion articulation element or an articulation element for an ornamental tone) or may be deleted (e.g., where a plurality of body portions are present, any one of the body portions may be deleted). The replacing articulation element R#x can be selected from among a multiplicity of the articulation element vectors AEVQ stored in the articulation data base section ADB (see, for example, FIG. 5B); in this case, a desired replacing articulation element R#x may be selected from among a group of the articulation elements of a same attribute with reference to the attribute information ART.

After that, template data corresponding to desired tonal factors in a desired articulation element (e.g., the replacing articulation element R#x) are replaced with other template data corresponding to the same tonal factors. The example of FIG. 11 is shown as replacing the pitch (Pitch) template of the replacing articulation element R#x with another pitch template Pitch' that, for example, has a pitch-bend characteristic. A new release-portion articulation element R#x' thus made will have an amplitude envelope characteristic rising relatively rapidly, as well as a pitch-bend-down characteristic. In this case, a desired replacing template (vector data) may be selected, with reference to the attribute information ART, from among various templates (vector data) of a group of the articulation elements of a same attribute in the multiplicity of the articulation element vectors AEVQ (see, for example, FIG. 5B).

The new articulation element R#x' thus made by the partial template replacement may be additionally registered, along with an index and attribute information newly imparted thereto, in the registration area of the articulation data base section ADB for the articulation element vectors AEVQ (see FIG. 4).

According to the preferred embodiment, it is also possible to modify a specific content of a desired template. In this case, a specific data content of a desired template for an articulation element being edited are read out from the template data base section TDB and visually shown on a display or otherwise to allow the user to modify the data content by manipulating the keyboard or mouse. Upon completion of the desired data modification, the modified template data may be additionally registered in the template data base section TDB along with an index newly imparted thereto. Also, new vector data may be allocated to the modified template data, and the new articulation element (e.g., R#x') may be additionally registered, along with an index and attribute information newly imparted thereto, in the registration area of the articulation data base section ADB for the articulation element vectors AEVQ (see FIG. 4).

As noted above, the data editing process can be executed which creates new sequence data by modifying the content of the basic articulation element sequence AESEQ#x. The new sequence data resulting from the data editing process are registered in the articulation data base section ADB, as a user articulation element sequence URSEQ with a new sequence number (e.g., URSEQ#x) and attributed information imparted thereto. In the subsequent tone synthesis processing, the data of the user articulation element sequence URSEQ can be read out from the articulation data base section ADB by use of the sequence number URSEQ#x.

The data editing may be carried out in any of a variety of ways other than that exemplarily described above in relation to FIG. 11. For example, it is possible to sequentially select desired articulation elements from the element vector AEVQ to thereby make a user articulation element sequence URSEQ without reading out the basic arithmetic element sequence AESEQ.

Figure 12:
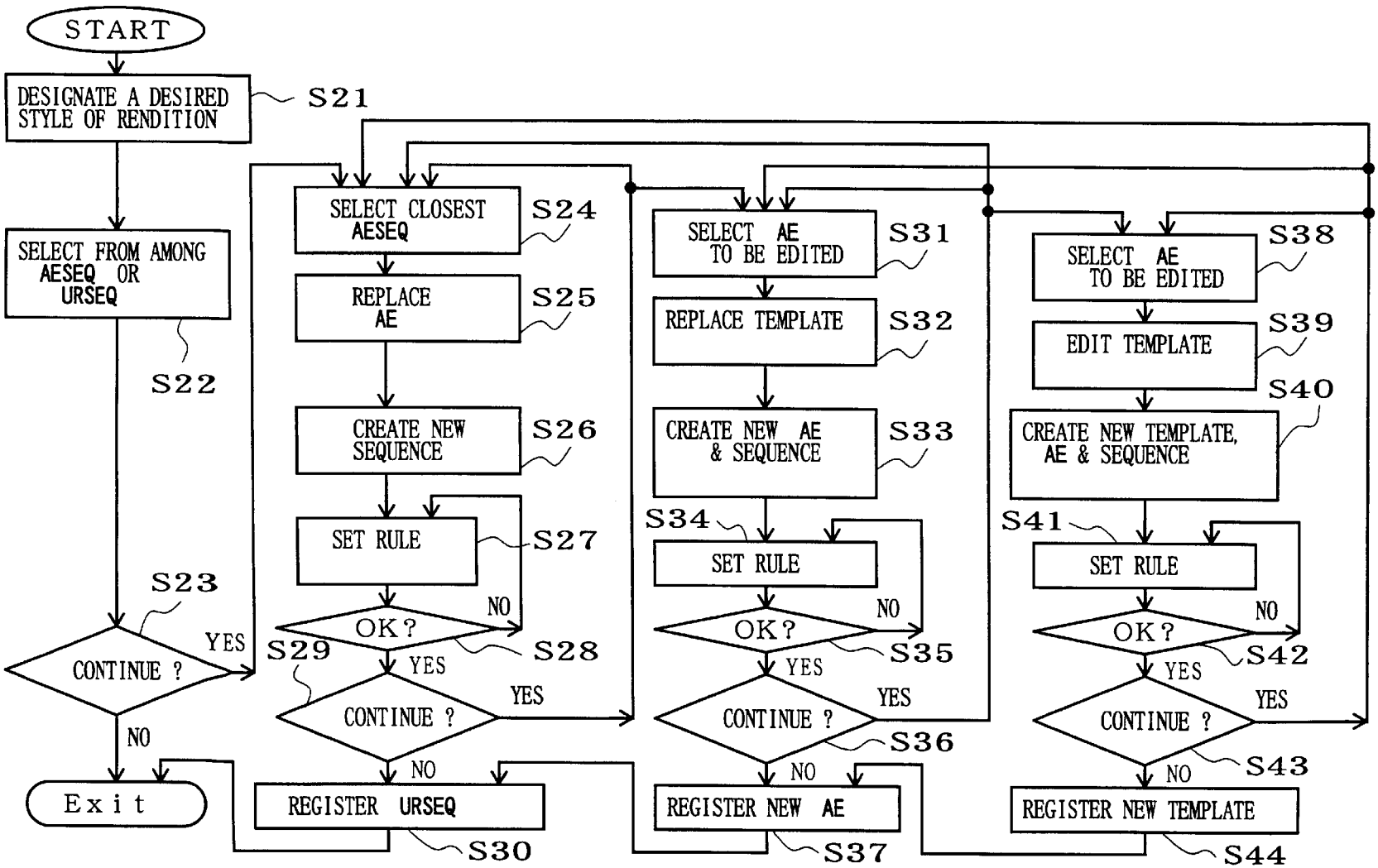
FIG. 12 is a flow chart outlining operations for editing a style-of-rendition sequence (articulation element sequence)

FIG. 12 is a flow chart outlining a computer program capable of executing the above-described data editing process.

At first step S21, a desired style-of-rendition is designated by, for example, using the computer keyboard or mouse to directly enter a unique number of an articulation element sequence AESEQ or URSEQ or enter a desired instrument tone color and attribute information.

At next step S22, it is ascertained whether or not an articulation element sequence matching the designated style-of-rendition is among the various articulation element sequences AESEQ or URSEQ in the articulation data base section ADB, to select such a matching articulation element sequence AESEQ or URSEQ. In this case, if the number of the articulation element sequence AESEQ or URSEQ has been directly entered at preceding step S21, the corresponding sequence AESEQ or URSEQ is read out directly. If the attribute information has been entered at step S21, a search is made through the data base ADB for an articulation element sequence AESEQ or URSEQ corresponding to the entered attribute information. A plurality of pieces of the attribute information may be entered, in which case the search may be made using the AND logic. Alternatively, the OR logic may be used for the search purpose. The search result is visually shown on the computer's display so that, when two or more articulation element sequences have been search out, the user can select a desired one of the search-out sequences.

Following step S22, an inquiry is made at step S23 to the user as to whether or not to continue the editing process. With a negative (NO) answer, the process exits from the editing process. If the content of the selected or searched-out articulation element sequence is as desired by the user and thus there is no need to edit it, the editing process is terminated. If, on the other hand, the user wants to continue the editing process, then an affirmative (YES) determination is made at step S23 and the process goes to step S24. Similarly, in case no articulation element sequence corresponding to the entered attribute information has been successfully found, an affirmative (YES) determination is made at step S23 and the process goes to step S24.

The following paragraphs describe an example of the search based on the attribute information, in relation to a case where the data as shown in FIGS. 5 and 6 are stored in the articulation data base section ADB. Let's assume here that "attack bend-up normal", "body normal" and "release normal" have been entered at step S21 as attribute-based search conditions to search for an articulation sequence. Because in this case the sixth sequence AESEQ#6 shown in FIG. 5A satisfies the search conditions, the sequence AESEQ#6 is selected at step S22. If the selected sequence AESEQ#6 is satisfactory, a negative determination is made at step S23, so that the editing process is terminated. If the editing process is to be continued, an affirmative determination is made at step S23, so that the process goes to step S24.

If the sequence corresponding exactly to the style-of-rendition designated at step S21 has not yet been selected at step S24, the process selects one of the stored sequences which corresponds most closely to the designated style-of-rendition. Let's assume here that "attack bend-up normal", "vibrato normal" and "release normal" have been entered at step S21 as attribute-based search conditions to search for an articulation sequence. Assuming that there are only seven different types of sequence AESEQ as illustrated in FIG. 5A, it is not possible to find, from among them, a sequence satisfying the search conditions, so that a selection is made, at step S24, of the articulation element sequence AESEQ#6 corresponding most closely to the search conditions.

At step S25 following step S24, an operation is executed for replacing vector data (index), designating a desired articulation element (AE) in the selected sequence, with other vector data (index) designating another articulation element. For example, in the case of the sequence AESEQ#6 selected at step S24 as closest to the search conditions and comprising three elements "ATT-Nor", "BOD-Nor" and "REL-Nor" (see FIG. 5A), the body-portion element BOD-Nor (normal body) may be replaced with a body portion element for vibrato. To this end, element vector data (index) for "body normal vibrato" (BOD-Vib-nor) is extracted to replace the "BOD-nor" element.

When necessary, addition or deletion of an articulation element is also carried out at step S25. By the replacement, addition and/or deletion of the desired element vector data, preparation of the new articulation element sequence is completed at step S26.

Now that guarantee of a smooth waveform connection between the elements in the created articulation element sequence has been lost due to the replacement, addition and/or deletion, a connecting rule data RULE is set at next step S27. Then, at step S28, it is ascertained whether or not the newly-se t connecting rule data RULE is acceptable. If not acceptable, the process reverts to step S27 to reset the corresponding connecting rule data RULE; otherwise, the process moves on to step S29.

At step S29, an inquiry is made to the user as to whether or not to continue the editing process. With a negative (NO) answer, the process proceeds to step S30, where the created articulation element sequence is registered in the articulation data base section ADB as a user sequence URSEQ. If, on the other hand, the user still wants to continue the editing process, then an affirmative (YES) determination is made at step S29 and the process goes to step S24 or S31. Namely, if the user wants to go back to the operation for the replacement, addition and/or deletion, the process reverts to step S24, while if the user wants to proceed to template data editing, the process goes to step S31.

At step S31, a selection is made of a particular articulation element (AE) for which template data is to be edited. At following step S32, the template data corresponding to a desired tonal factor in the selected articulation element (AE) is replaced with another template data.

Assume here that "attack bend-up normal", "slightly slow vibrato" and "release normal" have been entered at step S21 as attribute-based search conditions to search for an articulation sequence and that the sequence AESEQ#6 has been selected at step S24, from among the sequences of FIG. 5A, as closest to the search conditions. Because the body-portion element in the selected sequence AESEQ#6 is "normal body" (BOD-Nor) as noted above, this element is replaced with a body portion element for a vibrato such as "body normal vibrato" (BOD-Vib-nor). Then, at this step S31, the body normal vibrato (BOD-Vib-nor) element is selected as a subject of editing. To achieve the "slightly slow vibrato", a time template vector TSC-B-vib from among various template vectors of the "body normal vibrato" (BOD-Vib-nor) is replaced with another time template vector (e.g., TSC-B-sp2) to make the vibrato speed somewhat slower.

In this way, preparation of the new articulation element is completed at step S33 where the time template vector TSC-B-vib from among the various template vectors of the "body normal vibrato" (BOD-Vib-nor) has been replaced with the TSC-B-sp2 time template vector. At the same time, a new articulation element sequence is created where the body-portion element in the sequence AESEQ#6 has been replaced with the new created articulation element.

Following steps S34, S35 and S36 are similar to steps S27, S28 and S29 discussed above. Namely, now that guarantee of a smooth waveform connection between the elements in the new created articulation element sequence has been lost due to the template data replacement, the corresponding connecting rule data RULE is reset as mentioned above.

At step S36, an inquiry is made to the user as to whether or not to continue the editing process. With a negative (NO) answer, the process proceeds to step S37, where the created articulation element element (AE) is registered in the articulation data base section ADB as a user articulation element vector AEVQ. If, on the other hand, the user still wants to continue the editing process, then an affirmative (YES) determination is made at step S36 and the process goes to step S31 or S38. Namely, if the user wants to go back to the operation for the template vector, the process reverts to step S31, while if the user proceeds to editing of a specific content of the template data, the process goes to step S38.

At step S38, a selection is made of a template in a particular articulation element (AE) for which data content is to be edited. At following step S39, specific data contents of the selected template are modified as necessary read out from the template data base section TDB.

Assume here that "attack bend-up normal", "considerably slow vibrato" and "release normal" have been entered at step S21 as attribute-based search conditions to search for an articulation sequence and that the sequence AESEQ#6 has been selected at step S24, from among the sequences of FIG. 5A, as closest to the search conditions. Because the body-portion element in the sequence AESEQ#6 is "normal body" (BOD-Nor), this element is replaced with a body portion element for vibrato such as "body normal vibrato" (BOD-Vib-nor), as noted above. Then, at step S31, the body normal vibrato (BOD-Vib-nor) element is selected as a subject of editing. To achieve the "considerably slow vibrato", a time template vector TSC-B-vib from among various template vectors of the "body normal vibrato" (BOD-Vib-nor) is replaced with another time template vector (e.g., TSC-B-spl) to make the vibrato speed slower than any of the other time template vectors.

However, in case the desired "considerably slow vibrato" still can not be achieved via the time template designated by the time template vector TSC-B-sp1, this template vector TSC-B-sp1 is selected at step S38 so that the specific data content of the template vector TSC-B-sp1 is modified to provide an even slower vibrato. In addition, new vector data (e.g., TSC-B-sp0) is allocated to the new time template made by the data content modification.

In this way, preparation of the new time template data and its vector data e.g., TSC-B-sp0 are completed at step S40. At the same time, a new articulation element (AE) is created where the time template vector has been modified into a new vector and a new articulation element sequence is created where the body-portion element in the sequence AESEQ#6 has been replaced with the new created articulation element (AE).

Following steps S41, S42 and S43 are also similar to steps S27, S28 and S29 above. Namely, now that guarantee of a smooth waveform connection between the elements in the new created articulation element sequence has been lost due to the template data modification, the corresponding connecting rule data RULE is reset as mentioned above.

At step S43, an inquiry is made to the user as to whether or not to continue the editing process. With a negative (NO) answer, the process proceeds to step S44, where the created template data is registered in the template data base section TDB. If, on the other hand, the user still wants to continue the editing process, then an affirmative (YES) determination is made at step S43 and the process goes back to step S38. After step S44, the process goes to step S37, where the created articulation element element (AE) is registered in the articulation data base section ADB as a user articulation element vector AEVQ. After step S37, the process goes to step S30, where the created articulation element sequence is registered in the articulation data base section ADB as a user sequence URSEQ.

The editing process may be carried out in any other operational sequence than that shown in FIG. 12. As previously stated, it is possible to sequentially select a desired articulation element from the element vector AEVQ to thereby make a user articulation element sequence URSEQ without reading out the basic arithmetic element sequence AESEQ. Further, although not specifically shown, a tone corresponding to a waveform of an articulation element under editing may be audibly generated to allow the user to check the tone by ears.

Partial Vector

Figure 13:
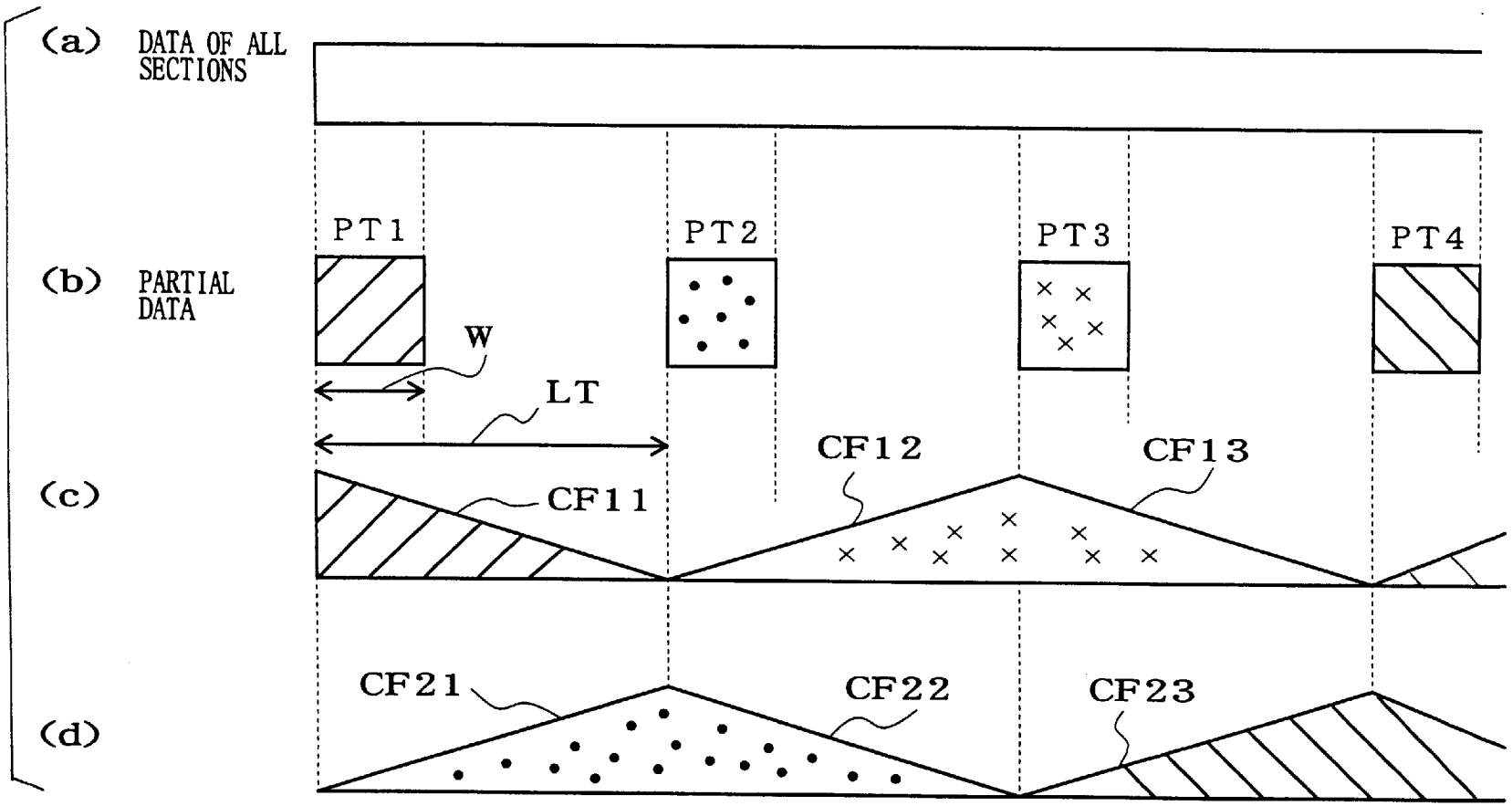
FIG. 13 is a conceptual diagram explanatory of a partial vector.

FIG. 13 is a conceptual diagram explanatory of the partial vector PVQ. In section (a) of FIG. 13, there is symbolically shown a succession of data (normal template data) acquired by analyzing a particular tonal factor (e.g., waveform) of an articulation element in a particular time section. In section (b) of FIG. 13, there are symbolically shown partial template data PT1, PT2, PT3 and PT4 extracted sporadically or dispersedly from the data of the entire section shown in section (a). These partial template data PT1, PT2, PT3 and PT4 are stored in the template data base section TDB as template data for that tonal factor. As in the normal case where the data of the entire time section are stored directly as template data, a single template vector is allocated to the template data. If, for example, the template vector for the template data is "Tim-B-nor", the partial template data PT1, PT2, PT3 and PT4 share the same template vector "Tim-B-nor". Let's assume here that identification data indicating that the template vector "Tim-B-nor" has a partial vector PVQ attached thereto is registered at an appropriate memory location.

For each of the partial partial template data PT1, PT2, PT3 and PT4, the partial vector PVQ contains data indicative of a stored location of the partial template data in the template data base section TDB (such as a loop start address), data indicative of a width W of the partial template data (such as a loop end address), and a time period LT over which the partial template data is to be repeated. Whereas the width W and time period LT are shown in the figure as being the same for all the partial template data PT1, PT2, PT3 and PT4, they may be set to any optionally-selected values for each of the data PT1, PT2, PT3 and PT4. Further, the number of the partial template data may be greater or smaller than four.

The data over the entire time section as shown in section (a) of FIG. 13 can be reproduced by reading out each of the partial template data PT1, PT2, PT3 and PT4 in a looped fashion only for the time period LT and connecting together the individual read-out loops. This data reproduction process will hereinafter be referred to as a "decoding process". One example of the decoding process may be arranged to simply execute a looped readout of each of the partial template data PT1, PT2, PT3 and PT4 for the time period LT, and another example of the decoding process may be arranged to cross-fade two adjoining waveforms being read out in a looped fashion. The latter example is more preferable in that it achieves a better connection between the loops.

In section (c) and (d) of FIG. 13, there are shown examples of the decoding process; specifically, (c) shows an example of a cross-fade control waveform in the first cross-fade synthesizing channel, while (d) shows an example of a cross-fade control waveform in the second cross-fade synthesizing channel. Namely, the first partial template data PT1 is controlled over the time period LT with a fade-out control waveform CF11 shown in section (c), and the second partial template data PT2 is controlled over the time period LT with a fade-in control waveform CF21 shown in section (d). Then, the partial template data PT1 having been subjected to the fade-out control is added together with the second partial template data PT2 having been subjected to the fade-in control, to provide a looped readout that is cross-faded from the first partial template data PT1 to the second partial template data PT2 during the time period LT. Thereafter, next cross-fade synthesis is carried out after replacing the first partial template data PT1 with the third partial template data PT3, replacing the control waveform for the data PT1 with a fade-in control waveform CF12 and replacing the control waveform for the second partial template data PT2 with a fade-out waveform CF22. After that, similar cross-fade synthesis will be repeated while sequentially switching the partial template data and control waveforms as shown. Note that in every such cross-fade synthesis, the two waveforms read out in the looped fashion are processed to properly agree with each other in both phase and pitch.

Figure 14:
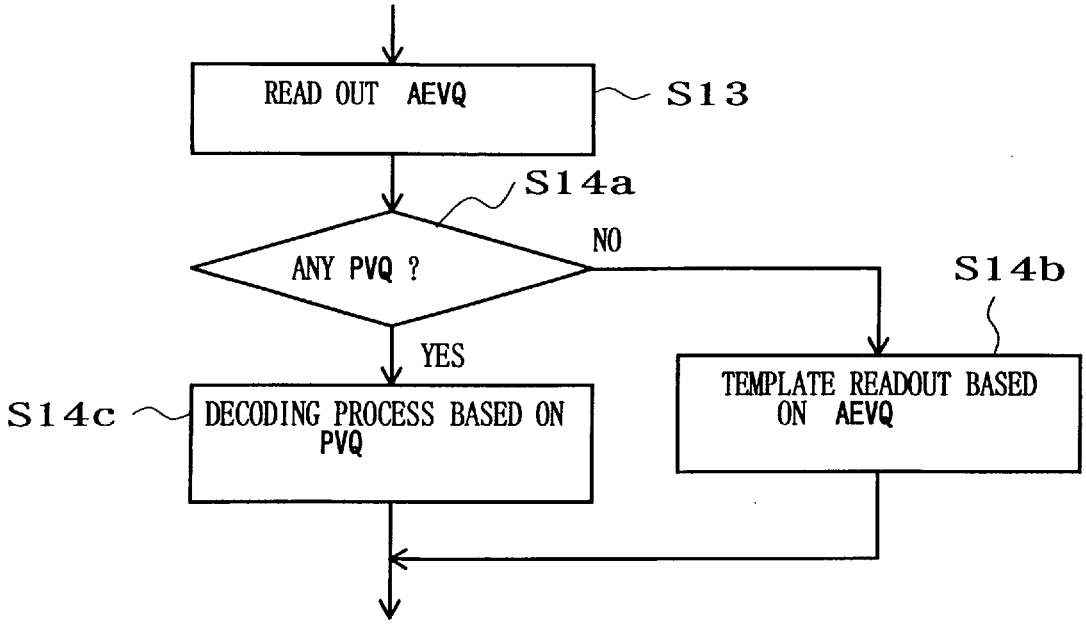
FIG. 14 is a flow chart showing part of an operational sequence for synthesizing a tone of an articulation element containing a partial vector.

FIG. 14 is a flow chart showing an example of a template readout process taking the partial vector PVQ into account. Steps S13 to S14*c* in this template readout process correspond to steps S13 and S14 of FIG. 7. At step S13, respective vector data of individual templates are read out which correspond to an articulation element designated from among those stored in the articulation element vector AEVQ. At step S14*a*, it is determined whether or not there is any partial vector PVQ on the basis of the identification data indicative of presence of a partial vector PVQ. If there is no partial vector PVQ, the process goes to step S14*b* in order to read out the individual template data from the template data base section TDB. Otherwise, the process goes to step S14*c*, where the above-mentioned "decoding process" is carried out on the basis of the partial vector PVQ to thereby reproduce (decode) the template data in the entire section of the articulation element.

When the partial vector PVQ is to be applied to an articulation element, there is no need to replace the templates for all the tonal factors of that articulation element with partial templates, and it is only necessary to use a partial template only for such a type of tonal factor that is fitted for a looped readout as a partial template. It will be appreciated that the reproduction of the template data over the entire section of the element based on the partial vector PVQ may be carried out using any other suitable scheme than the above-mentioned simple looped readout scheme; for example, a partial template of a predetermined length corresponding to a partial vector PVQ may be stretched along the time axis, or a limited plurality of partial templates may be placed, over the entire section of the element in question, randomly or in a predetermined sequence.

Vibrato Synthesis

The following paragraphs describe several new ideas as to how to execute vibrato synthesis in the embodiment.

Figure 15:
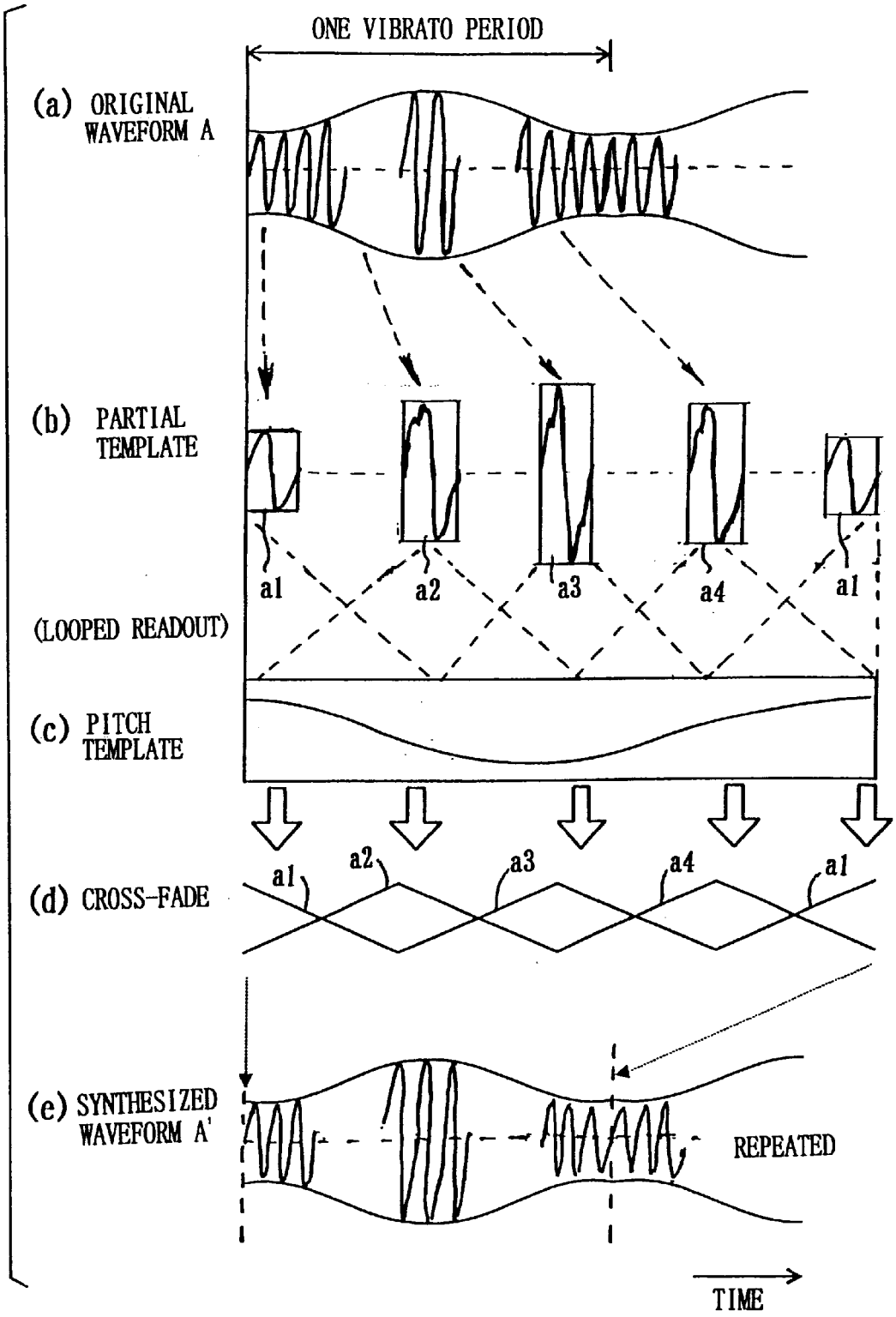
FIG. 15 is a diagram showing an example of a vibrato synthesizing process.

FIG. 15 is a diagram showing examples where waveform data of a body portion having a vibrato component are compressed using the novel idea of the partial vector PVQ and the compressed waveform data are decoded. Specifically, in section (a) of FIG. 15, there is illustratively shown an original waveform A with a vibrato effect, where the waveform pitch and amplitude vary over one vibrato period. In section (b) of FIG. 15, there are illustratively shown a plurality of waveform segments a1, a2, a3 and a4 extracted dispersedly from the original waveform A shown in section (a). Segments of the original waveform A which have different shapes (tone colors) are selected or extracted as these waveform segments a1, a2, a3 and a4 in such a manner that each of the segments has one or more waveform lengths (waveform periods) and the waveform length of each of the segments takes a same data size (same number of memory addresses). These selectively extracted waveform segments a1 to a4 are stored in the template data base section TDB as partial template data (i.e., looped waveform data), and are read out sequentially in the looped fashion and subjected to the cross-fade synthesis.

Further, in section (c) of FIG. 15, there is shown a pitch template defining a pitch variation during one vibrato period. Whereas the pitch variation pattern of this template is shown here as starting with a high pitch, then falling to a low pitch and finally returning to a high pitch, this pattern is just illustrative, and the template may define any other pitch variation pattern, such as one which starts with a low pitch, then rises to a high pitch and finally returns to a low pitch or one which starts with an intermediate pitch, then rises to a high pitch, next falls to a low pitch and finally returns to an intermediate pitch.

Furthermore, in section (d) of FIG. 15, there is shown an example of a cross-fade waveform corresponding to the individual waveform segments a1 to a4 read out in the looped fashion. The waveform segments a1 and a2 are first read out repetitively in the looped fashion at the pitch specified by the pitch template shown in section (c), and these read-out waveform segments a1 and a2 are synthesized together after the waveform segment a1 is subjected to fade-out amplitude control and the waveform segment a2 is subjected to fade-in amplitude control. In this way, the waveform shape sequentially changes by being cross-faded from the waveform segment a1 to the other waveform segment a2, and besides, the pitch of the cross-fade synthesized waveform sequentially varies at the pitch specified by the template. Afterwards, cross-fade synthesis is carried out between the waveform segments a2 and a3, next between the waveforms a3 and a4 and then between the waveform segments a4 and al, by sequentially switching the waveforms to be subjected to the cross-fade synthesis.

In section (e) of FIG. 15, there is shown synthesized waveform data A', which presents a shape sequentially varying, during one vibrato period, smoothly from the waveform segment a1 to the waveform segment a4 due to the cross-fade synthesis and whose pitch is varied as specified by the pitch template so as to be imparted a vibrato effect. Repeating the above-mentioned synthesis of the waveform data A' for one vibrato period can synthesize waveform data over a plurality of vibrato periods. To this end, it is only necessary that the pitch template for one vibrato period as shown in section (c) of FIG. 15 be looped over a necessary number of vibrato periods, and the partial vectors PVQ may be organized in a hierarchical manner; that is to say, for the waveform synthesis for one vibrato period, the waveform segments a1 to a4 may be read out individually in the looped fashion and the whole of the resultant waveform (for one vibrato period) may be hierarchically organized such that it is further repeated in accordance with the looping of the pitch template.

Figure 16:
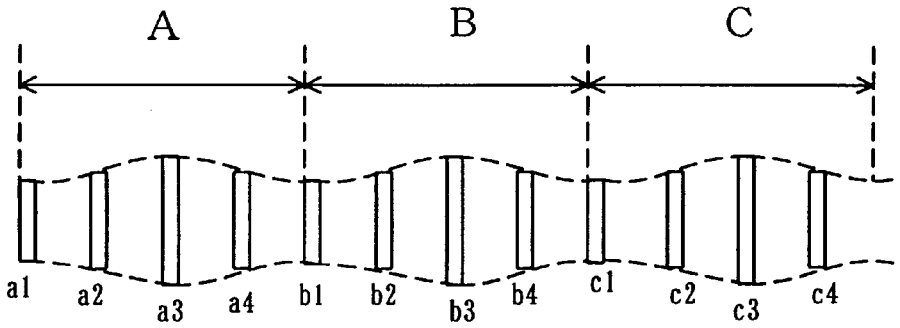
FIG. 16 is a diagram showing another example of the vibrato synthesizing process.

FIG. 16 is a diagram showing another example of vibrato synthesis, in which a plurality of waveform segments a1 to a4, b1 to b4 and c1 to c4 are extracted dispersedly from sections A, B and C, respectively, over a plurality of vibrato periods of an original waveform with a vibrato effect. As previously noted in relation to FIG. 15, those segments of the original waveform which have different shapes (tone colors) are selected or extracted as these waveform segments a1 to a4, b1 to b4 and c1 to c4 in such a manner that each of the segments has one or more waveform cycles (waveform periods) and one waveform length of each of the segments takes a same data size (same number of memory addresses). Basically, these selectively extracted waveform segments a1 to a4, b1 to b4 and c1 to c4 are stored in the template data base section TDB as partial template data, and are read out sequentially in the looped fashion and subjected to the cross-fade synthesis, in a manner similar to that described earlier in relation to FIG. 15. The illustrated example of FIG. 16 is different from that of FIG. 15 in that the time positions of the individual waveform segments a1 to a4, b1 to b4 and c1 to c4 are rearranged to optionally change pairs of the waveform segments to be subjected to the cross-fade synthesis in such a way that a variety of tone color variations may be provided by various different combinations of the waveform segments.

For example, by rearranging the positions of sets of the waveform segments a1 to a4, b1 to b4 and c1 to c4 without changing their relative time positions within one vibrato period, there can be provided a rearranged pattern of the waveform segment positions, such as a pattern "a1→b2→c3→a4→b1→c2→a3→b4→c1→a2→b3→c4". By carrying out a vibrato synthesis process based on the cross-fade synthesis, as shown in FIG. 15, in accordance with such a rearrangement pattern of the waveform segment positions, it is possible to provide a vibrato that contains a tone color variation different from that achieved by a vibrato synthesis through the cross-fade synthesis based on an original pattern of the waveform segment positions. The reason why the positions of the waveform segment sets a1 to a4, b1 to b4 and c1 to c4 are rearrangement without their relative time positions within one vibrato period left unchanged is to avoid unnaturalness that would result from the positional arrangement.

In the case of the 12 waveform segments a1 to a4, b1 to b4 and c1 to c4 as shown in FIG. 16, 81 ($3^4$) different rearrangement patterns of the waveform segment positions are possible per vibrato period and 813 different rearrangement patterns of the waveform segment positions are possible for three vibrato periods, so that this example can provide greatly diversified waveform color variations in a vibrato performance. Any one of the rearrangement or combination patterns of the waveform segment positions may be selected in a random manner.

It will be appreciated that the waveform having a vibrato characteristic, generated by the scheme as illustrated in FIG. 15 or 16 (e.g., the waveform A' shown in section (e) of FIG. 15) or by another suitable scheme, can be variably controlled by the pitch (Pitch) template, amplitude (Amp) template and time (TSC) template. For example, the pitch (Pitch) template can control the vibrato depth, the amplitude (Amp) template can control the depth of amplitude modulation that is imparted along with the vibrato, and the time (TSC) template can compress or stretch the time length of the waveform, constituting one vibrato period, to thereby control the vibrato speed (i.e., control the vibrato period).

For instance, in the illustrated example of FIG. 15, the time length of one vibrato period can be controlled to be stretched or compressed, by time-axially stretching or compressing (TSC-controlling) the time length of each cross-fade period, shown in section (d), in accordance with a desired time (TSC) template without changing a tone reproduction pitch (variation rate of waveform read addresses). Thus, the vibrato frequency can be controlled. Where the TSC template is prepared in correspondence with one vibrato period just like the pitch template shown in section (c) of FIG. 15, it is only necessary that this TSC template for one vibrato period be looped for a necessary number of vibrato periods. It will be appreciated that the pitch and amplitude templates may be controlled to be stretched or compressed along the time axis in response to the time-axial stretch or compression control of the waveform based on the TSC template so that these tonal factors can be controlled to be stretched or compressed time-axially in association with each other.

Further, by upward or downward shifting of a pitch-variation envelope characteristic specified by the pitch template, it is possible to variably control the tone reproduction pitch of the vibrato waveform. In this case, if an arrangement is made to omit the time-axial control of the waveform based on the TSC template, then the time length of one vibrato period can be controlled to be kept constant irrespective of the tone reproduction pitch.

Connecting Rule

The following paragraphs describe detailed examples of connecting rule data RULE that specify how to connect together articulation elements.

According to the preferred embodiment, there are provided the following connecting rules in relation to the individual tonal factors.

(1) Waveform (Timbre) Template Connecting Rules:

Rule 1: This rule defines a direct connection. Where a smooth connection between adjoining articulation elements is guaranteed previously as in the case of a preset style-of-rendition sequence (articulation element sequence AESEQ), direct connection between the articulation elements involving no interpolation would present no significant program.

Figure 17A:
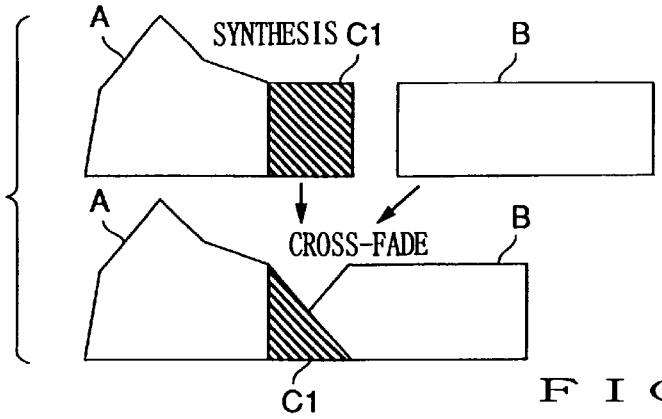
FIGS. 17A to 17E are diagrams showing several rules employed in connecting waveform templates.

Rule 2: This rule defines an interpolation process that is based on expansion of the ending portion of a waveform A in the preceding element. One example of such an interpolation process is shown in FIG. 17A, where the ending portion in the preceding element waveform A is expanded to provide a connecting waveform segment C1 and the succeeding element waveform B is used directly with no change. Cross-fade synthesis is carried out by causing the connecting waveform segment C1 at the end of the preceding element waveform A to fade out and causing the beginning portion of the succeeding element waveform B to fade in. The connecting waveform segment C1 is formed typically by repeating readout of one or more cycles in the ending portion of the preceding element waveform A over a necessary length.

Figure 17B:
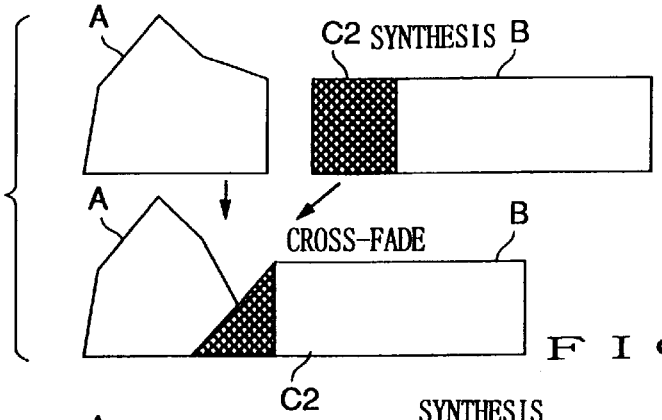

Rule 3: This rule defines an interpolation process that is based on expansion of the beginning portion of the succeeding element waveform B. One example of such an interpolation process is shown in FIG. 17B, where the beginning portion in the succeeding element waveform B is expanded to provide a connecting waveform segment C2 and the preceding element waveform A is used directly with no change. The cross-fade synthesis is carried out by causing the ending portion of the preceding element waveform A to fade out and causing the connecting waveform segment C2 at the beginning of the succeeding element waveform B to fade in. Similarly to the above-mentioned, the connecting waveform segment C2 is formed by repeating readout of one or more cycles in the beginning portion of the succeeding element waveform B over a necessary length.

Figure 17C:
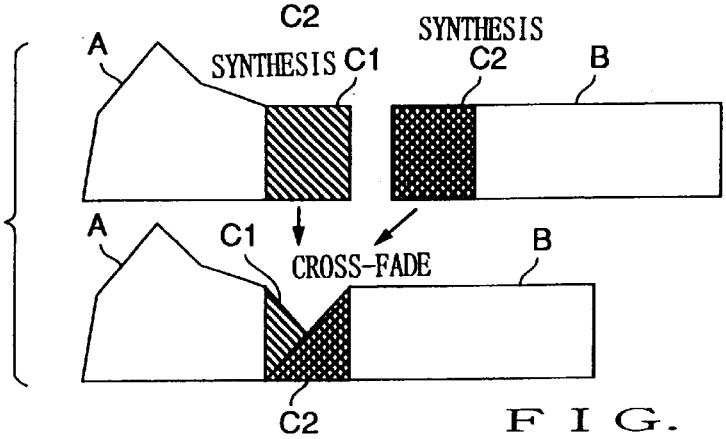

Rule 4: This rule defines an interpolation process that is based on expansion of both the ending portion of the preceding element waveform A and the beginning portion of the succeeding element waveform B. One example of such an interpolation process is shown in FIG. 17C, where the ending portion in the preceding element waveform A is expanded to provide a connecting waveform segment C1 and the beginning portion in the succeeding element waveform B is expanded to provide a connecting waveform segment C2 and where the cross-fade synthesis is executed between the connecting waveform segments C1 and C2. In this case, the total time length of the synthesized waveform would be increased by an amount equivalent to the length of the cross-fade synthesis period between the connecting waveform segments C1 and C2, and thus the increased time length is then subjected to time-axial compression by the TSC control.

Figure 17D:
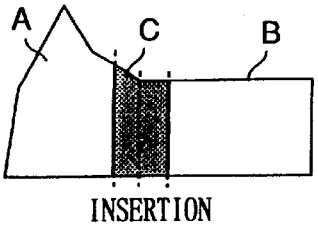

Rule 5: This rule defines a scheme which is based on insertion of a previously-made connecting waveform C between the preceding element waveform A and the succeeding element waveform B, as illustratively shown in FIG. 17D. In this case, the ending portion of the preceding element waveform A and the beginning portion of the succeeding element waveform B are partly removed by a length equivalent to the connecting waveform C. In an alternative, the connecting waveform C may be inserted between the preceding element and succeeding element waveforms A and B without removing the ending portion of the former and the beginning portion of the latter, in which case, however, the total time length of the synthesized waveform would be increased by an amount equivalent to the inserted connecting waveform C and thus the increased time length is then subjected to time-axial compression by the TSC control.

Figure 17E:
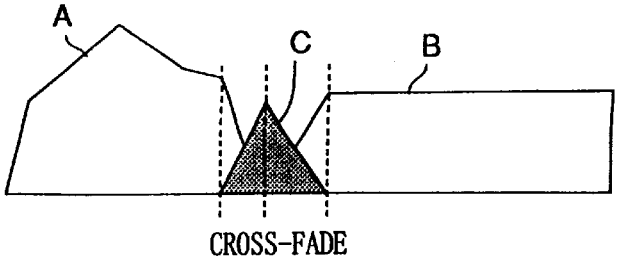

Rule 6: This rule defines a connecting scheme which is based on insertion of a previously-made connecting waveform C between the preceding element waveform A and the succeeding element waveform B, during which time cross-fade synthesis is executed between the ending portion of the preceding element waveform A and the former half of the connecting waveform C and between the beginning portion of the succeeding element waveform B and the latter half of the connecting waveform C, as illustratively shown in FIG. 17E. In the event that the total time length of the synthesized waveform is increased or decreased due to the insertion of the connecting waveform C, the increased or decreased length is then subjected to time-axial compression or stretch by the TSC control.

(2) Other Connecting Rules:

Because the data of the other templates (amplitude, pitch and time templates) than the waveform (Timbre) template take a simple shape of an envelope waveform, a smooth connection may be achieved via simpler interpolation operations without resorting to complex interpolation operations based on the two-channel cross-fade control waveforms.

Thus, in the interpolation synthesis between the template data each taking the shape of an envelope waveform, in particular, it is preferable to provide the interpolation results as differences (with the plus or minus sign) from the original template data values. In this manner, interpolating arithmetic operations for a smooth connection are accomplished by only adding the interpolated results or differences (with the plus or minus sign) to the original template data values, which would thus greatly simplify the necessary operations.

Figure 18A:
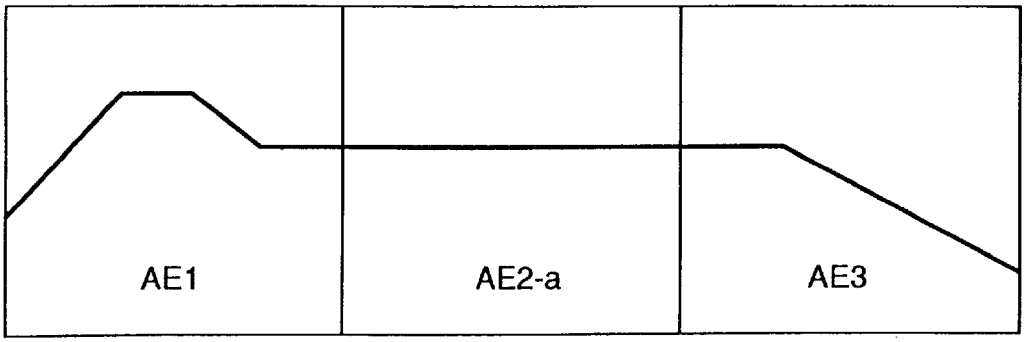
FIGS. 18A to 18C are diagrams showing several rules applied in connecting some other types of template data (each in the form of an envelope waveform) than the waveform template data.

Rule 1: This rule defines a direct connection as illustratively shown in FIG. 18A. In this instance, no interpolation process is required because of coincidence between an ending level of a first element template (envelope waveform) AE1 and a beginning level of a second element template (envelope waveform) AE2-a and between an ending level of the second element template (envelope waveform) AE2-a and a beginning level of a third element template (envelope waveform) AE3.

Figure 18B:
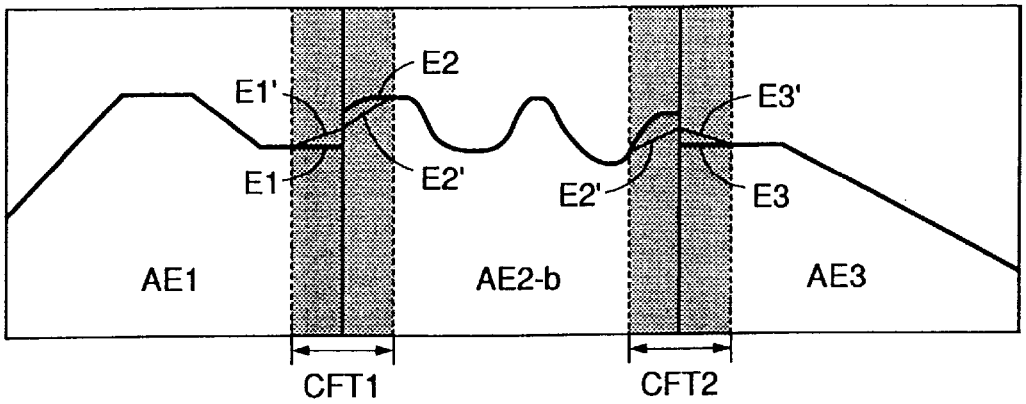

Rule 2: This rule defines a smoothing interpolation process over a local region before and after each connecting point, as illustratively shown in FIG. 18B. In this instance, an interpolation process is executed to permit a smooth shift from the first element template (envelope waveform) AE1 to the second element template (envelope waveform) AE2-b in a predetermined region CFT1 between an ending portion of the first element template AE1 and a beginning portion of the second element template AE2-b. Further, an interpolation process is executed to permit a smooth shift from the second element template (envelope waveform) AE2-b to the third element template (envelope waveform) AE3 in a predetermined region CFT2 between an ending portion of the second element template and a beginning portion of the third element template.

In the case of Rule 2, let's assume that data E1', E2' and E3' resulting from the interpolation process are given as differences (with the plus or minus sign) from the corresponding original template data values (envelope values) E1, E2 and E3. In this manner, interpolating arithmetic operations for smooth connections are accomplished by only adding the interpolated results or differences E1', E2' and E3' to the original template data values E1, E2 and E3 that are read out in real time from the template data base section TDB, and the necessary operations for smooth connections can be greatly simplified.

Figure 19A:
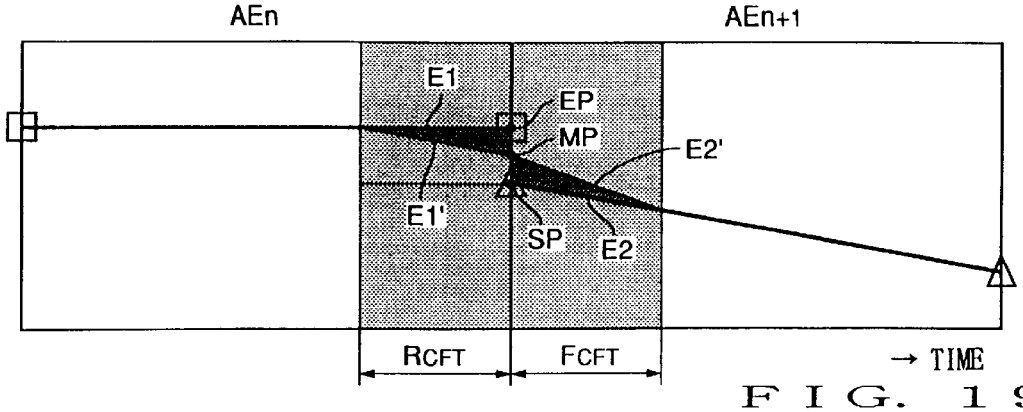
FIGS. 19A to 19C are diagrams showing several detailed examples of the connecting rule shown in FIG. 18B.
Figure 19B:
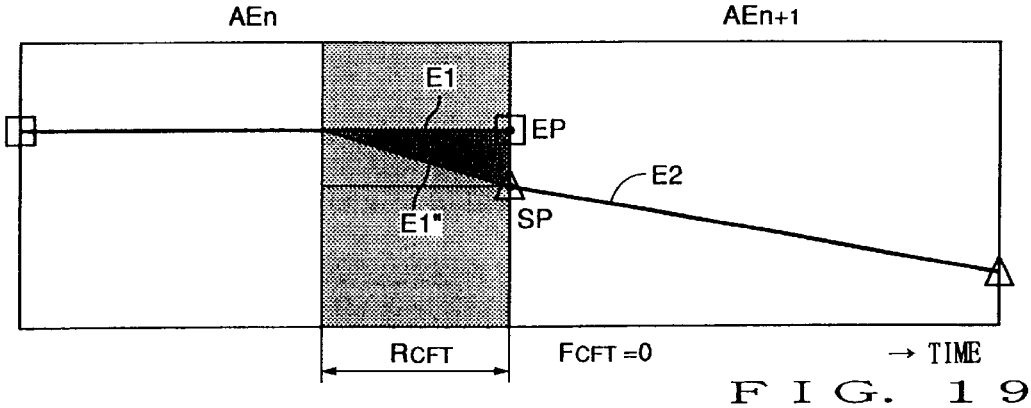
Figure 19C:
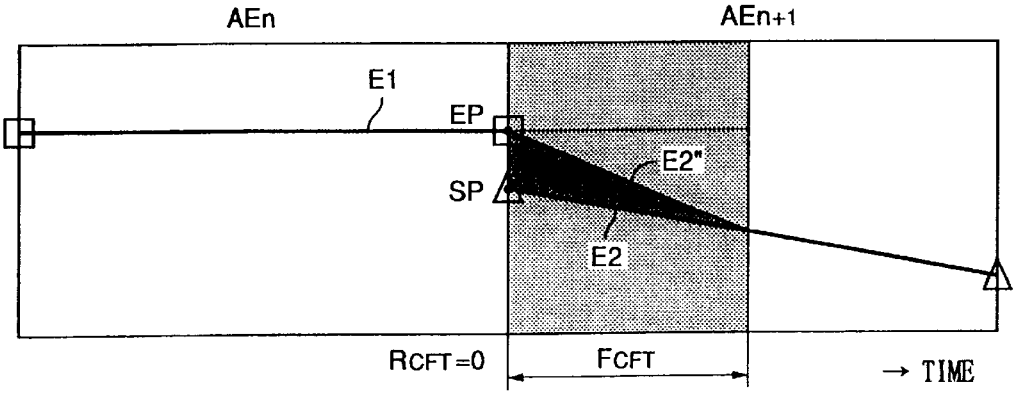

Specifically, the interpolation process according to Rule 2 may be carried out in any one of a plurality of ways such as shown in FIGS. 19A, 19B and 19C.

In the example of FIG. 19A, an intermediate level MP between a template data value EP at the end point of a preceding element $AE_n$ and a template data value SP at the start point of a succeeding element $AE_{n+1}$ is set as a target value and then the interpolation is carried out over an interpolation area RCFT in an ending portion of the preceding element $AE_n$ such that the template data value of the preceding element $AE_n$ is caused to gradually approach the target value MP. As a consequence, the trajectory of the template data of the preceding element $AE_n$ changes from original line E1 to line E1'. Also, in a next interpolation area FCFT in a beginning portion of the succeeding element $AE_{n+1}$, the interpolation is carried out such that the template data of the succeeding element $AE_{n+1}$ is caused to start with the above-mentioned intermediate level MP and gradually approach the trajectory of the original template data values denoted by line E2. As a consequence, the trajectory of the template data of the succeeding element $AE_{n+1}$ in the next interpolation area FCFT gradually approaches the original trajectory E2 as denoted at line E2'.

Further, in the example of FIG. 19B, the template data value SP at the start point of the succeeding element $AE_{n+1}$ is set as a target value and the interpolation is carried out over the interpolation area RCFT in the ending portion of the preceding element $AE_n$ such that the template data value of the preceding element $AE_n$ is caused to gradually approach the target value SP. As a consequence, the trajectory of the template data of the preceding element $AE_n$ changes from original line E1 to line E1". In this case, there is no interpolation area FCFT in the beginning portion of the succeeding element $AE_{n+1}$.

Furthermore, in the example of FIG. 19C, the interpolation is carried out over the interpolation area FCFT in the beginning portion of the succeeding element $AE_{n+1}$ such that the template data of the succeeding element $AE_{n+1}$ is caused to start with the value EP at the end point of the preceding element $AE_n$ and gradually approach the trajectory of the original template data values as denoted at line E2. As a consequence, the trajectory of the template data of the succeeding element $AE_{n+1}$ in the interpolation area RCFT gradually approaches the original trajectory E2 as denoted at line E2". In this case, there is no interpolation area RCFT in the ending portion of the preceding element $AE_n$.

In FIGS. 19A to 19C as well, let's assume that data indicative of the individual trajectories E1', E2', E1" and E2" resulting from the interpolation are given as differences from the corresponding original template data values E1 and E2.

Figure 18C:
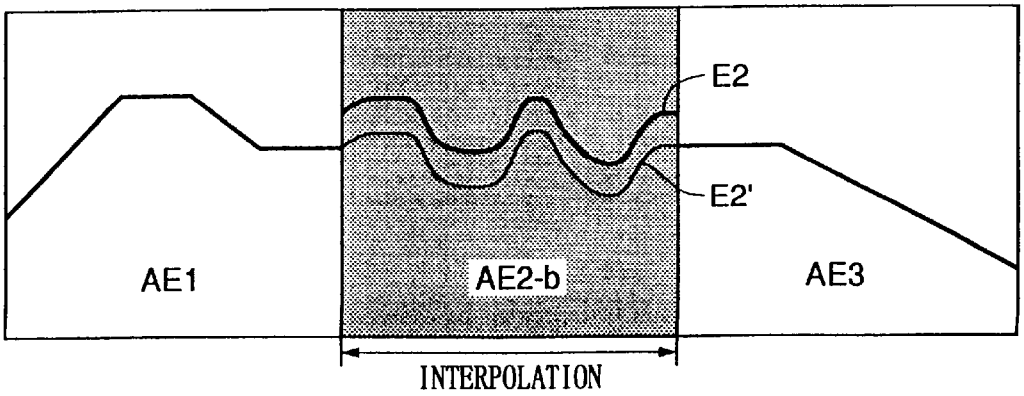

Rule 3: This rule defines a smoothing interpolation process over an entire section of an articulation element, one example of which is shown in FIG. 18C. In this example, while the template (envelope waveform) of a first element AE1 and the template (envelope waveform) of a third element AE3 are left unchanged, but interpolation is carried out on all data of the template (envelope waveform) of a second element AE2-b in between the elements AE1 and AE3 in such a way that a starting level of the second element template AE2-b coincides with an ending level of the first element template AE1 and an ending level of the second element template AE2-b coincides with a starting level of the third element template AE3. In this case too, let's assume that data E2' resulting from the interpolation is given as a difference (with the plus or minus sign) from the corresponding original template data value (envelope value) E2.

Figure 20A:
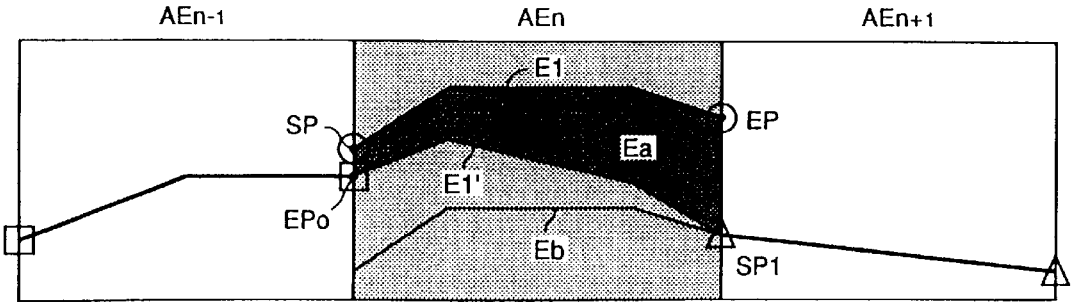
FIGS. 20A to 20C are diagrams showing several detailed examples of the connecting rule shown in FIG. 18C.
Figure 20B:
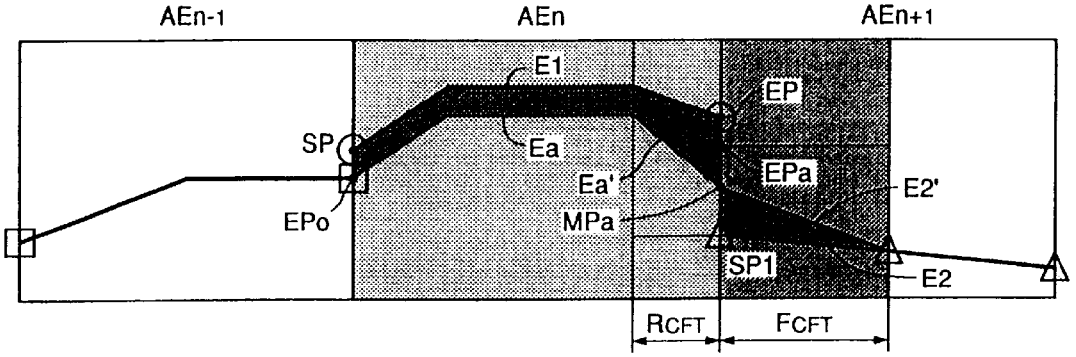
Figure 20C:
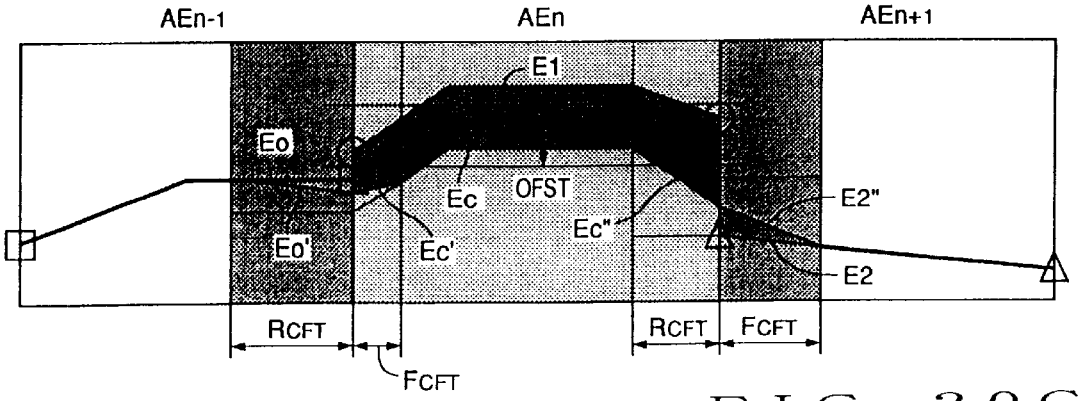

Specifically, the interpolation process according to Rule 3 may be carried out in any one of a plurality of ways such as shown in FIGS. 20A, 20B and 20C.

In FIG. 20A, there is shown an example where the interpolation is carried out only on an intermediate element $AE_n$ between two other elements. Reference character E1 represents the original trajectory of template data of the element AEn. The template data value trajectory of the intermediate element AEn is shifted in accordance with a difference between a template data value EP0 at the end point of the element $AE_{n-1}$ preceding the element AEn and an original template data value SP at the start point of the intermediate element AEn, so as to create template data following a shifted trajectory Ea over the entire section of the element AEn. Also, the template data value trajectory of the intermediate element AEn is shifted in accordance with a difference between an original template data value EP at the end point of the intermediate element AE and a template data value EP0 at the start point of the element $AE_{n+1}$ succeeding the element AEn, so as to create template data following a shifted trajectory Eb over the entire section of the element AEn. After that, the template data of the shifted trajectories Ea and Eb are subjected to cross-fade interpolation to provide a smooth shift from the trajectory Ea to the trajectory Eb, so that interpolated template data following a trajectory E1' are obtained over the entire section of the element AEn.

In FIG. 20B, there is shown another example where data modification is executed over the entire section of the intermediate element $AE_n$ and the interpolation is carried out in a predetermined interpolation area RCFT in an ending portion of the intermediate element $AE_n$ and in a predetermined interpolation area FCFT in a beginning portion of the succeeding element $AE_{n+1}$. First, similarly to the above-mentioned, the template data value trajectory E1 of the intermediate element AEn is shifted in accordance with a difference between a template data value EP0 at the end point of the element $AE_{n-1}$ preceding the element $AE_n$ and an original template data value SP at the start point of the intermediate element AEn, so as to create template data following a shifted trajectory Ea over the entire section of the element AEn.

Thereafter, an intermediate level MPa between a template data value EP at the end point of the trajectory Ea and a template data value SP1 at the start point of the succeeding element $AEn_{+1}$ is set as a target value and then the interpolation is carried out over the interpolation area RCFT in the ending portion of the intermediate element $AE_n$ such that the template data value of the preceding element $AE_n$ following the trajectory Ea is caused to gradually approach the target value MPa. As a consequence, the trajectory Ea of the template data of the element $AE_n$ changes as denoted at Ea'. Also, in the next interpolation area FCFT in the beginning portion of the succeeding element $AE_{n+1}$, the interpolation is carried out such that the template data of the succeeding element $AE_{n+1}$ is caused to start with the above-mentioned intermediate level MPa and gradually approach an original template data value trajectory as denoted at line E2. As a consequence, the trajectory of the template data of the succeeding element $AE_{n+1}$ in the next interpolation area FCFT gradually approaches the original trajectory E2 as denoted at line E2'.

In FIG. 20C, there is shown still another example where data modification is executed over the entire section of the intermediate element AEn, the interpolation is carried out in the interpolation area RCFT in the ending portion of the preceding element $AE_{n-1}$ and in the interpolation area FCFT in the beginning portion of the intermediate element $AE_n$, and also the interpolation is carried out in the interpolation areas RCFT and FCFT in the ending portion of the intermediate element $AE_n$ and beginning portion of the succeeding element $AE_{n+1}$. First, the original template data value trajectory E1 of the intermediate element AEn is shifted by an appropriate offset amount OFST, so as to create template data following a shifted trajectory Ec over the entire section of the element AEn.

Thereafter, the interpolation is carried out in the interpolation areas RCFT and FCFT in the ending portion of the preceding element $AE_{n-1}$ and beginning portion of the intermediate element $AE_n$ to provide a smooth connection between the template data trajectories E0 and Ec, so that interpolated trajectories E0' and Ec' are obtained in these interpolation areas. Similarly, the interpolation is carried out in the interpolation areas RCFT and FCFT in the ending portion of the intermediate element $AE_n$ and beginning portion of the succeeding element $AE_{n+1}$ to provide a smooth connection between the template data trajectories Ec and E2, so that interpolated trajectories Ec" and E2" are obtained in these interpolation areas RCFT and FCFT.

In FIG. 20 as well, let's assume that data indicative of the individual trajectories E1', Ea, Ea', E2', Ec, Ec', Ec" and E0' resulting from the interpolation are given as differences from the corresponding original template data values E1, E2 and E0.

Figure 21:
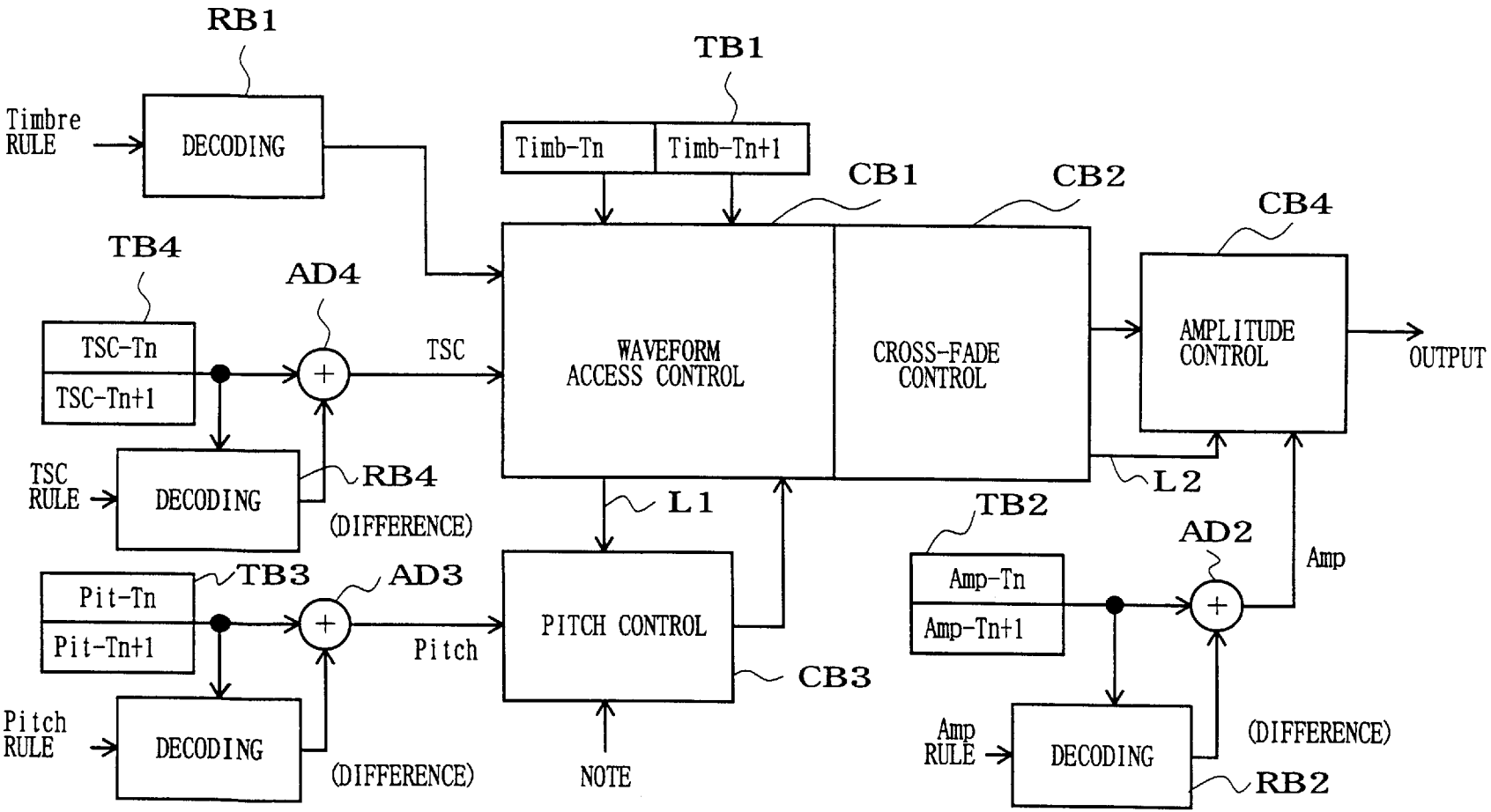
FIG. 21 is a block diagram outlining tone synthesis processing based on various types of template data and operations for connecting together the template data.

Conceptual Description on Tone Synthesis Processing Including Connecting Process FIG. 21 is a conceptual block diagram showing a general structure of a tone synthesizing device in accordance with a preferred embodiment of the present invention, which is designed to execute the above-described connecting process for each of the template data corresponding to the tonal factors and thereby carry out the tone synthesis processing on the basis of the thus-connected template data.

In FIG. 21, template data supply blocks TB1, TB2, TB3 and TB4 supply waveform template data Timb-Tn, amplitude template data Amp-Tn, pitch template data Pit-Tn and time template data TSC-Tn, respectively, of a preceding one of two adjoining articulation elements (hereinafter called a preceding articulation element), as well as template data $Timb\text{-}Tn_{+1}$, amplitude template data $Amp\text{-}Tn_{+1}$, pitch template data $Pit\text{-}Tn_{+1}$ and time template data $TSC\text{-}Tn_{+1}$, respectively, of the other or succeeding one of the two adjoining articulation elements (hereinafter called a succeeding articulation element).

Rule decoding process blocks RB1, RB2, RB3 and RB4 decode connecting rules TimbRULE, AmpRULE, PitRULE and TSCRULE corresponding to individual tonal factors of the articulation element in question, and they carry out the connecting process, as described earlier in relation to FIGS. 17 to 20, in accordance with the respective decoded connecting rules. For example, the rule decoding process block RB1 for waveform template performs various operations to carry out the connecting process as described earlier in relation to FIG. 17 (i.e., the direct connection or cross-fade interpolation).

The rule decoding process block RB2 for amplitude template performs various operations to carry out the connecting process as described earlier in relation to FIGS. 18 to 20 (i.e., the direct connection or interpolation). In this case, because the interpolation results are given as differences (with the plus or minus signs) from the original data values, each interpolated data or difference value output from the rule decoding process block RB2 is added, via an adder AD2, to the original template data value supplied from the corresponding template data supply block TB2. For a similar reason, adders AD3 and AD4 are provided for adding outputs from the other rule decoding process blocks RB3 and RB4 with the original template data values supplied from the corresponding template data supply blocks TB3 and TB4.

Thus, the adders AD2, AD3 and AD4 output template data Amp, Pitch and TSC, respectively, each having been subjected to the predetermined connection between adjoining elements. Pitch control block CB3 is provided for controlling a waveform readout rate in accordance with the pitch template data Pitch. Because the waveform template itself contains information indicative of an original pitch (original pitch envelope), the pitch control block CB3 receives, via a line L1, the original pitch information from the data base and controls the waveform readout rate on the basis of a difference between the original pitch envelope and the pitch template data Pitch. If the original pitch envelope and the pitch template data Pitch match each other, it is only necessary that desired waveform data be read out at a constant rate, but if the original pitch envelope and the pitch template data Pitch are different from each other, it is necessary for the pitch c control block CB3 to variably control the waveform readout rate by an amount corresponding to the difference therebetween. Also, the pitch control block CB3 receives note designating data and controls the waveform readout rate in accordance with the received note designating data. Assuming that the original pitch specified by the waveform template data is basically a pitch of note "C4" and a tone of note D4 specified by the note designating data is also generated using the same waveform template data having the original pitch of note C4, the waveform readout rate will be controlled in accordance with a difference between the "note D4" pitch specified by the note designating data and the original "note C4" pitch. Details of such pitch control will not be described here since the conventional technique well-known in the art can be employed such the control.

Waveform access control block CB1 sequentially reads out individual samples of the waveform template data, basically in accordance with waveform-readout-rate control information output from the pitch control block CB3. At that time, the total waveform readout time is variably controlled in accordance with the TSC control information while the waveform readout mode is controlled in accordance with the TSC control information given as the time template data and the pitch of a generated tone is controlled in accordance with the waveform template data control information. When, for example, the tone generating (sounding) time length is to be stretched or made longer than the time length of the original waveform data, it can be properly stretched with a desired pitch maintained, by allowing part of the waveform to be read out repetitively while leaving the waveform readout rate unchanged. When, on the other hand, the tone generating time length is to be compressed or made shorter than the time length of the original waveform data, it can be properly compressed with a desired pitch maintained, by allowing part of the waveform to be read out sporadically while leaving the waveform readout rate unchanged.

Further, the waveform access control block CB1 and cross-fade control block CB2 perform various operations to carry out the connecting process as described earlier in relation to FIG. 17 (i.e., the direct connection or cross-fade interpolation) in accordance with the output from the waveform template rule decoding process block RB1. The cross-fade control block CB2 is also used to execute the cross-fade process on a partial waveform template, being read out in the looped fashion, in accordance with the partial vector PVQ, as well as to smooth a waveform connection during the above-mentioned TSC control.

Furthermore, an amplitude control block CB4 operates to impart to generated waveform data an amplitude envelope specified by the amplitude template Amp. Because the waveform template itself also contains information indicative of an original amplitude envelope, the amplitude control block CB4 receives, via a line L2, the original amplitude envelope information from the data base and controls the waveform data amplitude on the basis of a difference between the original amplitude envelope and the amplitude template data Amp. If the original amplitude envelope and the amplitude template data Amp match each other, it is only necessary for the amplitude control block CB4 to allow the waveform data to pass therethrough without undergoing substantial amplitude control. If, on the other hand, the original amplitude envelope and the amplitude template data Amp are different from each other, it is only necessary that the amplitude level be variably controlled by an amount corresponding to the difference.

Detailed Example of Tone Synthesizing Device

Figure 22:
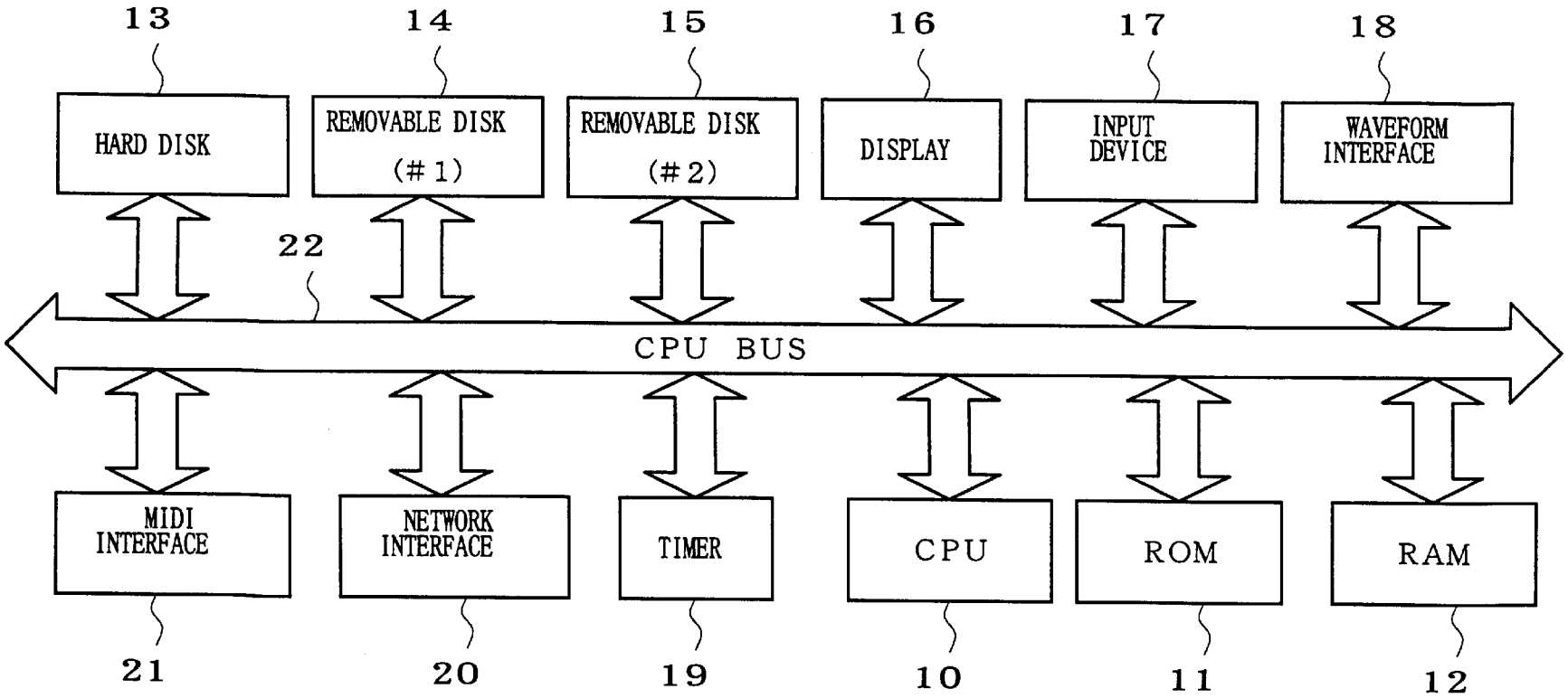
FIG. 22 is a block diagram showing an exemplary hardware setup of a tone synthesizing device in accordance with a preferred embodiment of the present invention.

FIG. 22 is a block diagram showing an exemplary hardware setup of the tone synthesizing device in accordance with a preferred embodiment of the present invention, which is applicable to a variety of electronically operable manufactures, such as an electronic musical instrument, karaoke device, electronic game machine, multimedia equipment and personal computer.

The tone synthesizing device shown in FIG. 22 carries out the tone synthesis processing based on the principle of the present invention. To this end, a software system is built to implement the tone data making and tone synthesis processing according to the present invention, and also a given data base DB is built in a memory device attached to the tone synthesizing device. In an alternative, the tone synthesizing device may be arranged to access, via a communication line, a data base DB external to the tone synthesizing device; the external data base DB may be provided in a host computer connected with the tone synthesizing device.

The tone synthesizing device of FIG. 22 includes a CPU (Central Processing Unit) 10 as its main control, under the control of which are run software programs for carrying out the tone data making and tone synthesis processing according to the present invention, as well as a software tone generator program. It should be obvious that the CPU 10 is capable of executing any other necessary programs in parallel with the above-mentioned programs.

To the CPU 10 are connected, via a data and address bus 22, a ROM (Read-Only Memory) 11, a RAM (Random Access Memory) 12, a hard disk device 13, a first removable disk device (such as a CD-ROM, or MO, i.e., magneto-optical disk drive) 14, a second removable disk device (such as a floppy disk drive) 15, a display 16, an input device 17 such as a keyboard and mouse, a waveform interface 18, a timer 19, a network interface 20, a MIDI interface 21 and so forth.

Figure 23:
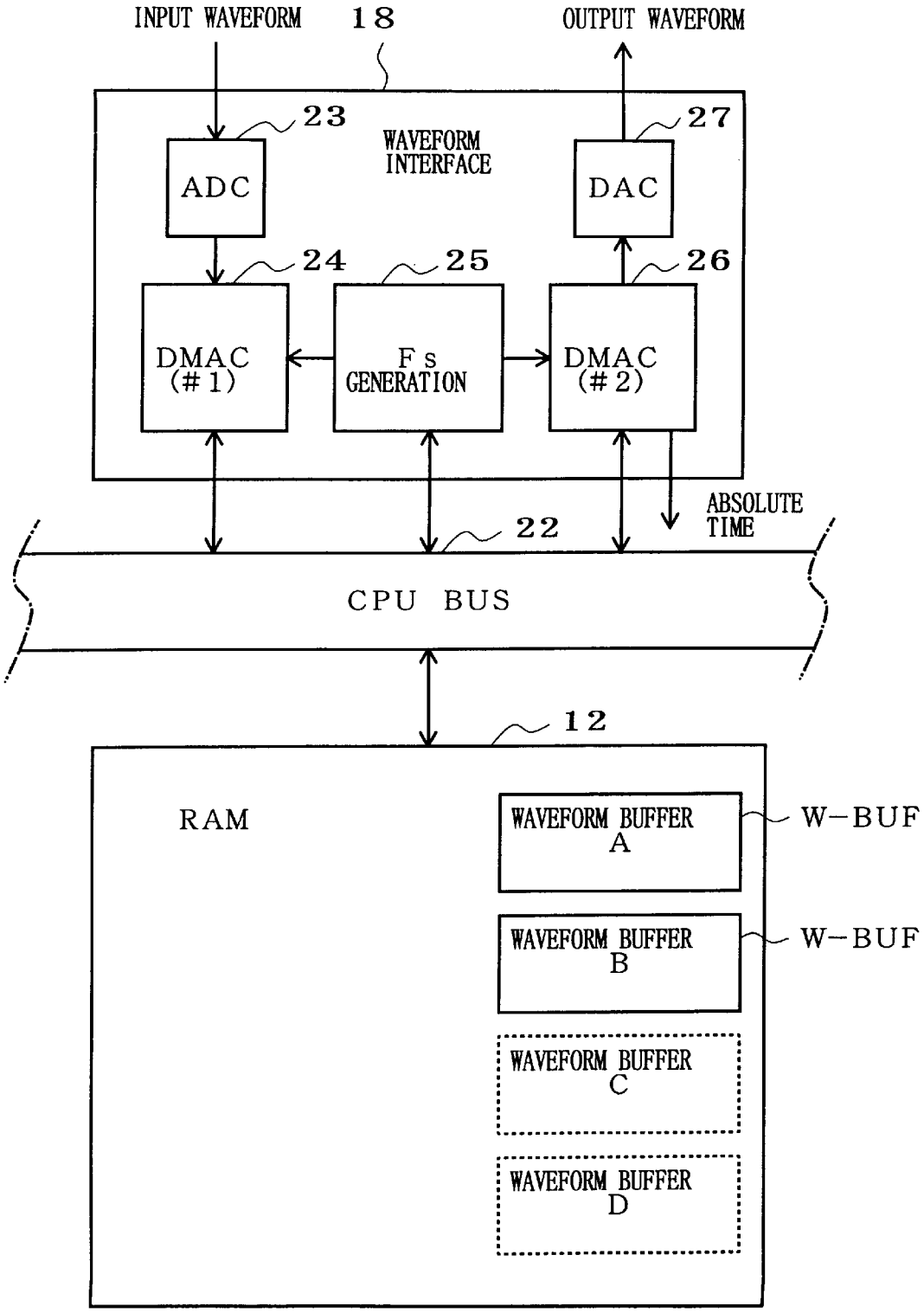
FIG. 23 is a block diagram showing an exemplary detail of a waveform interface and an exemplary arrangement of waveform buffers within a RAM shown in FIG. 22.

Further, FIG. 23 is a block diagram showing an exemplary detailed setup of the waveform interface 18 and an exemplary arrangement of waveform buffers provided in the RAM 12. The waveform interface 18, which controls both input (sampling) and output of waveform data to and from the tone synthesizing device, includes an analog-to-digital converter (ADC) 23 for sampling the waveform data, input from an external source via a microphone or the like, to covert the data into digital representation, a first DMAC (Direct Memory Access Controller) 24 for sampling the input waveform data, a sampling clock pulse generator 25 for generating sampling clock pulses Fs at a predetermined frequency, a second DMAC (Direct Memory Access Controller) 26 for controlling the waveform data output, and a digital-to-analog converter (DAC) 27 for converting the output waveform data into analog representation. Let's assume here that the second DMAC also functions to create absolute time information on the basis of the sampling clock pulses Fs and feed the thus-created absolute time information to the CPU bus 22.

As shown, the RAM 12 contains a plurality of waveform buffers W-BUF, each of which has a storage capacity (number of addresses) for cumulatively storing up to one frame of the waveform sample data. Assuming that the reproduction sampling frequency based on the sampling clock pulses Fs is 48 kHz and the time length of one frame is 10 msec and each of the waveform buffers W-BUF has a storage capacity for storing up to a total of 480 waveform sample data. At least two of the waveform buffers W-BUF (A and B) are used in such a way that when the one waveform buffer W-BUF is placed in a read mode for access by the second DMAC 26 of the waveform interface 18, the other waveform buffer W-BUF is placed in a write mode to write therein generated waveform data. According to the tone synthesis processing program employed in the embodiment, one frame of waveform sample data is generated collectively and accumulatively stored into the waveform buffer W-BUF placed in the write mode, for each of the tone synthesizing channels. More specifically, in a case where one frame is set to 480 samples, 480 waveform sample data are arithmetically generated in a collective manner for the first tone synthesizing channel and then stored into respective sample locations (address locations) in the waveform buffer W-BUF in the write mode, and then 480 waveform sample data are arithmetically generated in a collective manner for the second tone synthesizing channel and then added or accumulated into respective sample locations (address locations) in the same waveform buffer W-BUF. Similar operations are repeated for every other tone synthesizing channel. As a result, when the arithmetic generation of one frame of waveform sample data is completed for all of the tone synthesizing channels, each of the sample locations (address locations) of the waveform buffer W-BUF in the write mode has stored therein an accumulation of the corresponding waveform sample data of all of the tone synthesizing channels. For instance, one frame of the accumulated waveform sample data is first written into the "A" waveform buffer W-BUF, and then another frame of the accumulated waveform sample data is written into the "B" waveform buffer W-BUF. Once one frame of the accumulated waveform sample data has been completely written, the "A" waveform buffer W-BUF is switched to the read mode at the beginning of a next frame so that the accumulated waveform sample data are read out regularly therefrom at a predetermined sampling frequency based on the sampling clock pulses. Thus, whereas it basically suffices to use only two waveform buffers W-BUF (A and B) while switching the two buffers alternately between the read and write modes, three or more waveform buffers W-BUF (A, B, . . . ) may be used as shown if it is desired to reserve a storage space sufficient for writing several frames in advance.

The software programs for implementing the tone data making and tone synthesis processing of the invention under the control of the CPU 10 may be prestored in any of the ROM 11, RAM 12, hard disk device 13 and removable disk devices 14, 15. In an alternative, the tone synthesizing device may be connected to a communication network via the network interface 20 so that the software programs for implementing the tone data making and tone synthesis processing as well as the data of the data base DB are received and stored in any of the internal RAM 12, hard disk device 13 and removable disk devices 14, 15.

The CPU 10 executes the software programs for implementing the tone data making and tone synthesis processing which is prestored in, for example, the RAM 12, to synthesize tone waveform data corresponding to a particular style-of-rendition sequence and temporarily store the thus-synthesized tone waveform data in the waveform buffer W-BUF within the RAM 12. Then, under the control of the second DMAC 26, the waveform data in the waveform buffer W-BUF are read out and sent to the digital-to-analog converter (DAC) 27 for necessary D/A conversion. The D/A-converted tone waveform data are passed to a sound system (not shown), via which they are audibly reproduced or sounded.

The following description is based on the assumption that the style-of-rendition sequence (articulation element sequence AESEQ) data of the present invention are incorporated within automatic sequence data in the MIDI format as shown FIG. 8A. Although not having been detailed above in relation to FIG. 8A, the style-of-rendition sequence (articulation element sequence AESEQ) data may be incorporated as, for example, MIDI exclusive data in the MIDI format.

Figure 24:
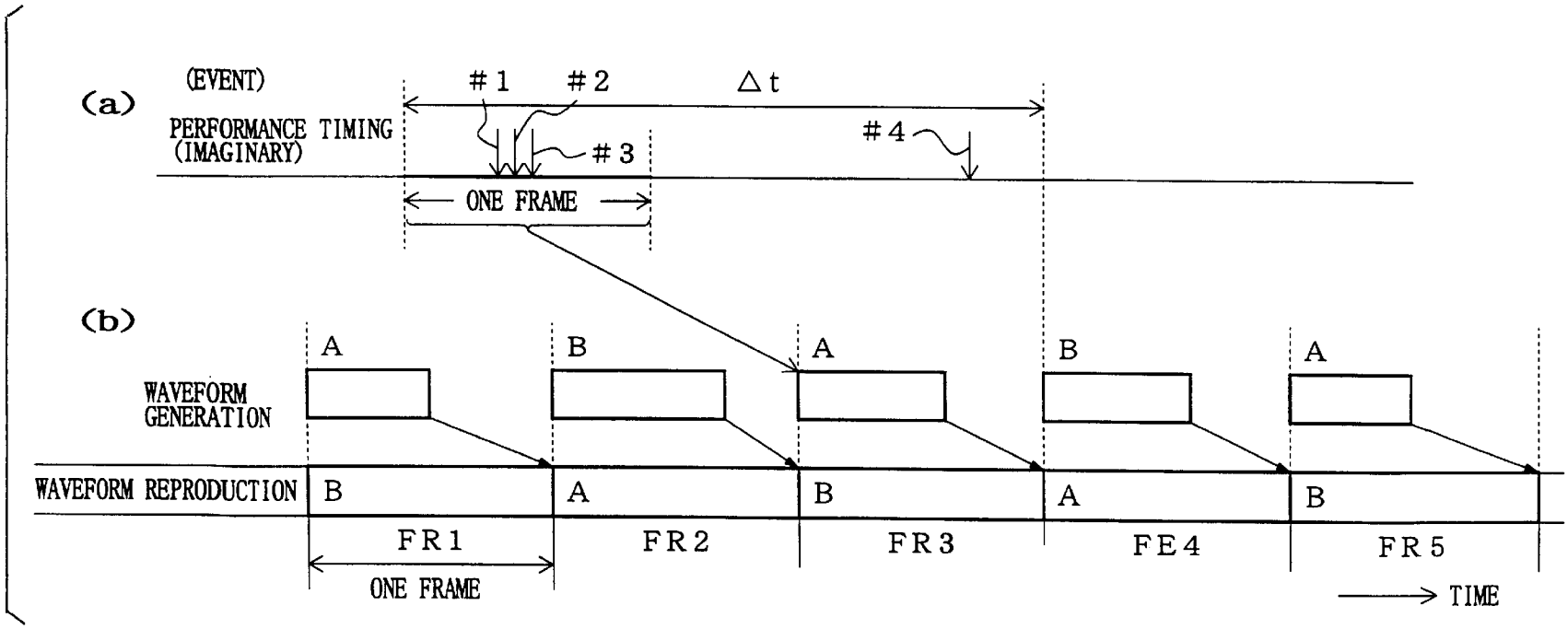
FIG. 24 is a time chart outlining an example of tone generation processing that is executed on the basis of MIDI performance data.

FIG. 24 is a time chart outlining tone generation processing that is executed by the software tone generator on the basis of the MIDI-format performance data. "Performance Timing" in section (a) of FIG. 24 indicates respective occurrent timing of various events #1 to #4 such as a MIDI note-on, note-off or other event ("EVENT (MIDI)" shown in FIG. 8A) and articulation element sequence event ("EVENT (AESEQ)" shown in FIG. 8A). In section (b) of FIG. 24, there is shown example relationship between timing for arithmetic operations to generate waveform sample data ("Waveform Generation") and timing for reproducing the generated waveform sample data ("Waveform Reproduction"). The upper "Waveform Generation" blocks in section (b) each indicates timing for executing a process where one frame of waveform sample data is generated collectively for one of the tone synthesizing channels and the thus-generated waveform sample data of the individual channels are added or accumulated into the respective sample locations (address locations) in one of the waveform buffers W-BUF that is placed in the write mode. The lower "Waveform Reproduction" blocks in section (b) each indicates timing for executing a process where the accumulated waveform sample data are read out, for the one-frame period, from the waveform buffer W-BUF regularly at a predetermined sampling frequency based on the sampling clock pulses. Reference characters "A" and "B" attached to the individual blocks in section (b) indicate on which of the waveform buffers W-BUF the waveform sample data are being written and read, i,e., which of the waveform buffers W-BUF are being in the write and read modes. "FR1", "FR2", "FR3", . . . represent unique numbers allocated to the individual frame periods. For example, a given frame of waveform sample data arithmetically generated in the frame period FR1 is written into the "A" waveform buffer W-BUF and read out therefrom in the next frame period FR2. After that, a next frame of waveform sample data is arithmetically generated and written into the "B" waveform buffer W-BUF in the frame period FR2, which is then read out from the "B" waveform buffer W-BUF in the following frame period FR3.

The events #1, #2 and #3 shown in section (a) of FIG. 24 all occur within a single frame period and arithmetic generation of waveform sample data corresponding to these events #1, #2 and #3 is initiated in the frame period FR3 shown in section (b), so that tones corresponding to the events #1, #2 and #3 are caused to rise (start sounding) in the frame period FR4 following the frame period FR3. Reference character "Δt" in section (a) represents a time difference or deviation between the predetermined occurrence timing of the events #1, #2 and #3 given as MIDI performance data and the sounding or tone-generation start timing of the tones corresponding thereto. Such a time difference or deviation would not influence auditive impression of listeners, since it is just as small as a time length of one to several frame periods. Note that the waveform sample data at the beginning of the tone generation are written at and after a predetermined intermediate or on-the-way location of the waveform buffer W-BUF then placed in the write mode, rather than at and after the very beginning of the buffer W-BUF.

Figure 29:
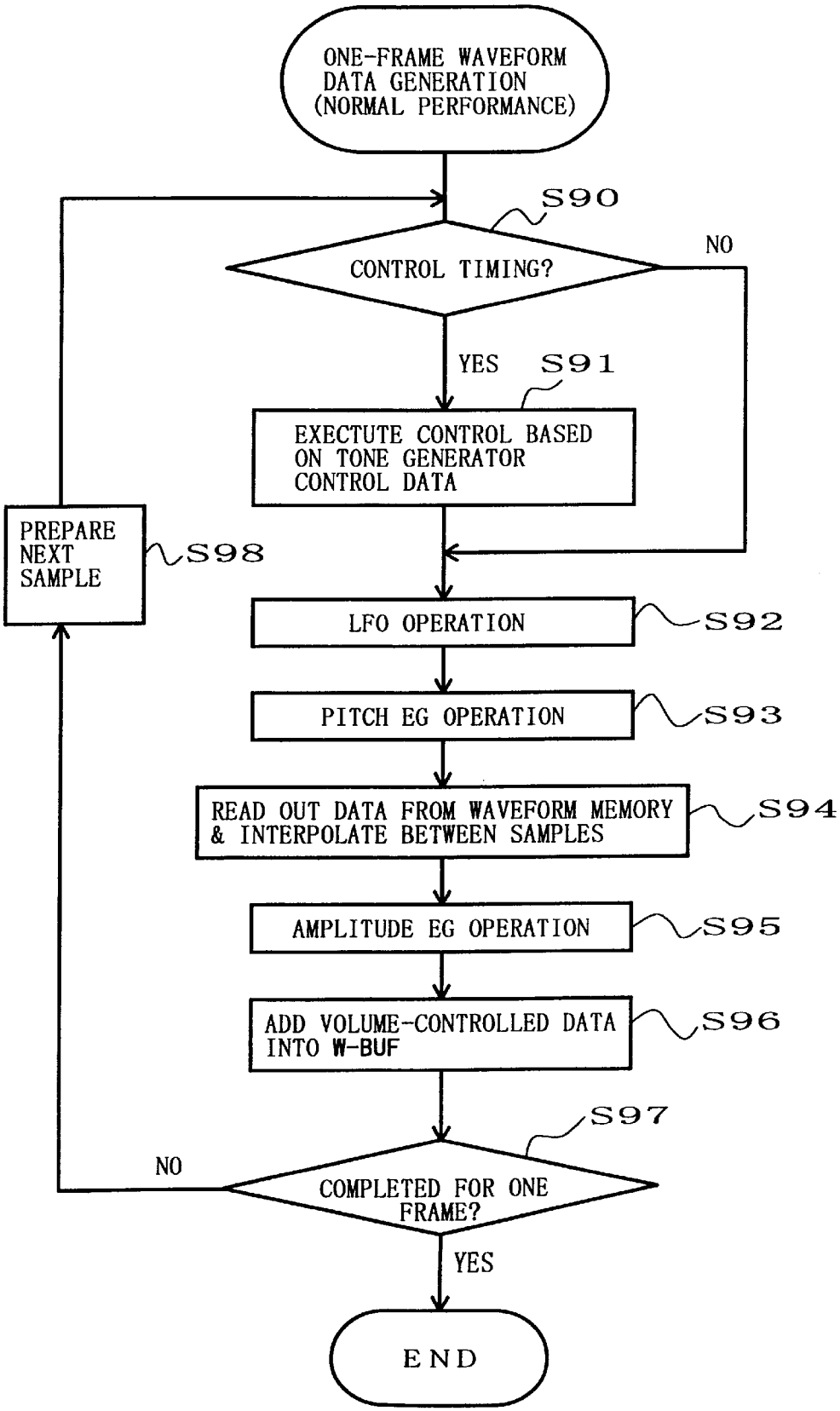
FIG. 29 is a flow chart showing an example of a one-frame waveform data generating operation for a normal performance shown in FIG. 28.
Figure 30:
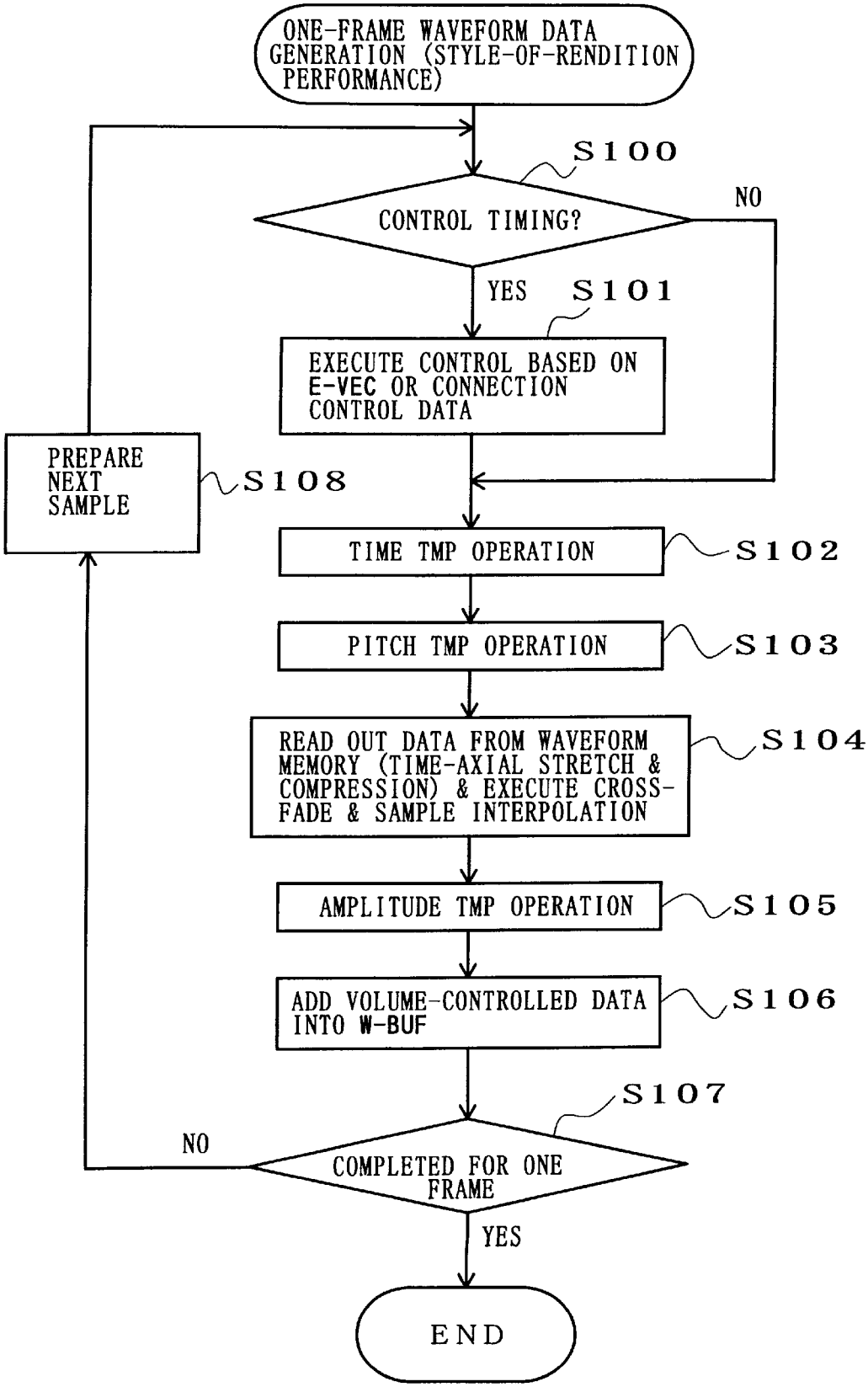
FIG. 30 is a flow chart showing an example of a one-frame waveform data generating process for a style-of-rendition performance shown in FIG. 28.

The manner of arithmetically generating the waveform sample data in the "Waveform Generation" stage is not the same for automatic performance tones based on normal MIDI note-on events (hereinafter referred to as "Normal Performance") and for performance tones based on on-events of an articulation element sequence AESEQ (hereinafter referred to as "Style-of-rendition Performance"). The "normal performance" based on normal MIDI note-on events and the "style-of-rendition performance" based on on-events of an articulation element sequence AESEQ are carried out through different processing routines as shown in FIGS. 29 and 30. For example, it will be very effective if an accompaniment part is performed by the "normal performance" based on normal MIDI note-on events and a particular solo part is performed by the "style-of-rendition performance" based on on-events of an articulation element sequence AESEQ.

Figure 25:
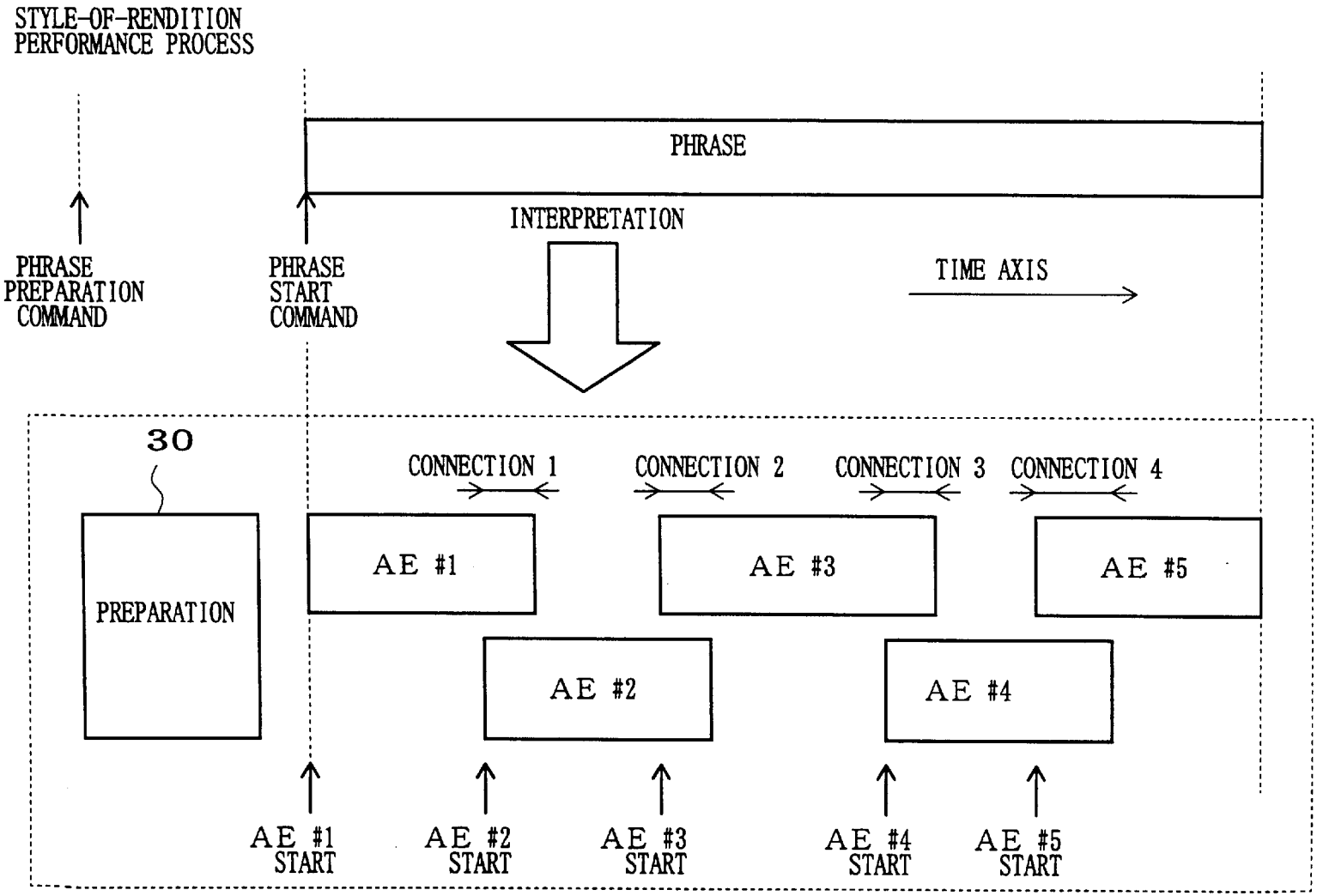
FIG. 25 is a time chart outlining an example of a style-of-rendition performance process (articulation element tone synthesis processing) that is executed on the basis of data of a style-of-rendition sequence (articulation element sequence) in accordance with the present invention.

FIG. 25 is a flow chart outlining the "style-of-rendition performance" processing based on data of a style-of-rendition sequence in accordance with the present invention (i.e., tone synthesis processing based on articulation elements). In FIG. 25, "Phrase Preparation Command" and "Phrase Status Command" are contained as "articulation element sequence event EVENT(AESEQ)" in the MIDI performance data as shown in FIG. 8A. Namely, event data in a single articulation element sequence AESEQ (denoted as a "Phrase" in FIG. 25) comprise the "phrase preparation command" and "phrase status command". The "phrase preparation command", preceding the "phrase status command", designates a particular articulation element sequence AESEQ (i.e., phrase) to be reproduced and instructs a preparation for reproduction of the designated sequence. This phrase preparation command is given a predetermined time before a predetermined sounding or tone-generation start point of the articulation element sequence AESEQ. In a "Preparation Operation" denoted at block 30, all necessary data for reproducing the designated articulation element sequence AESEQ are retrieved from the data base DB in response to the phrase preparation command and downloaded into a predetermined buffer area of the RAM 12, so that necessary preparations are made to promptly carry out the instructed reproduction of the sequence AESEQ. Also, this preparation operation interprets the designated articulation element sequence AESEQ, selects or sets rules for connecting adjoining articulation elements, and further generates necessary connection control data and the like. For example, if the designated articulation element sequence AESEQ comprises a total of five articulation elements AE#1 to AE#5, respective connecting rules are set for individual connecting regions (denoted as "Connection 1" to "Connection 4") therebetween and connection control data are generated for the individual connecting regions. Further, data indicative of respective start timing of the five articulation elements AE#1 to AE#5 are prepared in relative times from the beginning of the phrase.

The "phrase start command", succeeding the "phrase preparation command", instructs a start of sounding (tone generation) of the designated articulation element sequence AESEQ. The articulation elements AE#1 to AE#5 prepared in the above-mentioned preparation operation are sequentially reproduced in response to this phrase start command. Namely, once the start timing of each of the articulation elements AE#1 to AE#5 is arrived, reproduction of the articulation element is initiated and a predetermined connecting process is executed, in accordance with the pre-generated connection control data, to allow the reproduced articulation element to be smoothly connected to the preceding articulation element AE#1–AE#4 at the predetermined connecting region (Connection 1–Connection 4).

Figure 26:
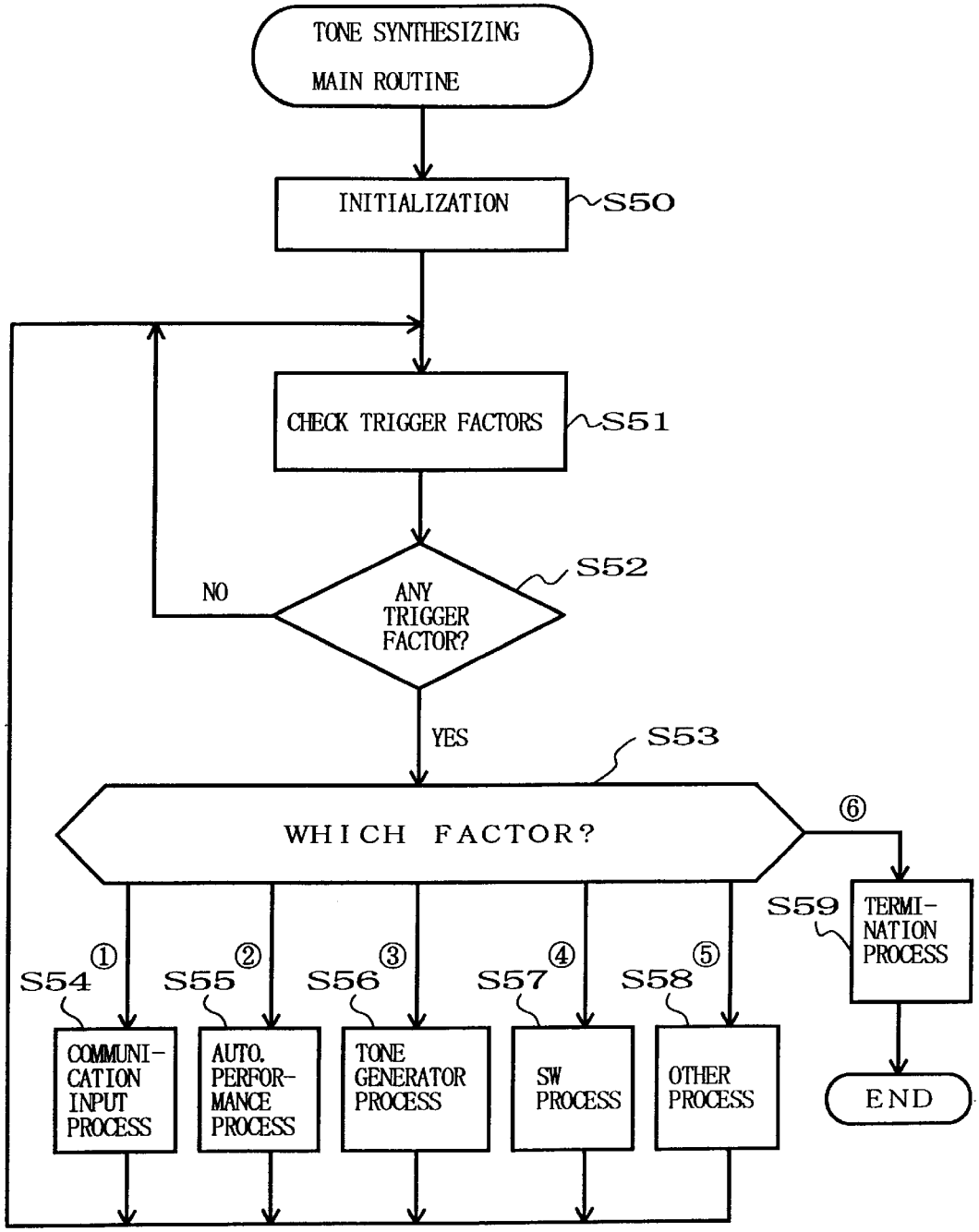
FIG. 26 is a flow chart showing a main routine of the tone synthesis processing that is executed by the CPU of FIG. 22.

FIG. 26 is a flow chart showing a main routine of the tone synthesis processing that is executed by the CPU 10 of FIG. 22. In an "Automatic Performance Process" within the main routine, various operations are carried out on the basis of events specified by automatic performance sequence data. First, at step S50, various necessary initialization operations are conducted, such as allocation of various buffer areas within the RAM 12. Next step S51 checks the following trigger factors.

Trigger Factor 1: Reception of MIDI performance data or other communication input data via the interface 20 or 21.

Trigger Factor 2: Arrival of automatic performance process timing, which regularly occurs to check an occurrence time of a next event during an automatic performance.

Trigger Factor 3: Arrival of waveform generation timing per frame, which occurs every frame period (e.g., at the end of every frame period) to generate waveform sample data collectively for each frame.

Trigger Factor 4: Execution of switch operation on the input device 17 such as the keyboard or mouse (excluding operation for instructing termination of the main routine).

Trigger Factor 5: Reception of an interrupt request from any of the disk drives 13 to 15 and display 16.

Trigger 6: Execution of operation, on the input device 17, for instructing termination of the main routine.

Figure 27:
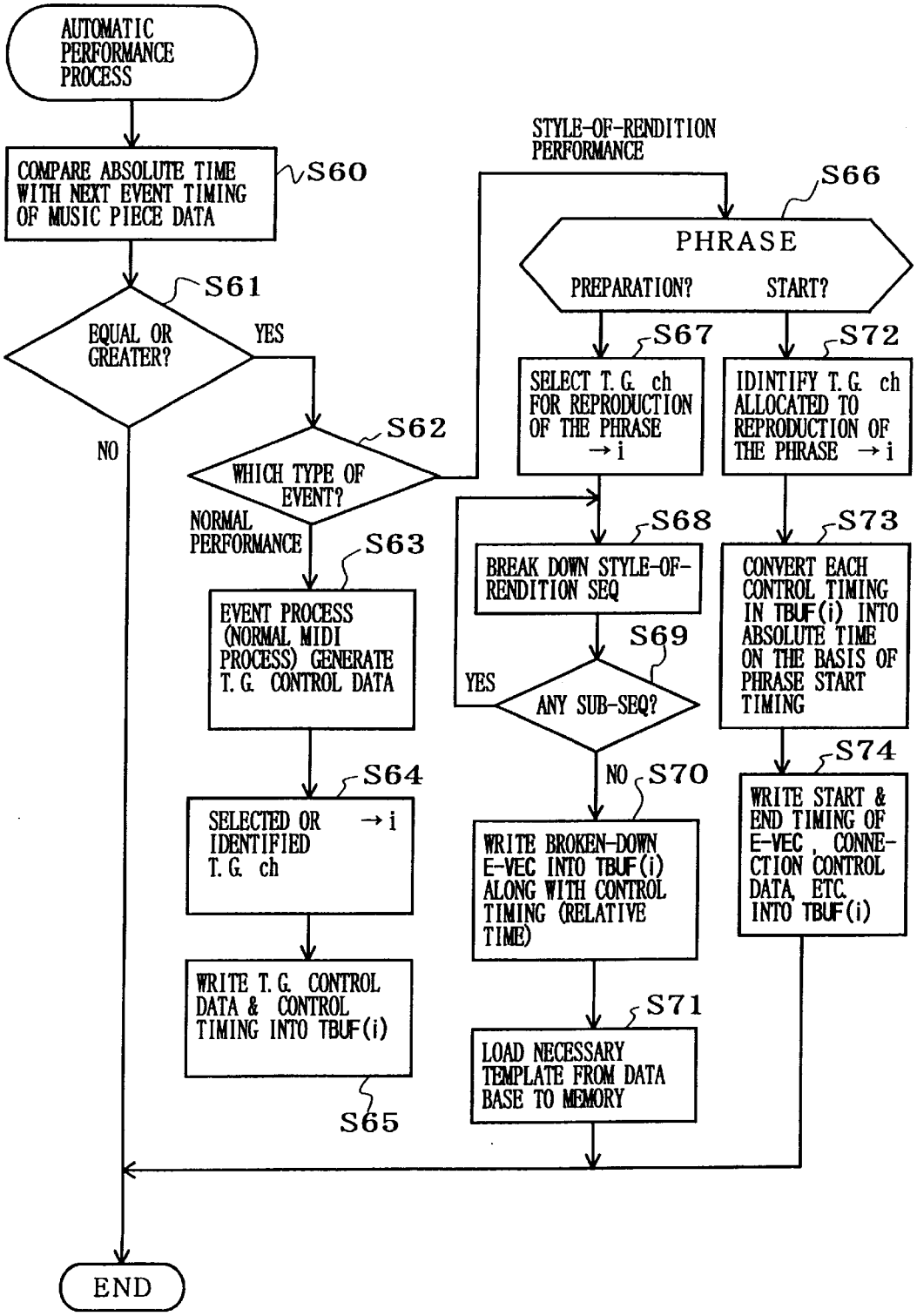
FIG. 27 is a flow chart showing an example of an automatic performance process shown in FIG. 26.
Figure 28:
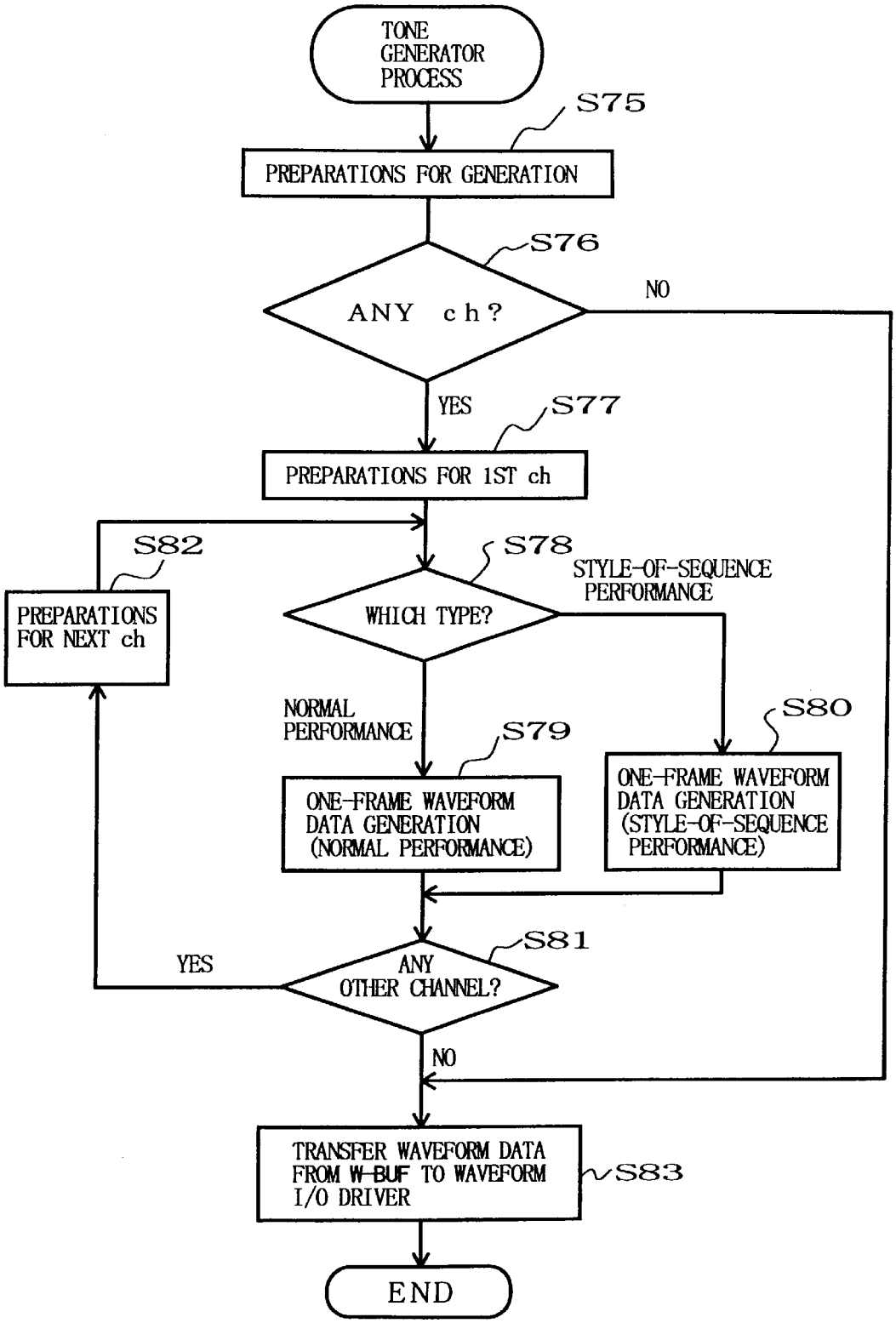
FIG. 28 is a flow chart showing an example of a tone generator process shown in FIG. 26.

At step S52, a determination is made as to whether any of the above-mentioned trigger factors has occurred. With a negative (NO) determination, the tone synthesizing main routine repeats the operations of steps S51 and S52 until an affirmative (YES) determination is made at step S52. Once an affirmative determination is made at step S52, it is further determined at next step S53 which of the trigger factors has occurred. If trigger factor 1 has occurred as determined at step S53, a predetermined "communication input process" is executed at step S54; if trigger factor 2 has occurred, a predetermined "automatic performance process" (one example of which is shown in FIG. 27) is executed at step S55; if trigger factor 3 has occurred, a predetermined "tone generator process" (one example of which is shown in FIG. 28) is executed at step S56; if trigger factor 4 has occurred, a predetermined "switch (SW) process" (i.e., a process corresponding to an operated switch) is executed at step S57; if trigger factor 5 has occurred, a predetermined "other process" is executed at step S58 in response to an interrupt request received; and if trigger factor 6 has occurred, a predetermined "termination process" is executed at step S59 to terminate this main routine.

Let's assume here that in case step S53 determines that two or more of trigger factors 1 to 6 have occurred simultaneously, these simultaneous trigger factors are dealt with in a predetermined priority order, such as the order of increasing trigger factor numbers (i.e., from trigger factor 1 to trigger factor 6). In such a case, some of the simultaneous trigger factors may be allotted a same priority. Steps S51 to S53 in FIG. 26 just illustratively show a task management in quasi multi-task processing. In practice, however, when one of the processes corresponding to any one of the trigger factors is being executed, the main routine may interruptively switch to another process in response to occurrence of another trigger factor having a higher priority; as an example, when trigger factor 2 occurs during execution of the tone generator process based on trigger factor 3, the main routine may interruptively switch to execution of the automatic performance process.

Now, a specific example of the automatic performance process at step S55 of FIG. 26 will be described in detail with reference to FIG. 27. At first step S60, an operation is carried out for comparing current absolute time information from the second DMAC (FIG. 23) with next event timing of music piece data in question. In the music piece data, i.e., automatic performance data, duration data DUR precedes every event data, as shown in FIG. 8. For example, as the duration data DUR is read out, the time values specified by the absolute time information and by the duration data DUR are added together to create new absolute time information indicative of an arrival time of a next event, and the thus-created absolute time information is stored into memory. Thus, step S60 compares the current absolute time information with that absolute time information indicative of the next event arrival time.

At following step S61, a determination is made as to whether the current absolute time has become equal to or greater than the next event arrival time. If the current absolute time has not yet reached the next event arrival time, the automatic performance process of FIG. 27 is terminated promptly. Once the current absolute time has reached the next event arrival time, the process goes to step S62 to ascertain whether the next event (which has now become the current event) is a normal performance event (i.e., normal MIDI event) or a style-of-rendition event (i.e., articulation element sequence event). If the current event is a normal performance event, the process proceeds to step S63, where a normal MIDI event process corresponding to the event is carried out to generate tone generator (T.G.) control data. Next step S64 selects or identifies a tone synthesizing channel (denoted as "T. G. ch" in the figure) relating to the event and stores its unique channel number in register i. For example, if the event is a note-on event, step S64 selects a particular tone synthesizing channel which is to be used for generation of the designated note and stores the selected channel in register i, and if the event is a note-off event, step S64 identifies a tone synthesizing channel which is being used for generation of the designated note and stores the identified channel in register i. At next step S65, the tone generator control data and control timing data generated at step S63 are stored in a tone buffer TBUF(i) corresponding to the channel number designated by register i. The control timing data indicates timing for executing control relating to the event, which is tone-generation start timing of the note-on event or release start timing of the note-off event. Because the tone waveform is generated via software processing in the embodiment, there would be caused a slight difference between the event occurrence timing of the MIDI data and actual processing timing corresponding thereto, so that this embodiment is arranged to instruct actual control timing, such as the tone-generation start timing, taking such a difference into account.

If the event is a style-of-rendition event as determined at step S62, the process branches to step S66, where a further determination is made as to whether the style-of-rendition event is a "phrase preparation command" or a "phrase start command" (see FIG. 25). If the style-of-rendition event is a phrase preparation command, the process carries out routines of steps S67 to S71 that correspond to the preparation operation denoted at block 30 in FIG. 25. First, step S67 selects a tone synthesizing channel (abbreviated "T.G. ch" in the figure) to be used for reproducing the phrase, i.e., articulation element sequence AESEQ, in question, and stores its unique channel number in register i. Next step S68 analyzes the style-of-rendition sequence (abbreviated "Style-of-Rendition SEQ" in the figure) of the phrase (i.e., articulation element sequence AESEQ). That is, the articulation element sequence AESEQ is analyzed after being broken down to the level of individual vector data to which separate templates are applicable, connecting rules are set which are to be applied to the individual connecting regions (connection 1 to connection 4) between the articulation elements (elements AE#1 to AE#5 of FIG. 25), and then connection control data are generated for the connection purposes. At following step S69, it is ascertained whether there is any sub-sequence ("Sub-SEQ" in the figure) attached to the articulation element sequence AESEQ. With an affirmative answer, the process reverts to step S68 in order to further break the sub-sequence down to the level of individual vector data to which separate templates are applicable.

Figure 32:
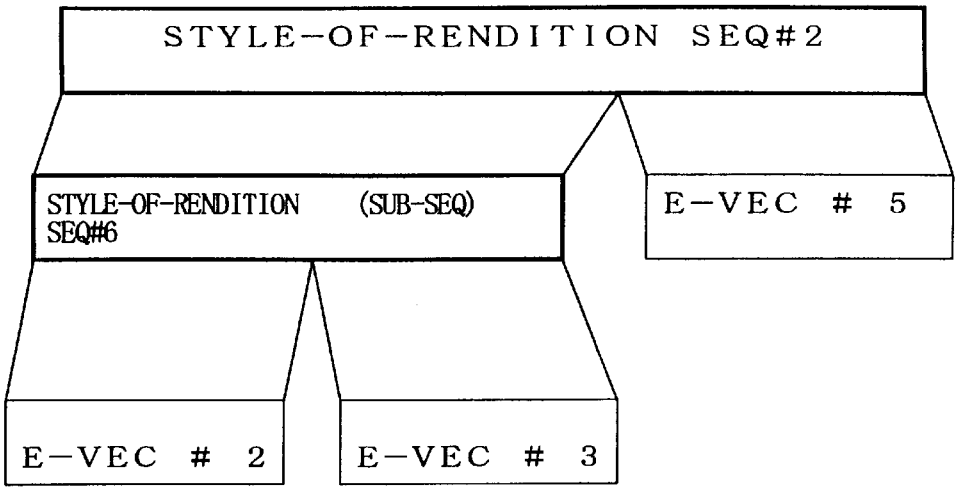
FIG. 32 is a diagram explanatory of a hierarchical organization of the style-of-rendition sequence.

FIG. 32 is a diagram showing a case where an articulation element sequence AESEQ includes a sub-sequence. As shown in FIG. 32, the articulation element sequence AESEQ may be of a hierarchical structure. Namely, if "style-of-rendition SEQ#2" is assumed to have been designated by data of the articulation element sequence AESEQ incorporated in MIDI performance information, the designated "style-of-rendition SEQ#2" can be identified by a combination of "style-of-rendition SEQ#6" and "element vector E-VEC#5". In this case, "style-of-rendition SEQ#6" is a sub-sequence. By analyzing this sub-sequence, "style-of-rendition SEQ#6" can be identified by a combination of "element vector E-VEC#2" and "element vector E-VEC#3". In this manner, "style-of-rendition SEQ#2" designated by the articulation element sequence AESEQ in the MIDI performance information is broken down and analytically determined as identifiable by a combination of element vectors E-VEC#2, E-VEC#3 and E-VEC#5. At the same time, the connection control data for connecting together the articulation elements are also generated if necessary, as previously stated. Note that the element vector E-VEC in the embodiment is a specific identifier of an articulation element. Of course, in some cases, such element vectors E-VEC#2, E-VEC#3 and E-VEC#5 may be arranged to be identifiable from the beginning via "style-of-rendition SEQ#2" designated by the articulation element sequence AESEQ in the MIDI performance information, rather than via the analyzation of the hierarchical structure as noted above.

Referring back to the flow chart of FIG. 27, step S70 stores the data of the individual element vectors (abbreviated "E-VEC" in the figure), along with data indicative of their control timing in absolute times, in a tone buffer TBUF(i) corresponding to the channel number designated by register i. In this instance, the control timing is start timing of the individual articulation elements as shown in FIG. 25. At next step S71, necessary template data are loaded from the data base DB down to the RAM 12, by reference to the tone buffer TBUF(i).

If the current event is a "phrase start command" (see FIG. 25), the process carries out routines of steps S72 to S74. Step S72 identifies a channel allocated to reproduction of the phrase performance and stores its unique channel number in register i. At following step S73, all the control timing data stored in the tone buffer TBUF(i) associated with the channel number designated by register i are converted into absolute time representation. Namely, each of the control timing data can be converted into absolute time representation, by setting as an initial value the absolute time information given from the DMAC 26 in response to occurrence of the current phrase start command and adding the thus-set initial value to the relative time value indicated by the control timing data. At next step S74, the current stored contents of the tone buffer TBUF(i) are rewritten in accordance with the absolute time values of the individual control timing. That is, step S74 stores in the tone buffer TBUF(i)

the start and end timing of the individual element vectors E-VEC constituting the style-of-rendition sequence, the connection control data to be used for connection between the element vectors, etc.

The following paragraphs describe a specific example of the "tone generator process" (step S56 of FIG. 26) with reference to FIG. 28, which is triggered every frame as previously noted. At first step S75, predetermined preparations are made to generate a waveform. For example, one of the waveform buffers W-BUF which has completed reproductive data readout in the last frame period is cleared, to enable data writing in that waveform buffer W-BUF in the current frame period. At next step S76, it is examined whether there is any channel (ch) for which tone generation operations are to be carried out. With a negative (NO) answer, the process jumps to step S83 since it is not necessary to continue the process. If there is one or more such channels (YES), the process moves to step S77 in order to specify one of the channels and make necessary preparations to effect a waveform sample data generating process for the specified channel. At next step S78, it is further ascertained whether the tone assigned to the specified channel is a "normal performance tone" or a "style-of-rendition performance". If the assigned tone is a normal performance tone, the process goes to step S79, where one frame of waveform sample data is generated for the specified channel as the normal performance tone. If, on the other hand, the assigned tone is a style-of-rendition performance, the process goes to step S80, where one frame of waveform sample data is generated for the specified channel as the style-of-rendition performance tone.

At next step S81, it is further ascertained whether there is any other channel for which the tone generation operations are to be carried out. With an affirmative answer, the process goes to step S82 to identify one of the channels to deal with next and make necessary preparations to effect a waveform sample data generating process for the identified channel. Then, the process reverts to step S78 in order to repeat the above-described operations of steps S78 to S80. When the above-described operations of steps S78 to S80 have been completed for all of the channels for which the tone generation operations are to be carried out, a negative determination is made at step S81, so that the process moves on to step S83. By this time, one frame of waveform sample data has been completely generated for all of the channels assigned to tone generation and accumulated in the waveform buffer W-BUF on the sample-by-sample basis. At step S83, the currently stored data in the waveform buffer W-BUF are transferred to and placed under the control of a waveform input/output (I/O) driver. Thus, in the next frame period, the waveform buffer W-BUF is placed in the read mode for access by the second DMAC 26 so that the waveform sample data are reproductively read out at a regular sampling frequency in accordance with the predetermined sampling clock pulses Fs.

Specific example of the operation of step S79 is shown in FIG. 29. Namely, FIG. 29 is a flow chart showing a detailed example of the "One-frame Waveform Data Generating Process" for the "normal performance", where normal tone synthesis based on MIDI performance data is executed. In this one-frame waveform data generating process, one waveform sample data is generated every execution of looped operations of steps S90 to S98. Thus, address pointer management is performed to indicate a specific place, in the frame, of each sample being currently processed, although not described in detail here. First, step S90 checks whether predetermined control timing has arrived or not; this control timing is the one instructed at step S65 of FIG. 27 such as tone-generation start timing or release start timing. If there is any control timing to deal with in relation to the current frame, an affirmative (YES) determination is made at step S90 due to an address pointer value corresponding to the control timing. In response to the affirmative determination at step S90, the process goes to step S91 in order to execute an operation to initiate necessary waveform generation based on tone generator control data. In case the current address pointer value has not reached the control timing, the process jumps over step S91 to step S92, where an operation is executed to generate a low-frequency signal ("LFO Operation") necessary for vibrato etc. At following step S93, an operation is executed to generate a pitch-controlling envelope signal ("Pitch EG Operation").

Then, at step S94, waveform sample data of a predetermined tone color are read out, on the basis of the above-mentioned tone generator control data, from a normal-performance-tone waveform memory (not shown) at a rate corresponding to a designated tone pitch, and interpolation is carried out between the read-out waveform sample data values (inter-sample interpolation). For these purposes, there may be employed the conventionally-known waveform memory reading technique and inter-sample interpolation technique. The tone pitch designated here is given by variably controlling a normal pitch of a note relating to the note-on event in accordance with the vibrato signal and pitch control envelope value generated at preceding steps S92 and S93. At next step S95, an operation is executed to generate an amplitude envelope ("Amplitude EG Operation"). Then, at step S96, the tone volume level of one waveform sample data generated at step S94 is variably controlled by the amplitude envelope value generated at step S95 and then the volume-controlled data is added to the waveform sample data already stored at the address location of the waveform buffer W-BUF pointed to by the current address pointer. Namely, the waveform sample data is accumulatively added to the corresponding waveform sample data of the other channel at the same sample point. Thereafter, at step S97, it is ascertained whether the above-mentioned operations have been completed for one frame. If the operations have not been completed for one frame, the process goes to step S98 to prepare a next sample (advance the address pointer to a next address).

With the above-described arrangement, when tone generation is to be started at some point on the way through a frame period, the waveform sample data will be stored at and after an intermediate or on-the-way address of the waveform buffer W-BUF corresponding to the tone generation start point. Of course, when tone generation is to continue throughout an entire frame period, the waveform sample data will be stored at all the addresses of the waveform buffer W-BUF.

It will be appreciated that the envelope generating operations at steps S93 and S95 may be effected by reading data from an envelope waveform memory or by evaluating a predetermined envelope function. In the latter case, a well-known first-order broken-line function of relatively simple form may be evaluated as the envelope function. Unlike the "style-of-sequence performance" to be detailed below, this "normal performance" does not require complex operations, such as replacement of a waveform being sounded, replacement of an envelope or time-axial stretch or compression control of a waveform.

Specific example of the operation of step S80 in FIG. 28 is shown in FIG. 30. Namely, FIG. 30 is a flow chart showing an example of the "One-frame Waveform Data Generating Process" for the "style-of-rendition performance", where tone synthesis based on articulation (style-of-rendition) sequence data is executed. In this one-frame waveform data generating process of FIG. 30, there are also executed various other operations, such as an articulation element tone waveform operation based on various template data and an operation for interconnecting element waveforms, in the manner stated above. In this one frame waveform data generating process as well, one waveform sample data is generated every execution of looped operations of steps S100 to S108. Thus, address pointer management is performed to indicate a specific place, in the frame, of a sample being currently processed, although not described in detail here. Further, this process carries out cross-fade synthesis between two different template data (including waveform template data) for a smooth connection between adjoining articulation elements, or cross-fade synthesis between two different waveform sample data for time-axial stretch or compression control; thus, with respect to each sample, various data processing operations are performed on two different data for the cross-fade synthesis purposes.

First, step S100 checks whether predetermined control timing has arrived or not; this control timing is the one written at step S74 of FIG. 27 such as start timing of the individual articulation elements AE#1 to AE#5 or start timing of the connecting process. If there is any control timing to deal with in relation to the current frame, an affirmative (YES) determination is made at step S100 due to an address pointer value corresponding to the control timing. In response to the affirmative determination at step S100, the process goes to step S101 in order to execute necessary control based on element vector E-VEC or connection control data corresponding to the control timing. In case the current address pointer value has not reached at the control timing, the process jumps over step S101 to step S102.

At step S102, an operation is carried out to generate a time template (abbreviated "TMP" in the figure) of a particular articulation element designated by the element vector E-VEC; this template is the time (TSC) template shown in FIG. 3. This embodiment assumes that the time (TSC) template is given as time-varying envelope data in the same manner as the amplitude template and pitch template. Thus, this step S102 generates an envelope of the time template.

At next step S103, an operation is carried out to generate a pitch (Pitch) template of the particular articulation element designated by the element vector E-VEC. The pitch template is also given as time-varying envelope data as exemplarily shown in FIG. 3.

At step S105, an operation is carried out to generate an amplitude (Amp) template of the particular articulation element designated by the element vector E-VEC. The amplitude template is also given as time-varying envelope data as exemplarily shown in FIG. 3.

Each of the envelope generating operations at steps S102, S103 and S105 may be executed in the manner as described above, i.e., by reading data from an envelope waveform memory or by evaluating a predetermined envelope function. In the latter case, a well-known first-order broken-line function of relatively simple form may be evaluated as the envelope function. Further, at these S102, S103 and S105, there are also carried out other operations, such as operations for forming two different templates (i.e., templates of a pair of preceding and succeeding elements) for each predetermined element connecting region and connecting together the two templates by cross-fade synthesis in accordance with the connection control data and an offset operation. Which of the connecting rules should be followed in the connecting process depends on the corresponding connection control data.

At step S104, an operation is executed basically to read out data of a waveform (Timbre) template, for the particular element designated by the particular articulation element designated by the element vector E-VEC, at a rate corresponding to a designated tone pitch. The tone pitch designated here is variably controlled by, for example, the pitch template (pitch-controlling envelope vale) generated at preceding step S103. At this step S104, TSC control is also carried out which controls the total length of the waveform sample data to be stretched or compressed along the time axis, independently of the tone pitch, in accordance with the time (TSC) template. Further, to prevent the waveform continuity from being lost due to the time-axial stretch or compression control, this step S104 executes an operation for reading out two different groups of waveform sample data (corresponding to different time points within the same waveform template and performing cross-fade synthesis between the read-out waveform sample data. This step S104 also executes an operation for reading out two different waveform templates (i.e., waveform templates of a pair of preceding and succeeding articulation elements) and performing cross-fade synthesis between the read-out waveform templates, for each of the predetermined element connecting regions. In addition, this step S104 further executes an operation for reading out waveform templates repetitively in the looped fashion and an operation for performing cross-fade synthesis between two templates while they are being read out.

In the event that the waveform (Timbre) template to be used retains a timewise pitch variation component of the original waveform, values of the pitch template may be given in differences or ratios relative to the original pitch variation. Thus, when the original timewise pitch variation is to be left unchanged, the pitch template is maintained at a constant value (e.g., "1").

At next step S105, an operation is executed to generate an amplitude template. Then, at step S106, the tone volume level of one waveform sample data generated at step S104 is variably controlled by the amplitude envelope value generated at step S105 and then added to the waveform sample data already stored at the address location of the waveform buffer W-BUF pointed to by the current address pointer. Namely, the waveform sample data is accumulatively added to the corresponding waveform sample data of the other channel at the same sample point. Thereafter, at step S107, it is ascertained whether the above-mentioned operations have been completed for one frame. If the operations have not been completed for one frame, the process goes to step S108 to prepare a next sample (advance the address pointer to a next address).

Similarly to the above, in the event that the waveform (Timbre) template to be used retains a timewise amplitude variation component of the original waveform, values of the amplitude (Amp) template may be given in differences or ratio relative to the original amplitude variation. Thus, when the original amplitude variation over time is to be left unchanged, the amplitude template is maintained at a constant value (e.g., "1").

Now, a description will be given about an example of the time-axial stretch/compression control employed in the embodiment.

Using the time-axial stretch/compression (TSC) control proposed by the assignee of the present application in a copending patent application (e.g., Japanese Patent Application No. HEI-9-130394), the time-axial length of waveform data of plural waveform cycles, having high-quality, i.e., articulation characteristics and a given data quantity (given number of samples or addresses), can be variably controlled as desired independently of a reproduction pitch of the corresponding tone and without sacrificing the general characteristics of the waveform. Briefly speaking, the proposed TSC control is intended to stretch or compress the time-axial length of a plural-cycle waveform having a given data quantity while maintaining a predetermined reproduction sampling frequency and reproduction pitch; specifically, to compress the time-axial length, the TSC control causes an appropriate part of the waveform data to be read out in a sporadic fashion, while to stretch the time-axial length, it causes an appropriate part of the waveform data to be read out in a repetitive or looped fashion. Also, the proposed TSC control carries out cross-fade synthesis, in order to prevent undesired discontinuity of the waveform data that would result from the sporadic or repetitive partial readout of the data.

Figure 31:
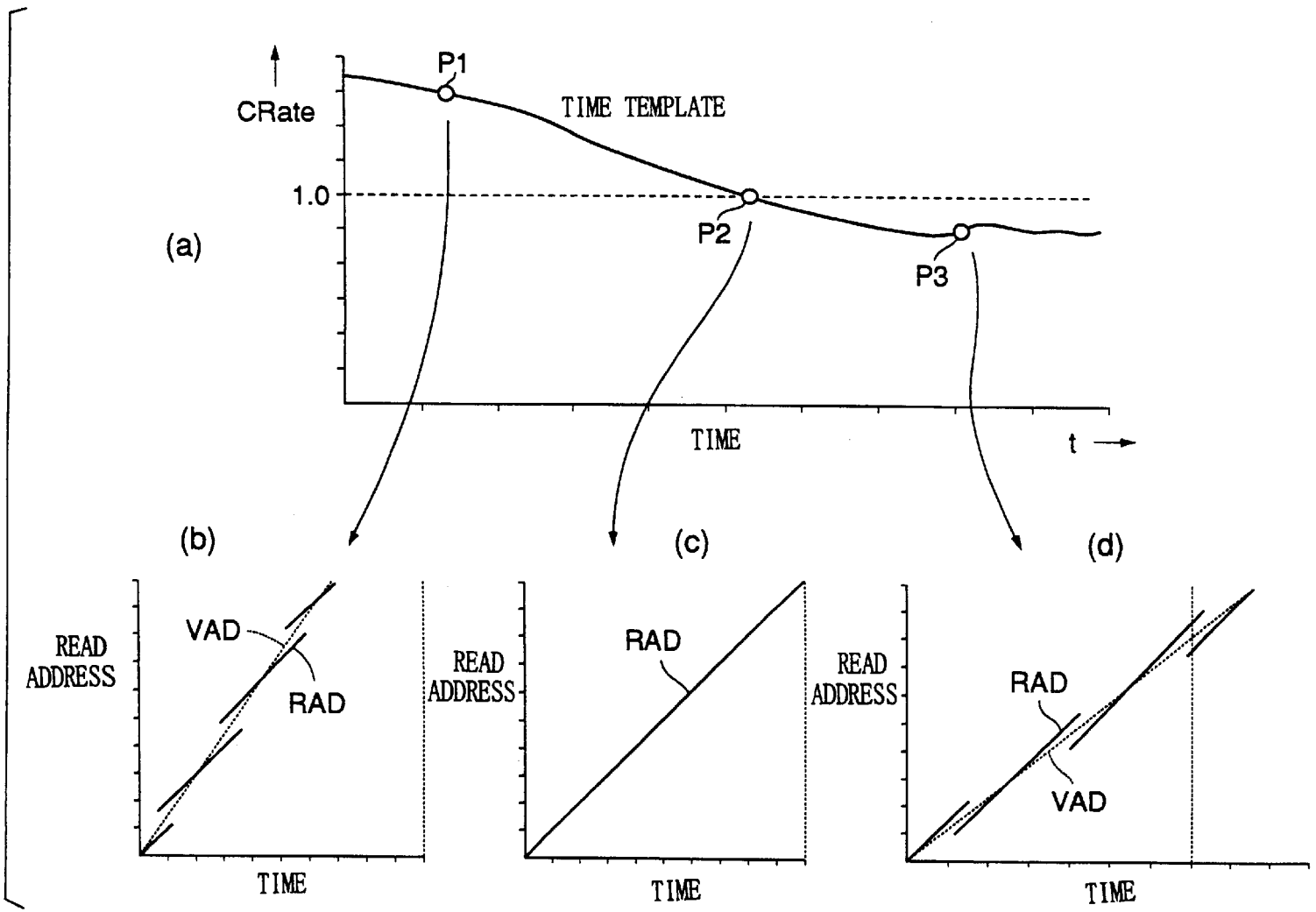
FIG. 31 is a conceptual diagram outlining time-axial stretch/compression (TSC) control employed in the present invention.

FIG. 31 is a conceptual diagram outlining the principle of such a time-axial stretch/compression (TSC) control. Specifically, Section (a) of FIG. 31 shows an example of a time-varying time template, which comprises data indicative of a time-axial stretch/compression ratio (CRate). In section (a), the vertical axis represents the time-axial stretch/compression ratio CRate while the horizontal axis represents the time axis t. The stretch/compression ratio CRate is based on a reference value of "1"; specifically, when the ratio CRate is "1", it indicates that no time-axial stretch/compression is to take place, when the ratio CRate is greater than the reference value "1", it indicates that the time axis is to be compressed, and when the ratio CRate is smaller than the reference value "1", it indicates that the time axis is to be stretched. Sections (b) to (d) of FIG. 31 show examples where the time-axial stretch/compression is carried out in accordance with the stretch/compression ratio CRate using virtual read address VAD and actual read address RAD, in each of which the solid line represents an advance path of the actual read address RAD and the dotted line represents an advance path of the virtual read address VAD. More specifically, section (b) of FIG. 31 shows an example where the time-axial compression control is performed as dictated by a time-axial stretch/compression ratio CRate at point P1 of the time template shown in section (a) (CRate>1), section (c) of FIG. 31 shows another example where no time-axial stretch/compression control is performed as dictated by a time-axial stretch/compression ratio CRate at point P2 of the time template (CRate=1), and section (d) of FIG. 31 shows still another example where the time-axial stretch control is performed as dictated by a time-axial stretch/compression ratio CRate at point P3 of the time template (CRate1<1). In section (c), the solid line represents a basic address advance path corresponding to designated pitch information, where the advance path of the actual read address RAD and virtual read address VAD coincide with each other.

The actual read address RAD is used to actually read out waveform sample data from the waveform template and varies at a constant rate corresponding to the information of designated desired pitch. For example, by regularly accumulating a frequency number corresponding to the desired pitch, there can be obtained actual read addresses RAD having a given inclination or advancing slope based on the desired pitch. The virtual read address VAD is an address indicating a specific location of the waveform template from which waveform sample data is to be currently read out in order to achieve desired time-axial stretch or compression. To this end, address data are calculated which vary with an advancing slope obtained by modifying the slope, based on the desired pitch, with the time-axial stretch/compression ratio CRate, and the thus-calculated address data are generated as the virtual read addresses VAD. A comparison is constantly made between the actual read address RAD and the virtual read addresses VAD, so that whenever a difference or deviation between the addresses RAD and VAD exceeds a predetermined value, an instruction is given to shift the value of the actual read address RAD. In accordance with such an instruction, control is performed to shift the value of the actual read address RAD by such a number of addresses as to eliminate the difference of the actual read address RAD from the virtual read addresses VAD.

Figure 33:
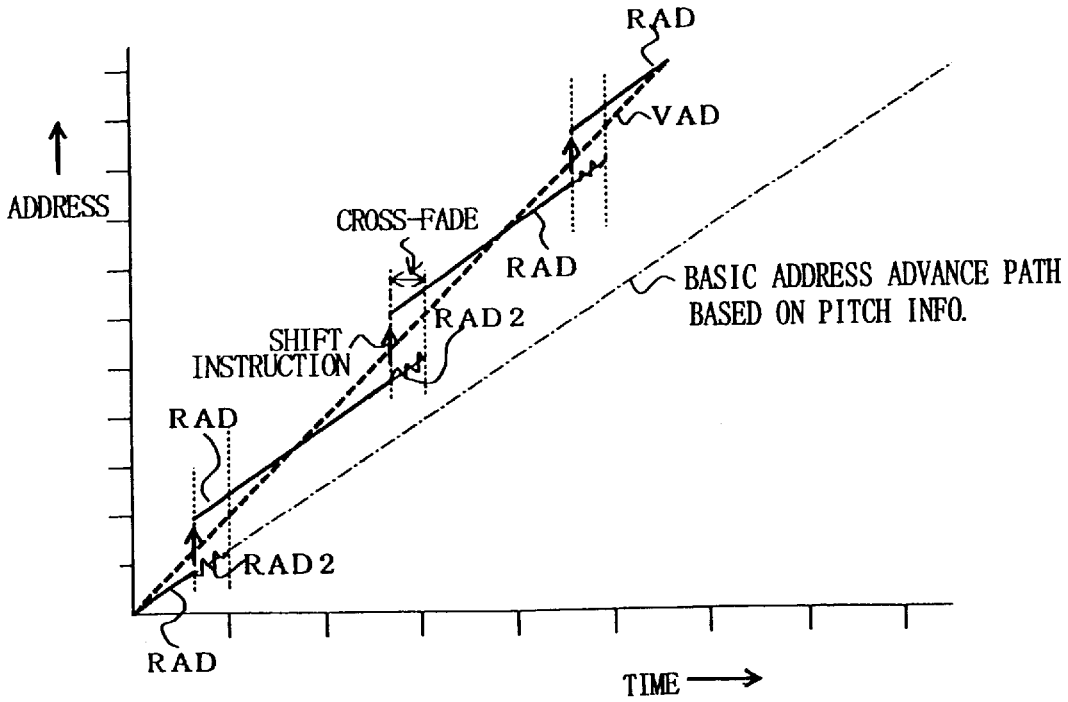
FIG. 33 is a diagram showing an exemplary manner in which addresses are advanced over time to read out a stored waveform during the time-axial compression control.

FIG. 33 is a diagram showing, on an increased scale, an example of the time-axial compression control similar to the example in section (b) of FIG. 31, where the dot-and-dash line represents an example of a basic address advance path based on pitch information, and corresponds to the solid line in section (c) of FIG. 31. The heavy broken in FIG. 33 line represents an exemplary advance path of the virtual read address VAD. If the stretch/compression ratio data CRate is of value "1", the advance of the virtual read address VAD coincides with the basic address advance represented by the dot-and-dash line and no time-axis variation occurs. If the time axis is to be compressed, the stretch/compression ratio data CRate takes an appropriate value equal to or greater than "1" so that the advancing slope of the virtual read address VAD becomes relatively great or steep as shown. The heavy solid line in FIG. 33 represents an example of an advance path of the actual read addresses RAD. The advancing slope of the actual read address RAD coincides with the basic address advance represented by the dot-and-dash line. In this case, because the advancing slope of the virtual read address VAD is relatively great, the advance of the actual read address RAD becomes slower and slower than that of the virtual read addresses VAD as the time passes. Once the difference or deviation of the actual read address RAD from the virtual read address VAD has exceeded a predetermined value, a shift instruction is given (as designated by an arrow), so that the actual read address RAD is shifted by an appropriate amount in such a direction to eliminate the difference. This way, the advance of the actual read addresses RAD is varied in line with that of the virtual read addresses VAD while maintaining the advancing slope as dictated by the pitch information, and presents characteristics having been compressed in the time-axis direction. Thus, by reading out the waveform data from the waveform template in accordance with such actual read addresses RAD, it is possible to obtain a waveform signal, indicative of a waveform compressed in the time-axis direction, without varying the pitch of the tone to be reproduced.

Figure 34:
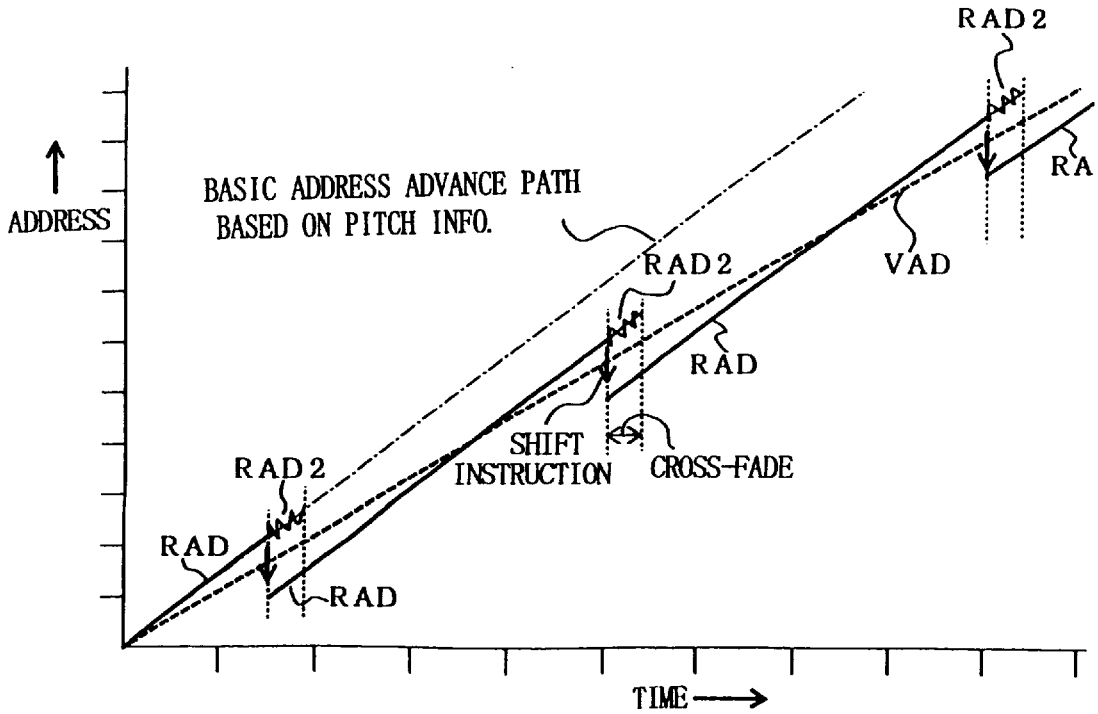
FIG. 34 is a diagram showing an exemplary manner in which addresses are advanced over time to read out a stored waveform during the time-axial stretch control.

Further, FIG. 34 is a diagram showing, on an increased scale, an example of the time-axial stretch control similar to the example in section (d) of FIG. 31, where the advancing slope of the virtual read addresses VAD represented by the heavy solid line is relatively small. Thus, the advance of the actual read addresses RAD becomes faster and faster than that of the virtual read addresses VAD as the time passes. Once the difference of the actual read address RAD from the virtual read address VAD has exceeded a predetermined value, a shift instruction is given (as designated by an arrow), so that the actual read address RAD is shifted by an appropriate amount in such a direction to eliminate the difference. This way, the advance of the actual read addresses RAD is varied in line with that of the virtual read addresses VAD while maintaining the advancing slope as dictated by the pitch information, and presents characteristics having been stretched in the time-axis direction. Thus, by reading out the waveform data from the waveform template in accordance with such actual read addresses RAD, it is possible to obtain a waveform signal, indicative of a waveform stretched in the time-axis direction, without varying the pitch of the tone to be reproduced.

Preferably, the shift of the actual read address RAD in the direction to eliminate its difference from the virtual read address VAD is carried out in such a manner that a smooth interconnection is achieved between the waveform data having been read out immediately before the shifting and the waveform data to be read out immediately after the shift. It is also preferable to carry out cross-fade synthesis at an appropriate period during the shifting, as denoted by ripple-shape lines. Each of the ripple-shape lines represents an advance path of actual read addresses RAD2 in a subsidiary cross-fading channel. As shown, in response to the shift instruction, the actual read addresses RAD2 in the subsidiary cross-fading channel are generated along an extension of the advance path of the unshifted actual read addresses RAD at a same rate (advancing slope) as the actual read addresses RAD. In a suitable cross-fade period, cross-fade synthesis is carried out in such a manner that a smooth waveform transfer is achieved from a waveform read out in accordance with the actual read addresses RAD2 in the subsidiary cross-fading channel, to another waveform data W1 read out in accordance with the actual read addresses RAD in a primary cross-fading channel. In this case, it is only necessary that the actual read addresses RAD2 in the subsidiary cross-fading channel be generated for a given cross-fade period.

Note that the TSC control employed in the present invention is not limited to the above-mentioned example where the cross-fade synthesis is carried out only for selected periods and it may of course employ another form of the TSC control where the cross-fade synthesis is constantly effected in accordance with the value of the stretch/compression ratio data CRate.

In the case where waveform sample data are generated by repetitively reading out a waveform template of a partial vector PVQ (i.e., looped waveform) as shown in FIGS. 13 to 15, the time length of the whole repetitively-read-out waveform can be variably controlled independently of a tone reproduction pitch relatively easily, basically by varying the number of the looped readout operation. Namely, a cross-fade period length (time length or number of the looped readout or "looping") is determined, as a particular cross-fade curve is designated by data indicating such a length. At that time, the cross-fade speed or rate can be variably controlled by variably controlling the inclination of the cross-fade curve in accordance with a time-axial stretch/compression ratio specified by a time template, and hence the cross-fade period length can be variably controlled. Because the tone reproduction pitch is not influenced during the cross-fade synthesis, the variable control of the number of the looping will ultimately result in variable control of the cross-fade period length.

Note that in the case where the time-axial length of reproduced waveform data is to be stretched or compressed by the time axial stretch/compression control, it is desirable that the time length of the pitch and amplitude templates be also subjected to the stretch/compression control. Thus, let it be assumed that steps S103 and S105 of FIG. 30 are arranged to control the time length of the pitch and amplitude templates, generated at these steps, to be stretched or compressed in accordance with the time template generated at step S102.

Further, the tone synthesizing functions may be performed by a hybrid tone generator comprising a combination of software and hardware tone generators, in stead of all the functions being performed by the software tone generator alone. Alternatively, the tone synthesis processing of the present invention may be carried out by the hardware tone generator device alone, or by use of a DSP (Digital Signal Processor).

The present invention arranged in the above-described manner permits free tone synthesis and editing reflective of various styles of rendition (articulations). Thus, in generating tones using an electronic musical instrument or other electronic device, the invention greatly facilitates realistic reproduction of the articulations (styles of rendition) and control of such reproduction, and achieves an interactive high-quality-tone making technique which permits free sound making and editing operations by a user.

What is claimed is:

1. A tone data making method comprising the steps of:

sampling a performance of a single or a plurality of tones;

dividing the performance, sampled by said step of sampling, into a plurality of time sections of variable lengths in accordance with characteristics of performance expression therein, to extract waveform data of each of the time sections as an articulation element;

analyzing the waveform data of each of the articulation elements, extracted by said step of-dividing, in terms of a plurality of predetermined tonal factors and generating tonal characteristic data indicative of respective characteristics of the tonal factors in the articulation element; and storing in a data base the tonal characteristic data corresponding to the extracted articulation elements.

2. A tone data making method as recited in claim 1 wherein said step of storing stores the tonal characteristic data in the data base and attaches, to each of the tonal characteristic data to be stored, attribute information representative of a characteristic of the performance expression in one of the articulation elements corresponding thereto.

3. A tone data making method as recited in claim 1 wherein the tonal characteristic data generated by said step of analyzing the waveform data include at least one of timbre data, time-dependent tone volume variation data, pitch variation data and time axis control data in one of the time sections corresponding thereto.

4. A tone data making method as recited in claim 1 wherein said step of analyzing the waveform data includes a step of extracting, from among the tonal factor characteristic data, partial data about a predetermined part of the corresponding time section, and wherein said step of storing stores the extracted partial data in the data base as the tonal factor characteristic data for the corresponding time section.

5. A tone data making method as recited in claim 1 which further comprises the steps of:

designating a tone performance to be executed, by a time-serial combination of a plurality of the articulation elements;

reading out, from said data base, the tonal factor characteristic data corresponding to the articulation elements designated by said step of designating;

synthesizing waveform data corresponding to the designated articulation elements, on the basis of each of the tonal factor characteristic data read out from said data base; and sequentially connecting together the waveform data, synthesized for individual ones of the designated articulation elements, to thereby generate a succession of performance tones comprising the time-serial combination of the articulation elements.

6. A tone data making method comprising the steps of:

sampling a tone having one or more types of articulation;

dividing the tone, sampled by said step of sampling, into a plurality of time sections of variable lengths in accordance with characteristics of the one or more types of articulation, to extract waveform data of each of the time sections as an articulation element;

analyzing the waveform data of each of the articulation elements, extracted by said step of dividing, in terms of a plurality of predetermined tonal factors and generating tonal factor characteristic data indicative of respective characteristics of the tonal factors in the articulation element; and storing in a data base the tonal factor characteristic data corresponding to the extracted articulation elements.

7. A tone synthesizing device comprising:

a storage section that stores therein tonal factor characteristic data relating to predetermined tonal factors of partial tone waveforms corresponding to various articulation elements;

a designating section that designates a tone performance to be executed, by a time-serial combination of a plurality of the articulation elements;

a readout section that reads out, from said storage section, tonal factor characteristic data, indicative of respective characteristics of the tonal factors, corresponding to the articulation elements designated by said designating section;

a synthesizing section that synthesizes partial waveform data corresponding to the designated articulation elements, on the basis of each of the tonal factor characteristic data read out from said storage section; and a section that sequentially connects together the partial waveform data, synthesized for individual ones of the designated articulation elements, to thereby generate a succession of performance tones comprising the time-serial combination of the articulation elements.

8. A machine-readable recording medium containing a group of instructions of a program to be executed by a computer for synthesizing tone waveform data by accessing a data base storing therein tonal factor characteristic data relating to predetermined tonal factors of partial tone waveforms corresponding to various articulation elements, said program comprising the steps of:

designating a tone performance to be executed, by a time-serial combination of a plurality of the articulation elements;

reading out, from said data base, tonal factor characteristic data, indicative of respective characteristics of the tone factors, corresponding to the articulation elements designated by said step of designating;

synthesizing partial waveform data corresponding to the designated articulation elements, on the basis of each of the tonal factor characteristic data read out from said data base; and sequentially connecting together the partial waveform data, synthesized for individual ones of the designated articulation elements, to thereby generate a succession of performance tones comprising the time-serial combination of the articulation elements.

9. A tone data making device comprising:

a sampling section that samples a performance of a single or a plurality of tones;

a dividing section that divides the performance, sampled by said sampling section, into a plurality of time sections of variable lengths in accordance with characteristics of performance expression therein, to extract waveform data of each of the time sections as an articulation element;

a section that analyzes the waveform data of each of the articulation elements, extracted by said dividing section, in terms of a plurality of predetermined tonal factors and generating tonal characteristic data indicative of respective characteristics of the tonal factors in the articulation element; and a section that stores in a data base the tonal characteristic data corresponding to the extracted articulation elements.

10. A machine-readable recording medium containing a group of instructions of a program to be executed by a computer for making tone data, said program comprising the steps of:

sampling a performance of a single or a plurality of tones;

dividing the performance, sampled by said step of sampling, into a plurality of time sections of variable lengths in accordance with characteristics of performance expression therein, to extract waveform data of each of the time sections as an articulation element;

analyzing the waveform data of each of the articulation elements, extracted by said step of dividing, in terms of a plurality of predetermined tonal factors and generating tonal characteristic data indicative of respective characteristics of the tonal factors in the articulation element; and storing in a data base the tonal characteristic data corresponding to the extracted articulation elements.

11. A tone synthesizing method comprising the steps of:

designating a tone performance to be executed, by a time-serial combination of a plurality of articulation elements, said articulation elements being organized hierarchically into a plurality of different levels, such as levels of a succession of tones, one of the tones and a partial tone in one of the tones, the tone performance to be executed being designatable by any of the levels;

reading out, from a data base, tone-forming data corresponding to the articulation elements designated by said step of designating;

synthesizing waveform data corresponding to the designated articulation elements, on the basis of the tone forming data read out from said data base; and sequentially connecting together the waveform data, synthesized for individual ones of the designated articulation elements, to thereby generate a succession of performance tones comprising the time-serial combination of the articulation elements.

12. A tone synthesizing method comprising:

a first step of dividing one or more continuous tones into a plurality of time elements and supplying element data indicative of a tonal characteristic for each of the time elements;

a second step of selecting a particular one of the time elements;

a third step of selecting desired element data from among a plurality of element data stored in a data base and replacing the element data of the particular time element, selected by said second step, with the selected element data; and a fourth step of generating a tone waveform for each of the time elements on the basis of the element data for said time element, wherein the one or more continuous tones are synthesized by sequentially connecting together the tone waveforms of individual ones of the time elements generated by said fourth step and the synthesized one or more continuous tones have tonal characteristics having been variably controlled in accordance with replacement of the element data by said third step.

13. A tone synthesizing method comprising:

a first step of dividing one or more continuous tones into a plurality of time elements and supplying variation data indicative of respective variations of a plurality of tonal factors for each of the time elements;

a second step of selecting a particular one of the time elements;

a third step of selecting desired variation data from among a plurality of variation data of a predetermined tonal factor stored in a data base and replacing the variation data of said predetermined tonal factor for the particular time element, selected by said second step, with the selected variation data; and a fourth step of generating a tone waveform for each of the time elements on the basis of the variation data of the plurality of tonal factors in said time element, wherein the one or more continuous tones are synthesized by sequentially connecting together the tone waveforms of individual ones of the time elements generated by said fourth step and the synthesized one or more continuous tones have tonal characteristics having been variably controlled in accordance with replacement of the variation data by said third step.

14. A tone synthesizing method comprising:

a first step of sequentially generating a plurality of instruction data corresponding to a plurality of tonal factors, for each of successive time sections;

a second step of generating respective control waveform data of the plurality of tonal factors, in response to the instruction data generated by said first step; and a third step of synthesizing a tone waveform in said time section, on the basis of the respective control waveform data of the plurality of tonal factors generated by said second step.

15. A tone synthesizing method as recited in claim 14 wherein said plurality of tonal factors include at least a color factor and time factor of a tone in the time section, and wherein said third step synthesizes the tone waveform, based on color control waveform data generated in response to the instruction data of the color factor, with a time axial length of the tone waveform controlled to be stretched or compressed in accordance with time control waveform data generated in response to the instruction data of the time factor.

16. A tone synthesizing method as recited in claim 15 wherein the plurality of tonal factors further include a pitch factor of the tone in the time section, and wherein said third step controls the time-axial length of the synthesized tone waveform to be stretched or compressed independently of pitch control based on pitch control waveform data generated in response to the instruction data of the pitch factor.

17. A tone synthesizing device comprising:

a first section that divides one or more continuous tones into a plurality of time elements and supplies element data indicative of a tonal characteristic for each of the time elements;

a second section that selects a particular one of the time elements;

a third section that selects desired element data from among a plurality of element data stored in a data base and replaces the element data of the particular time element, selected by said second section, with the selected element data; and a fourth section that generates a tone waveform for each of the time elements on the basis of the element data for said time element, wherein the one or more continuous tones are synthesized by sequentially connecting together the tone waveforms of individual ones of the time elements generated by said fourth section and the synthesized one or more continuous tones have tonal characteristics having been variably controlled in accordance with replacement of the element data by said third section.

18. A tone synthesizing device comprising:

a first section that divides one or more continuous tones into a plurality of time elements and supplying variation data indicative of respective variations of a plurality of tonal factors for each of the time elements;

a second section that selects a particular one of the time elements;

a third section that selects desired variation data from among a plurality of variation data of a predetermined tonal factor stored in a data base and replacing the variation data of said predetermined tonal factor in the particular time element, selected by said second section, with the selected variation data; and a fourth section that generates a tone waveform for each of the time elements on the basis of the element data for said time element, wherein the one or more continuous tones are synthesized by sequentially connecting together the tone waveforms of individual ones of the time elements generated by said fourth section and the synthesized one or more continuous tones have tonal characteristics having been variably controlled in accordance with replacement of the variation data by said third section.

19. A tone synthesizing device comprising:

a first section that sequentially generates a plurality of instruction data corresponding to a plurality of tonal factors, for each of successive time sections;

a second section that generates respective control waveform data of the tonal factors, in response to the instruction data generated by said first section; and a third section that synthesizes a tone waveform in said time section, on the basis of the respective control waveform data of the tonal factors generated by said second section.

20. A machine-readable recording medium containing a group of instructions of a program to be executed by a computer for synthesizing a tone, said program comprising:

a first step of dividing one or more continuous tones into a plurality of time elements and supplying element data indicative of a tonal characteristic for each of the time elements;

a second step of selecting a particular one of the time elements;

a third step of selecting desired element data from among a plurality of element data stored in a data base and replacing the element data of the particular time element, selected by said second step, with the selected element data; and a fourth step of generating a tone waveform for each of the time elements on the basis of the element data for said time element, wherein the one or more continuous tones are synthesized by sequentially connecting together the tone waveforms of individual ones of the time elements generated by said fourth step and the synthesized one or more continuous tones have tonal characteristics having been variably controlled in accordance with replacement of the element data by said third step.

21. A machine-readable recording medium containing a group of instructions of a program to be executed by a computer for synthesizing a tone, said program comprising:

a first step of dividing one or more continuous tones into a plurality of time elements and supplying variation data indicative of respective variations of a plurality of tonal factors for each of the time elements;

a second step of selecting a particular one of the time elements;

a third step of selecting desired variation data from among a plurality of variation data of a predetermined tonal factor stored in a data base and replacing the variation data of said predetermined tonal factor in the particular time element, selected by said second step, with the selected variation data; and a fourth step of generating a tone waveform for each of the time elements on the basis of the element data for said time element, wherein the one or more continuous tones are synthesized by sequentially connecting together the tone waveforms of individual ones of the time elements generated by said fourth step and the synthesized one or more continuous tones have tonal characteristics having been variably controlled in accordance with replacement of the variation data by said third step.

22. A machine-readable recording medium containing a group of instructions of a program to be executed by a computer for synthesizing a tone, said program comprising:

a first step of sequentially generating a plurality of instruction data corresponding to a plurality of tonal factors, for each of successive time sections;

a second step of generating respective control waveform data of the plurality of tonal factors, in response to the instruction data generated by said first step; and a third step of synthesizing a tone waveform in said time section, on the basis of the respective control waveform data of the plurality of tonal factors generated by said second step.

23. A recording medium containing data for generating a tone waveform, said recording medium comprising:

a first storage section that divides one or more continuous tones into a plurality of time elements and thereby stores therein, for each of the time elements, a plurality of instruction data corresponding to a plurality of tonal factors; and a second storage section that stores therein a plurality of control waveform data corresponding to the plurality of tonal factors, wherein said instruction data designates one of the control waveform data that is to be read out from said second storage section.

24. A recording medium as recited in claim 23 wherein each of the instruction data corresponding to one of the predetermined tonal factors in one of the time elements is optionally rewritable, and the control waveform data to be read out from said second storage section in accordance with the instruction data is changeable by rewriting said instruction data.

25. A sound synthesizing device comprising:

a storage section that stores therein a number of partial sound data corresponding to partial time sections of a sound;

a selecting section that, in response to designation of a desired style of rendition from among various predetermined styles of rendition, selects one or more of the partial sound data corresponding to the designated desired style of rendition; and a waveform generating section that generates a partial sound waveform for each of the partial time sections on the basis of the one or more partial sound data selected by said selecting section and then generates a performance sound corresponding to the designated desired style of rendition by connecting together the partial sound waveforms generated for individual ones of the partial time sections.

26. A sound data base comprising:

a first data base section that, for each of a plurality of musically-possible styles of rendition comprising one or more continuous sounds, divides the one or more continuous sounds, constituting the style of rendition, into a plurality of partial time sections and stores therein style-of-rendition element sequence data sequentially designating style-of-rendition elements for individual ones of the partial time sections; and a second data base section that stores therein data specifically describing partial sound waveforms corresponding to a variety of style-of-rendition elements.

27. A sound data base as recited in claim 26 wherein in order to describe each of the style-of-rendition elements in terms of one or more tonal factors, the style-of-rendition element sequence data stored in said first data base section includes one or more element vector data designating detailed contents of the one or more tonal factors.

28. A sound data base as recited in claim 27 wherein at least one of said element vector data comprises partial vector data designating the contents of the one or more tonal factors for part of one of the partial time sections.

29. A sound data base as recited in claim 27 wherein said second data base section stores therein template data that describe the detailed contents of the tonal factors corresponding to the element vector data.

30. A sound data base as recited in claim 27 wherein said style-of-rendition element sequence data includes index data each designating a style-of-rendition element and also includes, in corresponding relation to each of the index data, the element vector data of one or more tonal factors constituting a partial sound waveform corresponding to the style-of-rendition element designated by said index data, and wherein same element vector data can be shard between different style-of-rendition elements and thereby the template data stored in said second data base section can be shard between different style-of-rendition elements.

31. A sound data base as recited in claim 28 wherein said second data base section stores therein, in corresponding relation to the partial vector data, partial template data describing contents of the tonal factors for said part of the partial time section, and wherein in synthesizing a sound, said partial template data is utlized within a predetermined one of the partial time sections to thereby reproduce whole contents of the tonal factors in the predetermined partial time section.

32. A sound data base as recited in claim 26 wherein the style-of-rendition element sequence data stored in said first data base section includes rule data describing a manner of connecting together adjoining style-of-rendition elements.

33. A sound data base as recited in claim 26 wherein said first data base section includes a storage area for storing style-of-rendition element sequence data optionally created by a user.

34. A sound synthesizing device comprising:

a first data base section that, for each of a plurality of musically-possible styles of rendition comprising one or more continuous sounds, divides the one or more continuous sounds, constituting the style of rendition, into a plurality of partial time sections and stores therein style-of-rendition element sequence data sequentially designating style-of-rendition elements for individual ones of the partial time sections;

a second data base section that stores therein data specifically describing partial sound waveforms corresponding to a variety of style-of-rendition elements; and a waveform generating section that selects one of the style-of-rendition element sequence data in response to designation of a desired style of rendition, reads out the selected style-of-rendition element sequence data from said first data base section and then reads out, from said second data base section, the data specifically describing partial sound waveforms in accordance with the selected style-of-rendition element sequence data read out from said first data base section, to thereby sequentially generate partial sound waveforms corresponding to the style-of-rendition elements for the individual partial time sections.

35. A sound synthesizing device as recited in claim 34 wherein the style-of-rendition element sequence data stored in said first data base section includes one or more element vector data designating contents of one or more tonal factors in order to describe a style-of-rendition element in terms of one or more tonal factors, and at least one of said element vector data comprises partial vector data designating contents of the tonal factors for part of one of the partial time sections, wherein said waveform generating section generates the partial sound waveform corresponding to the style-of-rendition element for the partial time section by combining the one or more tonal factors corresponding to the one or more element vector data, and wherein said waveform generating section determines whether or not the element vector data comprises the partial vector data, and when said element vector data is determined as comprising the partial vector data, said waveform generating section repetitively reads out the contents of the tonal factors designated by the partial vector data, to thereby reproduce whole contents of the tonal factors in one of the partial time sections corresponding thereto.

36. An interactive music performance device comprising:

a storage section that divides waveform data, obtained by sampling a succession of music performance sounds, into a plurality of variable time sections and stores therein information indicative of respective waveform data for individual ones of the time sections:

an editing section that executes editing to modify, replace or delete a component of the waveform data in an optionally selected one of the time sections in response to operation by an user; and a waveform generating section that sequentially generate waveform data for the individual time sections, to thereby reproduce the succession of music performance sounds, wherein the user is allowed to process the succession of music performance sounds in a desired manner individually for each of the time sections.

37. An interactive music performance device as recited in claim 36 wherein said storage section has additionally stored therein attribute information that is indicative respective characteristics of styles-of-rendition present in the waveform data for the individual time sections.

38. An interactive music performance device as recited in claim 36 wherein said storage section includes a first area for storing a plurality of the waveform data corresponding to different partial time sections of various performance sounds and a second area for storing vector data designating waveform data in association with the individual time sections of the succession of music performance sounds, wherein said editing section edits the waveform data in the selected time section by modifying, replacing or deleting the vector data corresponding to said selected time section, and wherein said waveform generating section sequentially generates the waveform data for the individual time sections, by reading out the waveform data from said storage section in accordance with the vector data corresponding to said time sections.

39. A method of executing a music performance by use of a storage section that divides waveform data, obtained by sampling a succession of music performance sounds, into a plurality of variable time sections and stores therein information indicative of respective waveform data for individual ones of the time sections, said method comprising the steps of:

executing editing to modify, replace or delete a component of the waveform data in an optionally selected one of the time sections in response to operation by an user; and sequentially generating waveform data for the individual time sections, to thereby reproduce the succession of music performance sounds, wherein the user is allowed to process the succession of music performance sounds in a desired manner individually for each of the time sections.

40. A machine-readable recording medium containing a group of instructions of a program to be executed by a computer for executing a music performance by use of a storage section which divides waveform data, obtained by sampling a succession of music performance sounds, into a plurality of variable time sections and stores therein information indicative of respective waveform data for individual ones of the time sections, said program comprising the steps of:

executing editing to modify, replace or delete a component of the waveform data in an optionally selected one of the time sections in response to operation by an user; and sequentially generating waveform data for the individual time sections, to thereby reproduce the succession of music performance sounds, wherein the user is allowed to process the succession of music performance sounds in a desired manner individually for each of the time sections.

41. A display device adapted to show a music score which, in correspondence with partial time sections of a substantially continuous music performance, indicates particular articulation information that is indicative of respective characteristics of performance expression in individual ones of the partial time sections, and which describes the music performance by a combination of various pieces of the articulation information indicated in correspondence with a succession of the time sections.

42. A method of executing a sound performance by use of a data base storing therein template data descriptive of partial sound waveforms corresponding to various articulation elements, said method comprising:

a first step of designating a combination of a plurality of pieces of articulation attribute information indicative of respective characteristics of performance expression in a plurality of partial time sections of a sound, to thereby instruct a substantially continuous sound performance over a succession of the time sections;

a second step of generating index data indicative of articulation elements corresponding to the combination of the articulation attribute information designated by said first step; and a third step of, on the basis of the index data, reading out from said data base the template data descriptive of the partial sound waveforms corresponding to predetermined ones of the articulation elements, to thereby sequentially generate partial sound waveforms corresponding to the designated articulation attribute information.

43. A method of executing a sound performance by use of a data base, said data base including a first data base section for, each of a plurality of performance phrases with musical articulation, dividing one or more sounds constituting the performance phrase into a plurality of partial time sections and stores therein articulation element sequences each sequentially designating articulation elements for individual ones of the partial time sections and a second data base section for storing therein template data descriptive of partial sound waveforms corresponding to various articulation elements, said method comprising:

a first step of designating a combination of a plurality of pieces of articulation attribute information indicative of respective characteristics of performance expression in a plurality of partial time sections of a sound, to thereby instruct a substantially continuous sound performance over a succession of the time sections;

a second step of selecting one of the articulation element sequences stored in said first data base section, on the basis of the combination of a plurality of pieces of articulation attribute information designated by said first step; and a third step of reading out from said first data base section the articulation element sequence selected by said second step and, in accordance with the read-out articulation element sequence, reading out from said second data base section the template data descriptive of the partial sound waveforms, to thereby sequentially generate partial sound waveforms corresponding to the articulation elements for the individual partial time sections.

44. A method as recited in claim 43 wherein in said first step, the articulation attribute information in a desired one of the partial time sections can be designated, modified or deleted by a user in a desired manner.

45. A sound performance device comprising:

a data base that stores therein template data descriptive of partial sound waveforms corresponding to various articulation elements;

a first section that designates a combination of a plurality of pieces of articulation attribute information indicative of respective characteristics of performance expression in a plurality of partial time sections of a sound, to thereby instruct a substantially continuous sound performance over a succession of the time sections;

a second section that generates index data indicative of articulation elements corresponding to the combination of the articulation attribute information designated by said first section; and a third section that, on the basis of the index data, reads out from said data base the template data descriptive of the partial sound waveforms corresponding to predetermined ones of the articulation elements, to thereby sequentially generate partial sound waveforms corresponding to the designated combination of the articulation attribute information.

46. An automatic performance device comprising:

a storage section that sequentially stores therein style-of-rendition sequence data for a plurality of performance phrases in a predetermined order of performance thereof, each of the style-of-rendition sequence data describing one of the performance phrases in a time-serial sequence of a plurality of articulation elements;

a reading section that reads out the style-of-rendition sequence data from said storage section; and a waveform generating section that, in accordance with the style-of-rendition sequence data read out by said reading section, sequentially generate waveform data corresponding to the articulation elements constituting a style-of-rendition sequence specified by the read-out style-of-rendition sequence data.

47. An automatic performance device as recited in claim 46 wherein each of the style-of-rendition sequence data corresponding to one of the performance phrases is stored in said storage section along with time data indicative of performance timing of one of the performance phrases corresponding thereto.

48. An automatic performance device as recited in claim 46 wherein each of the style-of-rendition sequence data includes index data each designating one of the articulation elements, and said storage section includes an area for, in association with each of the index data, storing vector data designating contents of one or more tonal factors constituting a partial sound waveform corresponding to the articulation element and an area for storing a plurality of template data specifically describing contents of the one or more tonal factors, and wherein said waveform generating section sequentially reads out the index data of individual ones of the articulation elements designated by the style-of-rendition sequence data read out from said storage section by said reading section and reads out the template data from said storage device in accordance with the read-out vector data, to thereby generate partial sound waveform corresponding to the articulation elements on the basis of the read-out template data.

49. An automatic performance device comprising:

a storage section that sequentially stores therein style-of-rendition sequence data for a plurality of performance phrases in a predetermined order of performance thereof, each of the style-of-rendition sequence data describing one of the performance phrases in a time-serial sequence of a plurality of articulation elements, said storage section also storing therein note performance information in predetermined codes;

a reading section that, in accordance with passage of time, reads out the style-of-rendition sequence data and the note performance information from said storage section;

a waveform generating section that, in accordance with the style-of-rendition sequence data read out by said reading section, sequentially generate waveform data corresponding to the articulation elements constituting a style-of-rendition sequence specified by the read-out style-of-rendition sequence data; and a note sound generating section that generates a tone signal of each note designated in accordance with the note performance information read out by said reading section.

50. A method of executing an automatic performance by use of a storage device storing therein style-of-rendition sequence data for a plurality of performance phrases sequentially in a predetermined order of performance thereof, each of the style-of-rendition sequence data describing one of the performance phrases in a time-serial sequence of a plurality of articulation elements, said method comprising the steps of:

reading out the style-of-rendition sequence data from said storage device; and in accordance with the style-of-rendition sequence data read out by said step of reading out, sequentially generate waveform data corresponding to the articulation elements constituting a style-of-rendition sequence specified by the read-out style-of-rendition sequence data.

51. A machine-readable recording medium containing a group of instructions of a program to be executed by a computer for executing an automatic performance by use of a storage device sequentially storing therein style-of-rendition sequence data for a plurality of performance phrases in a predetermined order of performance thereof, each of the style-of-rendition sequence data describing one of the performance phrases in a time-serial sequence of a plurality of articulation elements, said method comprising the steps of:

reading out the style-of-rendition sequence data from said storage device; and in accordance with the style-of-rendition sequence data read out by said step of reading out, sequentially generate waveform data corresponding to the articulation elements constituting a style-of-rendition sequence specified by the read-out style-of-rendition sequence data.

52. A recording medium containing data for generating a sound waveform, said recording medium comprising:

a first storage section that divides one or more continuous sounds into a plurality of partial time sections and stores therein waveform sequence data designating respective waveform data for individual ones of the partial time sections; and a second storage section that stores therein a number of waveform data, wherein the waveform data to be read out from said second storage section are sequentially designated by the waveform sequence data.

53. A data editing method for a tone data base including a first data base section for, each of a plurality of performance phrases with musical articulation, dividing one or more sounds constituting the performance phrase into a plurality of partial time sections and stores therein an articulation element sequence sequentially designating articulation elements for individual ones of the partial time sections and a second data base section for storing therein template data descriptive of partial sound waveforms corresponding to various articulation elements, said data editing method comprising:

a first step of designating a desired style of rendition; and a second step of searching through said first data base section for the articulation element sequence corresponding to the style of rendition designated by said first step, whereby it can be determined whether or not a desired style of rendition is available from said tone data base.

54. A data editing method as recited in claim 53 which further comprises:

a third step of, when the articulation element sequence corresponding exactly to the designated style of rendition can not be successfully searched for by said second step, selecting a particular one of the articulation element sequences stored in said first data base section which corresponds most closely to the designated style of rendition; and a fourth step of executing an editing operation to modify or replace a selected one of the articulation elements constituting the articulation element sequence selected by said third step or to add a new articulation element to the selected articulation element sequence.

55. A data editing method as recited in claim 54 which further comprises a fifth step of setting a manner of connecting together the template data of the selected articulation element and another articulation element adjoining said selected articulation element in the articulation element sequence edited by said fourth step.

56. A data editing method as recited in claim 55 which further comprises a sixth step of registering, in said first data base section, the articulation element sequence edited by said fourth step as a new articulation element sequence along with data indicative of the manner of connecting set by said fifth step.

57. A data editing method as recited in claim 53 which further comprises:

a third step of, when the articulation element sequence corresponding exactly to the designated style of rendition can not be successfully searched for by said second step, selecting a particular one of the articulation element sequences stored in said first data base section which resembles the designated style of rendition; and a fourth step of selecting, as a subject of editing, any one of the articulation elements constituting the articulation element sequence selected by said third step and modifying contents of the selected articulation element, the partial sound waveform corresponding to the selected articulation element being described by a plurality of the template data corresponding to a plurality of tonal factors, said fourth step modifying the contents of the selected articulation element by replacing any one of the plurality of template data with another template data.

58. A data editing method as recited in claim 57 which further comprises a fifth step of setting a manner of connecting together the template data of the selected articulation element and another articulation element adjoining the selected articulation element in the articulation element sequence modified by said fourth step.

59. A data editing method as recited in claim 58 which further comprises a sixth step of registering, in said first data base section, the articulation element sequence selected by said fourth step as a new articulation element sequence along with data indicative of the manner of connecting set by said fifth step.

60. A data editing method as recited in claim 53 which further comprises:

a third step of, when the articulation element sequence corresponding exactly to the designated style of rendition can not be successfully searched for by said second step, selecting a particular one of the articulation element sequences stored in said first data base section which resembles the designated style of rendition; and a fourth step of selecting, as a subject of editing, any one of the articulation elements constituting the articulation element sequence selected by said third step and modifying contents of the selected articulation element, the partial sound waveform corresponding to the selected articulation element being described by a plurality of the template data corresponding to a plurality of tonal factors, said fourth step modifying the contents of the selected articulation element by modifying contents of any one of the plurality of template data.

61. A data editing method as recited in claim 60 wherein said fourth step registers the template data with the contents modified thereby in said second data base section as new template data.

62. A data editing method as recited in claim 60 which further comprises a fifth step of setting a manner of connecting together the template data of the selected articulation element and another articulation element adjoining said selected articulation element in the articulation element sequence modified by said fourth step.

63. A data editing method as recited in claim 62 which further comprises a sixth step of registering, in said first data base section, the articulation element sequence edited by said fourth step as a new articulation element sequence along with data indicative of the manner of connecting set by said fifth step.

64. A tone data editing device comprising:

a tone data base section that, for each of a plurality of performance phrases with musical articulation, divides one or more sounds constituting the performance phrase into a plurality of partial time sections and stores therein an articulation element sequence sequentially designating articulation elements for individual ones of the partial time sections;

a first section that designates a desired style of rendition; and a second section that searches through said data base section for the articulation element sequence corresponding to the style of rendition designated by said first section, whereby it can be determined whether or not a desired style of rendition is available from said tone data base section.

65. A data editing device as recited in claim 64 which further comprises:

a third section that, when the articulation element sequence corresponding exactly to the designated style of rendition can not be successfully searched for by said second section, selects a particular one of the articulation element sequences stored in said data base section which resembles the designated style of rendition; and a fourth section that executes an editing operation to modify or replace any one of the articulation elements constituting the articulation element sequence selected by said third section or to add a new articulation element to the selected articulation element sequence.

66. A machine-readable recording medium containing a group of instructions of a program to be executed by a computer for editing data in a data base section which, for each of a plurality of performance phrases with musical articulation, divides one or more sounds constituting the performance phrase into a plurality of partial time sections and stores therein an articulation element sequence sequentially designating articulation elements for individual ones of the partial time sections, said program comprising:

a first step of designating a desired style of rendition; and a second step of searching through said data base section for the articulation element sequence corresponding to the style of rendition designated by said first step, whereby it can be determined whether or not a desired style of rendition is available from said tone data base.

67. A sound waveform generating device comprising:

a storage section that stores therein template data descriptive of partial sound waveforms corresponding to partial time sections of a sound;

a reading section that, in accordance with passage of time, reads out the template data descriptive of a plurality of the partial sound waveforms;

a connection processing section that, for each particular one of the template data read out by said reading section from said storage section, defines a manner of connecting the particular template data and other template data adjoining the particular template data, and connects together an adjoining pair of the template data, read out by said reading section, in accordance with the defined manner of connecting; and a waveform generating section that generates partial sound waveform data on the basis of the template data connected by said connection processing section.

68. A sound waveform generating device as recited in claim 67 wherein said connection processing section defines the manner of connecting, by, for each connecting region between the ad joining pair of the template data, selecting one connecting rule from among a plurality of predetermined connecting rules.

69. A sound waveform generating device as recited in claim 67 wherein said storage section stores therein the template data for a plurality of predetermined tonal factors to describe a partial sound waveform, and said connection processing section has a plurality of unique connecting rules for each of the tonal factors and, for each of the template data corresponding to one of the tonal factors, selects one of the connecting rules for the tonal factor, and wherein said connection processing section connects together the adjoining pair of the template data, read out by said reading section, in accordance with the selected connecting rule.

70. A sound waveform generating device as recited in claim 67 which further comprises an editing section that executes editing to modify, replace or delete the template data in an optionally selected one of the partial time sections, and wherein said connection processing section re-defines the manner of connecting for each template edited by said editing section.

71. A sound waveform generating device as recited in claim 68 wherein the plurality of unique connecting rules include a direct connecting rule for directly connecting together adjoining templates, and an interpolative connecting rule for connecting together adjoining templates by use of interpolation.

72. A sound waveform generating device as recited in claim 71 wherein the interpolative connecting rule includes a plurality of different interpolative connecting rules.

73. A sound waveform generating device as recited in claim 72 wherein the interpolative connecting rule includes a rule for effecting interpolative connection such that a value of only one of two templates to be connected together is varied to approach a value of another of the two templates.

74. A sound waveform generating device as recited in claim 72 wherein the interpolative connecting rule includes a rule for effecting interpolative connection such that values of two templates to be connected together are both varied to approach each other.

75. A sound waveform generating device as recited in claim 72 wherein the interpolative connecting rule includes a rule for effecting interpolative connection such that a value of an intermediate one of three templates to be sequentially connected together is varied to approach values of the other templates before and after the intermediate template.

76. A sound waveform generating device as recited in claim 72 wherein the interpolative connecting rule includes a rule for effecting interpolative connection such that a value of an intermediate one of three templates to be sequentially connected together is varied and also a value of at least one of the other templates before and after the intermediate template is varied, to thereby permit smooth interpolative connection between the three templates.

77. A method of generating a sound waveform on the basis of template data descriptive of partial sound waveforms corresponding to partial time sections of a sound, said method comprising the steps of:

setting a unique connecting rule for every connecting region between an adjoining pair of the template data;

connecting together an adjoining pair of the template data in accordance with the connecting rule set by said step of setting, for each of the connecting regions; and generating partial sound waveform data on the basis of the template data connected together by said step of connecting.

78. A machine-readable recording medium containing a group of instructions of a program to be executed by a computer for generating a sound waveform on the basis of template data descriptive of partial sound waveforms corresponding to partial time sections of a sound, said program comprising the steps of:

setting a unique connecting rule for each connecting region between an adjoining pair of the template data;

connecting together an adjoining pair of the template data in accordance with the connecting rule set by said step of setting, for each of the connecting regions; and generating partial sound waveform data on the basis of the template data connected together by said step of connecting.

79. A method of connecting together first and second sound waveforms having respective predetermined time lengths, said method comprising:

a first step of connecting together said first and second sound waveforms in accordance with a predetermined connecting rule and thereby providing a synthesized waveform having a time length prolonged or shortened relative to a total time length of said first and second sound waveforms; and a second step of executing an operation to stretch or compress the time length of the synthesized waveform provided by said first step, by approximately a same length as the prolonged or shortened time length of the synthesized waveform provided by said first step.

80. A method as recited in claim 79 wherein said first step provides the synthesized waveform by inserting a predetermined connecting waveform between said first and second sound waveforms to thereby connect together said first and second sound waveforms, and said synthesized waveform has a stretched time length relative to the total time length of said first and second sound waveforms, and wherein said second step compresses the time length of the synthesized waveform provided by said first step, by approximately a same time length as stretched by insertion of the connecting waveform.

81. A method as recited in claim 80 wherein said connecting waveform is genera ted by repeating a predetermined waveform segment at a connecting end region of at least one of said first and second sound waveforms, and wherein sound waveform cross-fade interpolation synthesis is carried out within said connecting waveform.

82. A method as recited in claim 80 wherein cross-fade interpolation synthesis is carried out between said first and second sound waveforms via said connecting waveform.

83. A device for connecting together first and second sound waveforms having respective predetermined time lengths, said device comprising:

a first section that connects together said first and second sound waveforms in accordance with a predetermined connecting rule and thereby providing a synthesized waveform having a time length prolonged or shortened relative to a total time length of said first and second sound waveforms; and a second section that executes an operation to stretch or compress the time length of the synthesized waveform provided by said first section, by approximately a same length as the prolonged or shortened time length of the synthesized waveform provided by said first section.

84. A machine-readable recording medium containing a group of instructions of a program to be executed by a computer for connecting together first and second sound waveforms having respective predetermined time lengths, said method comprising:

a first step of connecting together said first and second sound waveforms in accordance with a predetermined connecting rule and thereby providing a synthesized waveform having a time length prolonged or shortened relative to a total time length of said first and second sound waveforms; and a second step of executing an operation to stretch or compress the time length of the synthesized waveform provided by said first step, by approximately a same length as the prolonged or shortened time length of the synthesized waveform provided by said first step.

85. A vibrato sound generating device comprising:

a storage section that stores therein a plurality of waveform data sets, each of said waveform data sets having been sporadically extracted from an original vibrato-imparted waveform; and a reading section that repetitively reads out one of the waveform data sets while sequentially switching the waveform data set to be read out and thereby executes a waveform data readout sequence corresponding to a predetermined vibrato period, said reading section repeating the waveform data readout sequence to thereby provide a vibrato over a plurality of vibrato periods.

86. A vibrato sound generating device as recited in claim 85 which further comprises a control data generating section that, in accordance with the waveform data readout sequence, generates control data indicative of a timewise pitch variation, and wherein said reading section varies, over time, a readout rate of the waveform data set in accordance with the control data.

87. A vibrato sound generating device as recited in claim 85 which further comprises a control data generating section that, in accordance with the waveform data readout sequence, generates control data indicative of a timewise amplitude variation, and an amplitude control section that controls, over time, an amplitude of the waveform data read out by said reading section in accordance with the control data.

88. A vibrato sound generating device as recited in claim 85 which further comprises a control data generating section that generates time control data for controlling a length of one vibrato period, and wherein in accordance with the time control data, said reading section variably controls a length of a time period during which one of the waveform data sets is repetitively read out by said reading section and thereby variably controls a time length of the waveform data readout sequence corresponding to the one vibrato period.

89. A vibrato sound generating device as recited in claim 85 wherein said reading section includes a cross-fade synthesis section that executes cross-fade synthesis between a pair of preceding and succeeding waveform data sets being repetitively read out within a predetermined period.

90. A vibrato sound generating method comprising the steps of:

storing in a memory a plurality of waveform data sets, each of said waveform data sets having been sporadically extracted from an original vibrato-imparted waveform; and repetitively reading out predetermined part of one of the waveform data sets from the memory while sequentially switching the waveform data set to be read out and thereby executes a waveform data readout sequence corresponding to a predetermined vibrato period, said reading section repeating the waveform data readout sequence to thereby provide a vibrato over a plurality of vibrato periods.

91. A vibrato sound generating device comprising:

a storage section that stores therein a plurality of sporadic waveform data sets for a plurality of vibrato periods;

a setting section that variable sets a desired readout order in which the waveform data sets are to be read out over a plurality of vibrato periods, by rearranging respective locations, in one vibrato period, of individual ones of the waveform data sets while still maintaining relative locations of the individual waveform data sets in the one vibrato period; and a reading section that repetitively reading out predetermined part of one of the waveform data sets from said storage section while sequentially switching the waveform data set to be read out in accordance with the readout order set by said setting section, to thereby provide a vibrato over a plurality of vibrato periods.

92. A vibrato sound generating device as recited in claim 91 wherein said reading section repeats a waveform data readout sequence based on the readout order set by said setting section.

93. A vibrato sound generating method comprising the steps of:

extracting and storing in a memory a plurality of sporadic waveform data sets for a plurality of vibrato periods;

variably setting a desired readout order in which the waveform data sets are to be read out over a plurality of vibrato periods, by rearranging respective locations, in one vibrato period, of individual ones of the waveform data sets while still maintaining relative locations of the individual waveform data sets in the one vibrato period; and repetitively reading out predetermined part of one of the waveform data sets from the memory while sequentially switching the waveform data set to be read out in accordance with the readout order set by said step of variably setting, to thereby provide a vibrato over a plurality of vibrato periods.

94. A tone synthesizing device comprising:

a processor;

a storage device coupled to said processor, the storage device adapted to store tonal factor characteristic data relating to predetermined tonal factors of partial tone waveforms corresponding to various articulation elements; and a program memory storing instructions for causing the processor to execute a tone synthesizing process comprising the steps of:

designating a tone performance to be executed, by a time-serial combination of a plurality of the articulation elements;

reading out, from said storage device, tonal factor characteristic data, indicative of respective characteristics of the tonal factors, corresponding to the articulation elements designated by said designating step;

synthesizing partial waveform data corresponding to the designated articulation elements, on the basis of each of the tonal factor characteristic data read out from said storage device; and sequentially connecting together the partial waveform data, synthesized for individual ones of the designated articulation elements, to thereby generate a succession of performance tones comprising the time-serial combination of the articulation elements.

95. A tone data making device comprising:

a processor; and a program memory storing instructions for causing the processor to execute a tone data making process comprising the steps of:

sampling a performance of a single or a plurality of tones;

dividing the performance, sampled by said sampling step, into a plurality of time sections of variable lengths in accordance with characteristics of performance expression therein, to extract waveform data of each of the time sections as an articulation element;

analyzing the waveform data of each of the articulation elements, extracted by said dividing step, in terms of a plurality of predetermined tonal factors and generating tonal characteristic data indicative of respective characteristics of the tonal factors in the articulation element; and storing in a data base the tonal characteristic data corresponding to the extracted articulation elements.

96. A tone synthesizing device comprising:

a processor; and a program memory storing instructions for causing the processor to execute a tone synthesizing process comprising the steps of:

a first step of dividing one or more continuous tones into a plurality of time elements and supplying element data indicative of a tonal characteristic for each of the time elements;

a second step of selecting a particular one of the time elements;

a third step of selecting desired element data from among a plurality of element data stored in a data base and replacing the element data of the particular time element, selected by said second step, with the selected element data; and a fourth step of generating a tone waveform for each of the time elements on the basis of the element data for said time element, wherein the one or more continuous tones are synthesized by sequentially connecting together the tone waveforms of individual ones of the time elements generated by said fourth step and the synthesized one or more continuous tones have tonal characteristics having been variably controlled in accordance with replacement of the element data by said third step.

97. A tone synthesizing device comprising:

a processor; and a program memory storing instructions for causing the processor to execute a tone synthesizing process comprising the steps of:

a first step of dividing one or more continuous tones into a plurality of time elements and supplying variation data indicative of respective variations of a plurality of tonal factors for each of the time elements;

a second step of selecting a particular one of the time elements;

a third step of selecting desired variation data from among a plurality of variation data of a predetermined tonal factor stored in a data base and replacing the variation data of said predetermined tonal factor in the particular time element, selected by said second step, with the selected variation data; and a fourth step of generating a tone waveform for each of the time elements on the basis of the element data for said time element, wherein the one or more continuous tones are synthesized by sequentially connecting together the tone waveforms of individual ones of the time elements generated by said fourth step and the synthesized one or more continuous tones have tonal characteristics having been variably controlled in accordance with replacement of the variation data by said third step.

98. A tone synthesizing device comprising:

a processor; and a program memory storing instructions for causing the processor to execute a tone synthesizing process comprising the steps of:

a first step of sequentially generating a plurality of instruction data corresponding to a plurality of tonal factors, for each of successive time sections;

a second step of generating respective control waveform data of the tonal factors, in response to the instruction data generated by said first step; and a third step of synthesizing a tone waveform in said time section, on the basis of the respective control waveform data of the tonal factors generated by said second step.

99. A sound synthesizing device comprising:

a processor;

a storage device coupled to said processor adapted to store a number of partial sound data corresponding to partial time sections of a sound; and a program memory storing instructions for causing the processor to execute a sound synthesizing process comprising the steps of:

selecting, in response to designation of a desired style of rendition from among various predetermined styles of rendition, one or more of the partial sound data corresponding to the designated desired style of rendition; and generating a partial sound waveform for each of the partial time sections on the basis of the one or more partial sound data selected by said selecting step and then generating a performance sound corresponding to the designated desired style of rendition by connecting together the partial sound waveforms generated for individual ones of the partial time sections.

100. A sound synthesizing device comprising:

a processor; and a program memory storing instructions for causing the processor to execute a sound synthesizing process comprising the steps of:

a first step of dividing, for each of a plurality of musically-possible styles of rendition comprising one or more continuous sounds, the one or more continuous sounds, constituting the style of rendition, into a plurality of partial time sections and storing therein style-of-rendition element sequence data sequentially designating style-of-rendition elements for individual ones of the partial time sections;

a second step of storing data specifically describing partial sound waveforms corresponding to a variety of style-of-rendition elements; and a third step of selecting one of the style-of-rendition element sequence data in response to designation of a desired style of rendition, reading out the selected style-of-rendition element sequence data from said first step and then reading out, from said second step, the data specifically describing partial sound waveforms in accordance with the selected style-of-rendition element sequence data read out from said first step, to thereby sequentially generate partial sound waveforms corresponding to the style-of-rendition elements for the individual partial time sections.

101. An interactive music performance device comprising:

a processor;

a storage device coupled to said processor adapted to divide waveform data, obtained by sampling a succession of music performance sounds, into a plurality of variable time sections and adapted to store therein information indicative of respective waveform data for individual ones of the time sections; and a program memory storing instructions for causing the processor to execute a music performance, said program comprising the steps of:

executing editing to modify, replace or delete a component of the waveform data in an optionally selected one of the time sections in response to operation by a user; and sequentially generating waveform data for the individual time sections, to thereby reproduce the succession of music performance sounds, wherein the user is allowed to process the succession of music performance sounds in a desired manner individually for each of the time sections.

102. A sound performance device comprising:

a processor; and a program memory storing instructions for causing the processor to execute a sound performance process comprising the steps of:

storing template data descriptive of partial sound waveforms corresponding to various articulation elements;

designating a combination of a plurality of pieces of articulation attribute information indicative of respective characteristics of performance expression in a plurality of partial time sections of a sound, to thereby instruct a substantially continuous sound performance over a succession of the time sections;

generating index data indicative of articulation elements corresponding to the combination of the articulation attribute information designated by said designating step; and reading out, on the basis of the index data, from said storing step the template data descriptive of the partial sound waveforms corresponding to predetermined ones of the articulation elements, to thereby sequentially generate partial sound waveforms corresponding to the designated combination of the articulation attribute information.

103. An automatic performance device comprising:

a processor;

a storage device adapted to sequentially store therein style-of-rendition sequence data for a plurality of performance phrases in a predetermined order of performance thereof, each of the style-of-rendition sequence data describing one of the performance phrases in a time-serial sequence of a plurality of articulation elements; and a program memory storing instructions for causing the processor to execute an automatic performance process comprising the steps of:

reading out the style-of-rendition sequence data from said storage device; and in accordance with the style-of-rendition sequence data read out by said reading out step, sequentially generating waveform data corresponding to the articulation elements constituting a style-of-rendition sequence specified by the read-out style-of-rendition sequence data.

104. An automatic performance device comprising:

a processor;

a storage device adapted to sequentially store therein style-of-rendition sequence data for a plurality of performance phrases in a predetermined order of performance thereof, each of the style-of-rendition sequence data describing one of the performance phrases in a time-serial sequence of a plurality of articulation elements, said storage device also adapted to store therein note performance information in predetermined codes; and a program memory storing instructions for causing the processor to execute an automatic performance process comprising the steps of:

in accordance with passage of time, reading out the style-of-rendition sequence data and the note performance information from said storage device;

in accordance with the style-of-rendition sequence data read out by said reading out step, sequentially generating waveform data corresponding to the articulation elements constituting a style-of-rendition sequence specified by the read-out style-of-rendition sequence data; and generating a tone signal of each note designated in accordance with the note performance information read out by said reading out step.

105. A tone data editing device comprising:

a processor;

a data base storage device adapted to store a tone data base that, for each of a plurality of performance phrases with musical articulation, divides one or more sounds constituting the performance phrase into a plurality of partial time sections and stores therein an articulation element sequence sequentially designating articulation elements for individual ones of the partial time sections; and a program memory storing instructions for causing the processor to execute a tone data editing process comprising the steps of:

a first step of designating a desired style of rendition; and a second step of searching through said data base storage device for the articulation element sequence corresponding to the style of rendition designated by said first step, whereby it can be determined whether or not a desired style of rendition is available from said tone data base storing device.

106. A sound waveform generating device comprising:

a processor; and a program memory storing instructions for causing the processor to execute a sound waveform generating process comprising the steps of:

a first step of storing template data descriptive of partial sound waveforms corresponding to partial time sections of a sound;

a second step of reading out, in accordance with passage of time, the template data descriptive of a plurality of the partial sound waveforms;

a third step of, for each particular one of the template data read out by said second step from said first step of storing template data, defining a manner of connecting the particular template data and other template data adjoining the particular template data, and connecting together an adjoining pair of the template data, read out by said second step, in accordance with the defined manner of connecting; and a fourth step of generating partial sound waveform data on the basis of the template data connected by said third step.

107. A device for connecting together first and second sound waveforms having respective predetermined time lengths, said device comprising:

a processor; and a program memory storing instructions for causing the processor to execute a process for connecting together first and second sound waveforms having respective predetermined time lengths, said process comprising the steps of:

a first step of connecting together said first and second sound waveforms in accordance with a predetermined connecting rule and thereby providing a synthesized waveform having a time length prolonged or shortened relative to a total time length of said first and second sound waveforms; and a second step of executing an operation to stretch or compress the time length of the synthesized waveform provided by said first step, by approximately a same length as the prolonged or shortened time length of the synthesized waveform provided by said first step.

108. A vibrato sound generating device comprising:

a processor;

a storage device adapted to store therein a plurality of waveform data sets, each of said waveform data sets having been sporadically extracted from an original vibrato-imparted waveform; and a program memory storing instructions for causing the processor to execute a vibrato sound generating process comprising the steps of:

repetitively reading out one of the waveform data sets while sequentially switching the waveform data set to be read out and thereby executing a waveform data readout sequence corresponding to a predetermined vibrato period, said repetitively reading out step repeating the waveform data readout sequence to thereby provide a vibrato over a plurality of vibrato periods.

109. A vibrato sound generating device comprising:

a processor;

a storage device adapted to store therein a plurality of sporadic waveform data sets for a plurality of vibrato periods; and a program memory storing instructions for causing the processor to execute a vibrato sound generating process comprising the steps of:

variably setting a desired readout order in which the waveform data sets are to be read out over a plurality of vibrato periods, by rearranging respective locations, in one vibrato period, of individual ones of the waveform data sets while still maintaining relative locations of the individual waveform data sets in the one vibrato period; and repetitively reading out a predetermined part of one of the waveform data sets from said storage device while sequentially switching the waveform data set to be read out in accordance with the readout order set by said variably setting step, to thereby provide a vibrato over a plurality of vibrato periods.

* * * * *